US012435912B2

(12) United States Patent
Wang et al.

(10) Patent No.: US 12,435,912 B2
(45) Date of Patent: Oct. 7, 2025

(54) THERMAL STORAGE ABSORPTION REFRIGERATION UNIT

(71) Applicants: Quanling Wang, Qinhuangdao (CN); Miaohong Wang, Qinhuangdao (CN)

(72) Inventors: Quanling Wang, Qinhuangdao (CN); Miaohong Wang, Qinhuangdao (CN)

( * ) Notice: Subject to any disclaimer, the term of this patent is extended or adjusted under 35 U.S.C. 154(b) by 0 days.

(21) Appl. No.: 18/986,670

(22) Filed: Dec. 18, 2024

(65) Prior Publication Data

US 2025/0116435 A1 Apr. 10, 2025

Related U.S. Application Data

(63) Continuation of application No. PCT/CN2023/099395, filed on Jun. 9, 2023.

(30) Foreign Application Priority Data

Jul. 19, 2022 (CN) ..... 202210850993.6

(51) Int. Cl.
*F25B 15/00* (2006.01)
*F25B 15/06* (2006.01)
*F25B 30/06* (2006.01)

(52) U.S. Cl.
CPC ..... *F25B 15/06* (2013.01); *F25B 30/06* (2013.01); *F25B 2315/007* (2013.01); *F25B 2400/01* (2013.01)

(58) Field of Classification Search
CPC .... F25B 15/06; F25B 30/06; F28D 2020/006; F24H 1/185
See application file for complete search history.

(56) References Cited

U.S. PATENT DOCUMENTS

2019/0161366 A1* 5/2019 Al-Azazmeh ..... B01D 3/007
2019/0360728 A1* 11/2019 Hatoya ..... C09K 5/047

FOREIGN PATENT DOCUMENTS

| | | | |
|---|---|---|---|
| CN | 205783474 | U | 12/2016 |
| CN | 108487994 | A | 9/2018 |
| CN | 213783243 | U | 7/2021 |
| CN | 114459169 | A | 5/2022 |
| JP | H07120015 | A | 5/1995 |

OTHER PUBLICATIONS

Internation Search Report of PCT/CN2023/099395, Mailed Sep. 8, 2023.

* cited by examiner

*Primary Examiner* — Brian M King

(57) ABSTRACT

A thermal storage absorption refrigeration unit, including: a thermal storage device and an absorption refrigerating machine; an output end of the thermal storage device is connected to an input end of the absorption refrigerating machine. The excessive wind and solar power, along with electricity from the grid during off-peak hours, are stored in thermal storage device in the form of heat. These thermal storage device are configured to serve as the heat source for the absorption refrigerating machine. The thermal storage device can achieve an energy storage efficiency of 96%, offering advantages over battery storage, compressed air energy storage, and pumped hydro storage in terms of safety, efficiency, energy savings, and low upfront investment.

12 Claims, 44 Drawing Sheets

THERMAL STORAGE ABSORPTION REFRIGERATION UNIT

CROSS REFERENCE TO RELATED APPLICATIONS

This application is a continuation application of international application number PCT/CN2023/099395, filed Jun. 9, 2023, which claims priority to Chinese patent application 202210850993.6, filed on Jul. 17, 2022. The contents of these applications are incorporated herein by reference in their entirety.

TECHNICAL FIELD

The present disclosure relates to the technical field of thermal storage, in particular to a thermal storage absorption refrigeration unit.

BACKGROUND

Under the guidance of the "dual carbon" target plan, wind and photovoltaic power generation have developed rapidly. However, wind and photovoltaic power generation are greatly affected by environmental factors. The strength of wind power depends on wind speed, leading to issues such as insufficient wind for generation or excessive wind causing power overload. Photovoltaic power generation entirely relies on sunlight, so its output spikes on sunny days, but it cannot generate power during nighttime or in cloudy, rainy, or snowy conditions. This variability poses significant challenges to the grid.

As a result, the phenomenon of curtailing wind and solar power has become more common. The fundamental reason is that the energy storage capacity of the grid does not match the fluctuating power generation from wind and photovoltaic sources. Therefore, many countries are focusing on developing energy storage systems.

To address the issues mentioned above, several energy storage methods are currently in use.

Lithium-ion battery storage, while lithium-ion battery storage offers low investment and fast construction, it has serious environmental concerns due to battery production and disposal. Additionally, lithium batteries are prone to explosion and fire incidents, and they cannot store energy for long periods.

Pumped hydro storage: Pumped hydro storage overcomes the issues associated with battery storage, but it requires high investment, specific geographic conditions for reservoirs, and a long construction period. Moreover, it is vulnerable to droughts and floods, which can directly impact the effectiveness of reservoir storage.

Compressed air energy storage, compressed air energy storage addresses the shortcomings of pumped hydro storage, but both pumped hydro and compressed air energy storage suffer from low efficiency. The efficiency of the pumps and compressors used in these systems is typically only 60-70%, meaning most of the electricity used in off-peak periods is consumed by the pumps and compressors. During peak electricity periods, when water is released to generate power or compressed air is used to generate electricity, the efficiency of the engines involved is only 50-60%. As a result, almost all the electricity stored during off-peak times is lost, providing no economic value other than serving as energy storage.

In summary, the urgent issue to resolve is the development of energy storage technologies and products that can store energy for long periods, be safe and reliable, and offer low investment with high economic benefits.

Since the signing of the Montreal Protocol, the use of refrigerants (which are major contributors to the greenhouse effect) has been heavily restricted or even banned. The existing technology of lithium bromide absorption refrigerating machines does not use refrigerants, making it a very environmentally friendly cooling option. However, due to the low energy efficiency of the three energy modes used by lithium bromide absorption refrigerating machines (steam, hot water, and direct combustion), they have been largely replaced in recent years by refrigerant-based compression cycle units.

SUMMARY

The present disclosure provides a thermal storage absorption refrigeration unit, to solve the technical problem of low energy utilization efficiency of absorption refrigerants.

To realize the above objective, the present disclosure provides a thermal storage absorption refrigeration unit, including: a thermal storage device and an absorption refrigerating machine wherein an output end of the thermal storage device is connected to an input end of the absorption refrigerating machine.

Furthermore, the thermal storage device includes a phase change thermal storage device or a sensible thermal storage device wherein the phase change thermal storage device is a molten salt thermal storage device or a metal phase change thermal storage device and the sensible thermal storage device is a high temperature refractory or a refractory brick thermal storage device or a thermal conductive oil thermal storage device.

Furthermore, the absorption refrigerating machine is a lithium bromide absorption refrigerating machine, an ammonia absorption refrigerating machine or a steam jet refrigerating machine.

Furthermore, the thermal storage device is a molten salt thermal storage device, and the absorption refrigerating machine is a lithium bromide absorption refrigerating machine wherein the molten salt thermal storage device includes the molten salt thermal storage outer shell, a molten salt thermal storage inner shell, molten salt, a power supply, an electric heating device, and a molten salt circulating pump and the molten salt is disposed in the molten salt thermal storage inner shell and the electric heating device is disposed in the molten salt and the lithium bromide absorption refrigerating machine includes an upper cylinder and a lower cylinder and the upper cylinder includes a condenser, a generator, and lithium bromide solution the lithium bromide solution is provided within the upper cylinder and the generator is immersed in the lithium bromide solution, the condenser is located above the generator, the condenser is set below a water collecting tray and one end of the molten salt circulating pump is connected with the molten salt thermal storage shell and connected with the molten salt, another end of the molten salt circulating pump is connected with one end of the generator, another end of the generator is connected with the molten salt thermal storage inner shell and connected with the molten salt and the lower cylinder includes an evaporator, a refrigerant pump, a spraying device, a solution spraying device, an absorber, lithium bromide solution, a solution purification pump, a solution spraying pump, a concentrate storage cylinder, concentrate, a concentrated liquid discharge pipe and a solution heat exchanger and the evaporator is set below a water collecting tray, the water collecting tray is located above the absorber, the solution spraying device is set above the absorber, and the absorber is provided above the lithium bromide solution and one end of the refrigerant pump is connected to the water collecting tray, another end of the refrigerant pump is connected to the spraying device, and the spraying device is located above the evaporator and one end of the solution purification pump is connected to a lower end of the lower cylinder, and communicated with the lithium bromide solution, another end of the solution spraying pump is connected to a lower end of the upper cylinder through a primary side of the solution heat exchanger, and communicated with the lithium bromide solution, one end of the solution spraying pump is connected to the lower end of the lower cylinder, and communicated with the lithium bromide solution, another end of the solution spraying pump is connected to the solution spraying device, one end of the secondary side of the solution heat exchanger is connected to the lower part of the upper cylinder, and communicated with the lithium bromide solution, another end of the secondary side of the solution heat exchanger is connected to the concentrate storage cylinder, and communicated with the concentrated lithium bromide solution in the concentrate storage cylinder.

Furthermore, the thermal storage device is a thermal conductive oil thermal storage device, and the absorption refrigerating machine is a lithium bromide absorption refrigerating machine wherein, the thermal conductive oil thermal storage device includes a thermal conductive oil storage heat external shell, a thermal conductive oil storage heat internal shell, thermal conductive oil, a power supply, an electric heating device and a thermal conductive oil circulating pump and the lithium bromide absorption refrigerating machine includes the upper cylinder and the lower cylinder and the thermal conductive oil is stored in the internal housing and the electric heating device is immersed in the thermal conductive oil and one end of the thermal conductive oil circulating pump is connected to the thermal conductive oil storage heat internal shell and connected to the thermal conductive oil, another end of the thermal conductive oil circulating pump is connected to an end of the generator in the upper cylinder, another end of the generator is connected to the thermal conductive oil storage inner housing and communicated to the thermal conductive oil.

Furthermore, the thermal storage device includes a phase change thermal storage device and a sensible thermal storage device wherein, the absorption refrigerating machine includes a lithium bromide absorption refrigerating machine the phase change thermal storage device is a molten salt thermal storage device, the molten salt thermal storage device includes the molten salt thermal storage outer shell, the molten salt thermal storage inner shell, the molten salt, the power supply, the electric heating device, a molten salt heat exchanger, a molten salt heat circulating pump, the molten salt heat exchanger is set in the molten salt and the thermal storage device also includes a thermal conductive oil thermal storage device, the thermal conductive oil thermal storage device includes a thermal conductive oil heat storing and exchanging outer shell, a thermal conductive oil heat storing and exchanging internal shell, the thermal conductive oil, thermal conductive oil heat circulating pump, the thermal conductive oil configured in the thermal conductive oil heat storing and exchanging internal shell and one end of the molten salt heat changing and circulating pump is connected to the thermal conductive oil heat storing and exchanging internal shell and connected with the heat conductive oil, another end of the molten salt heat changing and circulating pump is connected to an end of the molten salt heat exchanger, another end of the molten salt heat exchanger is connected to the thermal conductive oil heat storing and exchanging internal shell and connected with the heat conductive oil one end of the thermal conductive oil heat circulating pump is connected to the thermal conductive oil heat storing and exchanging internal shell and communicated with the thermal conductive oil, another end of the thermal conductive oil heat circulating pump is connected to an end of the generator, another end of the generator is connected with the thermal conductive oil heat storing and exchanging internal shell and communicated with the thermal conductive oil.

Furthermore, the thermal storage absorption refrigerating machine is equipped with a two-stage molten salt thermal storage device, a thermal conductive oil storage and heat transfer device and an absorption lithium bromide refrigerating machine; wherein, a first-stage of molten salt thermal storage device includes the molten salt thermal storage outer shell, the molten salt thermal storage inner shell, the molten salt, the power supply, the electric heating device, and the molten salt circulating pump the second-stage of molten salt thermal storage device includes a molten salt thermal storage outer shell, a molten salt thermal storage inner shell, the molten salt, the electric heating device, the power supply, the molten salt heat exchanger, the molten salt heat circulating pump the thermal conductive oil storage and heat transfer device includes the thermal conductive oil heat storing and exchanging outer shell, the thermal conductive oil heat storing and exchanging internal shell, the thermal conductive oil, and the thermal conductive oil heat circulating pump and one end of the molten salt circulating pump is connected to the molten salt thermal storage inner shell and communicated with the molten salt, another end of the molten salt circulating pump is connected to the molten salt heat inner shell and communicated with the molten salt and the molten salt thermal storage internal shell is connected to the molten salt thermal storage inner shell and communicated with the molten salt of the two-stage molten salt thermal storage device; one end of the molten salt heat changing and circulating pump is connected to the thermal conductive oil heat storing and exchanging internal shell and connected to the heat conductive oil, another end of the molten salt heat circulating pump is connected to one end of the molten salt exchanger and another end of the molten salt exchanger is connected to the thermal conductive oil heat storing and exchanging internal shell and connected to the heat conductive oil one end of the thermal conductive oil heat circulating pump is connected with the thermal conductive oil heat storing and exchanging internal shell and communicated with the thermal conductive oil, another end of the thermal conductive oil heat circulating pump is connected to one end of the generator and another end of the generator is connected to the thermal conductive oil heat storing and exchanging internal shell and communicated with the thermal conductive oil.

Furthermore, the thermal storage absorption refrigerating machine is equipped with a phase change thermal storage device, a sensible thermal storage device, and a dual-effect lithium bromide absorption refrigerating machine; and the phase change thermal storage device includes the molten salt thermal storage device, the molten salt thermal storage device includes the molten salt thermal storage outer shell, the molten salt thermal storage inner shell, the molten salt, the power supply, the electric heating device, the molten salt heat exchanger, the molten salt heat circulating pump, the molten salt heat exchanger is set in the molten salt and the thermal storage device includes a thermal conductive oil thermal storage device, the thermal conductive oil heat transfer device includes thermal conductive oil heat storing and exchanging outer shell, the thermal conductive oil heat storing and exchanging internal shell, the thermal conductive oil, the thermal conductive oil heat circulating pump, the thermal conductive oil is stored in the thermal conductive oil heat storing and exchanging internal shell and a three-cylinder dual-effect lithium bromide absorption refrigerating machine includes a high temperature generator, a low temperature generator and the lower cylinder and the high temperature generator cylinder includes a high temperature generator, high temperature lithium bromide solution, a high temperature heat exchanger, a high temperature dilution returning port, and a high temperature solution heat exchanger and the low temperature generator cylinder includes the condenser, a low temperature lithium bromide solution, a low temperature generator, a low temperature dilution returning port, and a low temperature solution heat exchanger and the lower cylinder includes the spraying device, the evaporator, the refrigerant pump, a solution spraying device, the absorber, the lithium bromide solution, and a lithium bromide solution spraying pump and one end of the molten salt heat changing and circulating pump is connected to the thermal conductive oil heat storing and exchanging internal shell and connected with the heat conductive oil, another end of the molten salt heat changing and circulating pump is connected to one end of the molten salt exchanger, and another end of the molten salt exchanger is connected to the thermal conductive oil heat storing and exchanging internal shell and communicated with the heat conductive oil and one end of the thermal conductive oil heat transfer pump is connected with the thermal conductive oil heat storing and exchanging internal shell and communicated with the thermal conductive oil, another end of the heat conduction oil heat transfer pump is connected to one end of the high temperature generator, and another end of the high temperature generator is connected with the thermal conductive oil heat storing and exchanging internal shell and communicated with the thermal conductive oil and one end of the lithium bromide solution spraying pump is connected to the lower cylinder, and communicated with the described lithium bromide solution a first route at another end of the lithium bromide solution spraying pump is connected to the solution spraying device through the concentrate storage cylinder, and a second route is connected with a primary heat exchanging side of the high temperature heat exchanger through the first heat exchange side of the low temperature solution heat exchanger, another end of the heat exchanger is connected to the low temperature dilution returning port and a third route is connected to the high temperature solution heat exchanger and the high temperature dilution heat returning port through a secondary heat exchanging side of the low temperature solution heat exchanger.

Furthermore, including a molten salt thermal storage steam device and a single-acting steam lithium bromide absorption refrigerating machine with two cylinders; wherein, the molten salt thermal storage steam device includes a molten salt thermal storage outer shell, a molten salt thermal storage inner shell, the molten salt, the power supply, the electric heating device, a steam generator, a water pump, a steam tank outer shell, a steam tank inner shell, steam, and a valve wherein, an end of the water pump is connected to an end of the steam generator, another end of the water pump is connected with the water source interface, another end of the steam generator is connected with the steam tank inner shell and connected with the steam an end of the valve is connected to the steam tank inner shell and communicated to the steam, another end of the valve is connected to an end of the generator and another end of the generator is connected to the condensate water.

Furthermore, including a two-stage thermal storage steam device and a single-acting steam lithium bromide refrigerating machine with two cylinders; the two-stage thermal storage device includes the molten salt heat outer shell, the molten salt thermal storage inner shell, the molten salt, the power supply, the electric heating device, the molten salt circulating pump, the molten salt thermal storage outer shell, the molten salt thermal storage inner shell, the steam generator, the waterpump, the steam storage tank outer shell, the steam tank inner shell, the steam, and the valve and one end of the molten salt circulating pump is connected to the molten salt thermal storage inner shell and communicated with the molten salt, another end of the molten salt circulating pump is connected to the molten salt thermal storage inner shell and the molten salt, the molten salt thermal storage inner shell is connected to the molten salt thermal storage inner shell through two levels of molten salt one end of the water pump is connected to one end of the steam generator, another end of the water pump is connected to the water source interface, another end of the steam generator is connected with the steam tank inner shell and communicated with the steam one end of the valve is connected to the steam tank inner shell and communicated to the steam, another end of the valve is connected to one end of the generator and another end of the generator is communicated to the condensate water.

Furthermore, a two-stage molten salt heat storing device, a thermal conductive oil storage and heat transfer steam device, and a steam dual-effect lithium bromide absorption refrigerating machine are provided; the two-stage molten salt heat storing device includes the molten salt heat shell, the molten salt thermal storage inner shell, the molten salt, the power power, the electric heating device, the molten salt circulating pump, the molten salt thermal storage outer shell, the molten salt thermal storage inner shell, a molten salt heat exchanger, and a molten salt heat exchanging and circulating pump and the heat conduction oil storage and heat transfer steam device includes the thermal conductive oil storage and heat transfer steam shell, the thermal conductive oil storage and heat transfer steam shell, the thermal conductive oil, the thermal conductive oil steam generator, the water pump, the steam storage tank outer shell, the steam tank inner shell, the steam, and the valve and the steam dual-effect lithium bromide absorption refrigerating machine includes high temperature generator cylinder, the low temperature cylinder, the lower cylinder and the high temperature cylinder includes the high temperature generator, the high temperature heat exchanger and the low temperature cylinder includes the low temperature generator, the condenser, the lithium bromide solution spraying pump, the high temperature solution heat exchanger, and the low temperature solution heat exchanger one end of the molten salt heat changing and circulating pump is connected with the thermal conductive oil storage and heat transfer steam shell and communicated with the thermal conductive oil, another end of the molten salt heat changing and circulating pump is connected to one end of the molten salt exchanger and another end of the molten salt exchanger is connected with the thermal conductive oil storage and heat transfer steam shell and communicated with the thermal conductive oil one end of the lithium bromide solution spraying pump is connected to the lower cylinder, and communicated with the diluted lithium bromide solution, another end of the lithium bromide solution spraying pump is output in three routes, a first route is connected to the solution spraying device through the concentrate storage cylinder, a second route is connected to one end of the high temperature heat exchanger by the low temperature solution heat exchanger, another end of the high temperature heat exchanger communicates with the low temperature dilution returning port of the low temperature generating cylinder and a third route connects one end of the high temperature heat exchanger through another side of the low temperature solution heat exchanger, another end of the high temperature heat exchanger connects the drain port of diluted lithium bromide solution, and communicated with the high temperature generating cylinder one end of the valve is connected to the steam tank inner shell and communicated with the steam, another end of the valve is connected to one end of the high temperature generator and another end of the high temperature generator is communicated with the condensate water.

Furthermore, the two-stage molten salt thermal storage device, the thermal conductive oil storage and heat transfer device, and a direct fired lithium bromide absorption refrigerating machine are provided; wherein, the first-stage of molten salt thermal storage device includes the molten salt thermal storage outer shell, the molten salt thermal storage inner shell, the molten salt, the power supply, the electric heating device, the molten salt circulating pump and the second-stage of molten salt thermal storage device includes the molten salt thermal storage outer shell, the molten salt thermal storage inner shell, the molten salt, the power supply, the electric heating device, the molten salt heat exchanger, and the molten salt heat circulating pump and the thermal conductive oil storage heat exchange device includes the thermal conductive oil storage heat exchanging outer shell, the thermal conductive oil heat storing and exchanging internal shell, the thermal conductive oil, and the thermal conductive oil heat circulating pump and the direct combustion lithium bromide absorption refrigerating machine is equipped with a high temperature generator, the high temperature lithium bromide solution the high temperature generator is set in the high temperature lithium bromide solution of an original lithium bromide direct fired furnace body the end of high temperature generator is connected to the thermal conductive oil heat storing and exchanging internal shell through the heat exchanging pump, and communicated with the heat conduction oil another end of the high temperature generator is connected to the thermal conductive oil heat storing and exchanging internal shell and communicated with the heat conduction oil.

Furthermore, the two-stage molten salt thermal storage device, the thermal conductive oil thermal storage and heat transfer device, and a heat collecting and supplying system are provided; wherein, the heat collecting and supplying system includes a hot water exchanging outer tank, a hot water exchanging inner tank, hot water, a hot water exchanger, a heat collecting and supplying circulating pump, a radiator or a underfloor heating pipe or a fan coil, and/or a domestic hot water heat exchanger, and a shower head and one end of the hot water heat exchanger is connected with the thermal conductive oil heat storing and exchanging internal shell through the heat conduction oil heat circulating pump and communicated with the heat conduction oil one end of the heat collecting and supplying heating circulating pump is connected to the hot water exchanging inner tank and communicated with the hot water, another end of the heat collecting and supplying heating circulating pump is connected to an end of the radiator or the underfloor heating pipe or the fan coil and/or of the domestic hot water heat exchanger and another end of the radiator or the underfloor heating pipe or the fan coil, and/or the domestic hot water heat exchanger is connected to the hot water exchanging tank box, and comunicated with the hot water the shower head is connected to a tap water interface by the domestic hot water heat exchanger.

Furthermore, the single-phase power supply molten salt thermal storage, the thermal conductive oil storage and heat transfer device, the lithium bromide absorption refrigerating machine, and heat collecting and supplying system are provided; and wherein, the oil thermal storage and heat transfer devices include a single-phase power molten salt thermal storage outer shell, a single-phase power molten salt thermal storage outer shell, a single-phase power supply, an electric heating device, a molten salt pump, the molten salt output heat exchanger, the molten salt output heat circulating pump, the thermal conductive oil heat storing and exchanging outer shell, the thermal conductive oil heat storing and exchanging internal shell, the thermal conductive oil, the thermal conductive oil heat circulating pump, a first winter/summer conversion valve, a second winter/summer conversion valve, a third winter/summer conversion valve, and a fourth winter/summer conversion valve and one end of the molten salt output heat exchanger is connected to the thermal conductive oil heat storing and exchanging internal shell and communicated with the thermal conductive oil, another end of the molten salt output heat exchanger is connected to the thermal conductive oil heat storing and exchanging internal shell and communicated to the thermal conductive oil one end of the thermal conductive oil heat circulating pump is connected to the thermal conductive oil heat storing and exchanging internal shell, and communicated with the thermal conductive oil another end of the thermal conductive oil heat circulating pump is connected to ends of the second winter/summer conversion valve and the fourth winter/summer conversion valve, respectively; and another end of the second winter/summer switching valve is connected to one end of the hot water heat exchanger and another end of the fourth winter/summer conversion valve is connected to one end of the high temperature generator one end of the first winter/summer conversion valve is connected to the thermal conductive oil heat storing and exchanging internal shell, and communicated with the thermal conductive oil another end of the first winter/summer conversion valve is connected to one end of the winter/summer valve, another end of the winter/summer conversion valve is connected to another end of the high temperature generator and another end of the winter/summer conversion valve is also connected to another end of the hot water heat exchanger.

Furthermore, the high temperature refractory or the refractory brick thermal storage device, and the two-stage molten salt thermal storage device, the thermal conductive oil storage and heat transfer device, and the lithium bromide refrigerating machine; wherein, the high temperature refractory material or the refractory brick thermal storage device includes a solid state sensible heat storage device, refractory rick, molten salt heat transfer device, the solid state thermal storage power supply, the electric heating device, and the molten salt circulating pump and the electric heating device is provided in the firebrick of the solid state sensible heat storage device, and the molten salt heat transfer device is set inside the firebrick and one end of the molten salt circulating pump is connected to one end of the molten salt heat exchanger, another end of the molten salt circulating pump is connected to the molten salt thermal storage inner shell and communicated to the molten salt, another end of the molten salt heat exchanger is connected to the molten salt thermal storage inner shell and communicated to the molten salt.

Furthermore, the thermal conductive oil thermal storage device includes an electromagnetic thermal storage outer shell, an electromagnetic thermal storage internal shell, electromagnetic vacuum or/and high temperature insulation material, an electromagnetic induction disk induction coil, an electromagnetic induction coil, an coil connector, a high frequency power distribution control device, a ceramic insulation, an electromagnetic thermal storage power supply, a magnetic wire, a first electromagnetic thermal conductive oil output interface, a second electromagnetic thermal conductive oil output interface, and an electromagnetic thermal storage internal shell electromagnetic induction coil wherein, the electromagnetic thermal storage inner housing is disposed above the ceramic heat insulation layer, the electromagnetic induction disk is disposed under the ceramic insulation layer, the electromagnetic induction disk induction coil is configured in the electromagnetic induction disk, the electromagnetic thermal storage power supply is configured to supply power to the high frequency power distribution control device, the high frequency power distribution control device is configured to provide high frequency electrical energy to the electromagnetic induction disk induction coil; and the electromagnetic induction disk induction coil generates an electromagnetic field, the magnetic wire passes through the electromagnetic thermal storage inner housing and the electromagnetic thermal storage internal shell electromagnetic induction coil is disposed on the outside of the electromagnetic thermal storage inner housing.

Furthermore, a composite dual insulation structure is formed by a vacuum insulation state and a high temperature insulation material and the composite dual insulation structure is located between the molten salt thermal storage outer shell and the molten salt thermal storage inner shell, or the composite dual insulation structure is located between the molten salt thermal storage outer shell and the molten salt thermal storage inner shell, or the composite dual insulation structure is located between the single-phase power molten salt thermal storage outer shell and the single-phase power molten salt thermal storage inner shell.

Furthermore, a composite dual insulation structure is formed by a vacuum insulation state and a high temperature insulation material and the composite dual insulation structure is located between the thermal conductive oil storage heat external shell and the thermal conductive oil storage inner housing, or the composite dual insulation structure is located between the thermal conductive oil heat storing and exchanging outer shell and the thermal conductive oil heat storing and exchanging internal shell, or the composite dual insulation structure is located between a single phase conductive hot oil heat storing and exchanging outer shell and a single phase conductive hot oil heat storing and exchanging inner shell.

Beneficial effects: this application stores wind power, solar power, off-peak grid electricity, and excess electricity in the form of thermal energy in a thermal storage device, and adopts the thermal storage as the heat source for an absorption refrigerating machine. The thermal storage device achieves an efficiency of 96%, offering advantages over battery storage, compressed air energy storage, and pumped hydro storage in terms of safety, efficiency, energy conservation, and low initial investment. By combining the thermal storage device with the absorption refrigerating machine, excess electricity from wind, solar, off-peak grid power, and surplus generation can be stored as thermal energy in summer and used for cooling and air conditioning. In winter, the stored thermal energy is used for heating. During the spring and autumn seasons, it provides domestic hot water. This system enables year-round energy storage for air conditioning, heating, and hot water, transforming energy storage into a high-value economic product that can be sold directly. It overcomes the severe energy loss in the transmission and distribution caused by charging, discharging energy storage systems, as well as the costly investment in power generation equipment for pumped hydro, compressed air storage, and other energy storage methods.

BRIEF DESCRIPTION OF THE DRAWINGS

In order to describe the specific embodiments of this disclosure or the technical solutions in the prior art more clearly, a brief introduction to the drawings of the specific embodiments is provided below. It is apparent that the drawings described below represent some of the embodiments of this disclosure. For those person skilled in the art, it is possible to obtain other drawings based on these, without requiring any inventive effort.

LABELS AND DESCRIPTION

Figure 1:
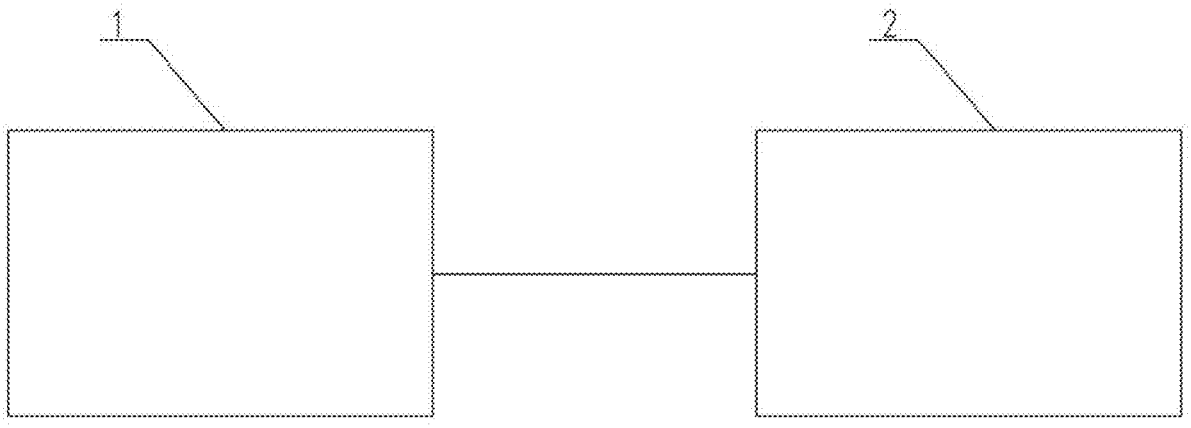
FIG. 1 is a schematic structural diagram of a thermal storage absorption refrigeration unit according to an embodiment of the present disclosure.
Figure 2:
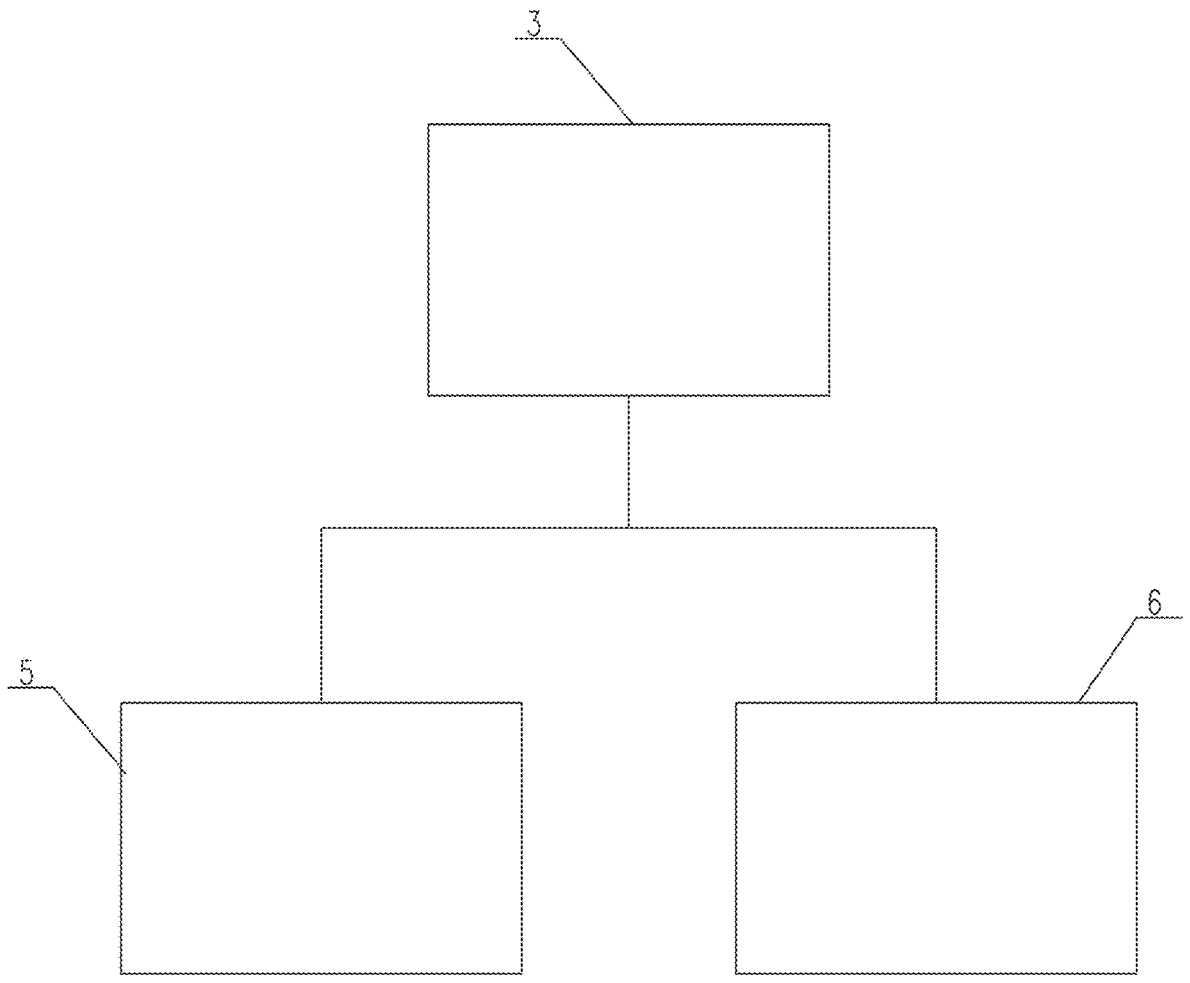
FIG. 2 is a schematic structural diagram of a phase change thermal storage device according to an embodiment of the present disclosure.
Figure 3:
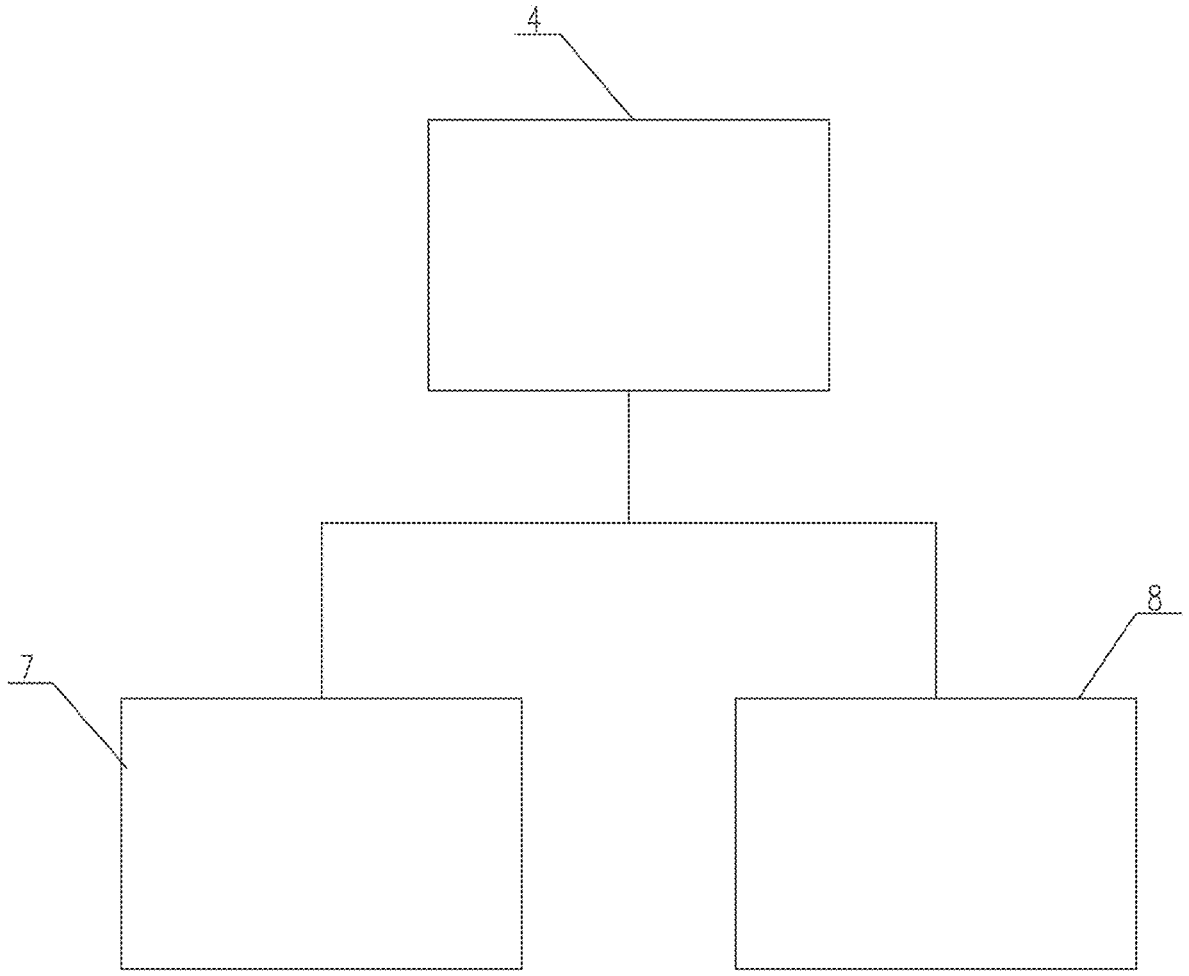
FIG. 3 is a schematic structural diagram of a sensible thermal storage device according to an embodiment of the present disclosure.
Figure 4:
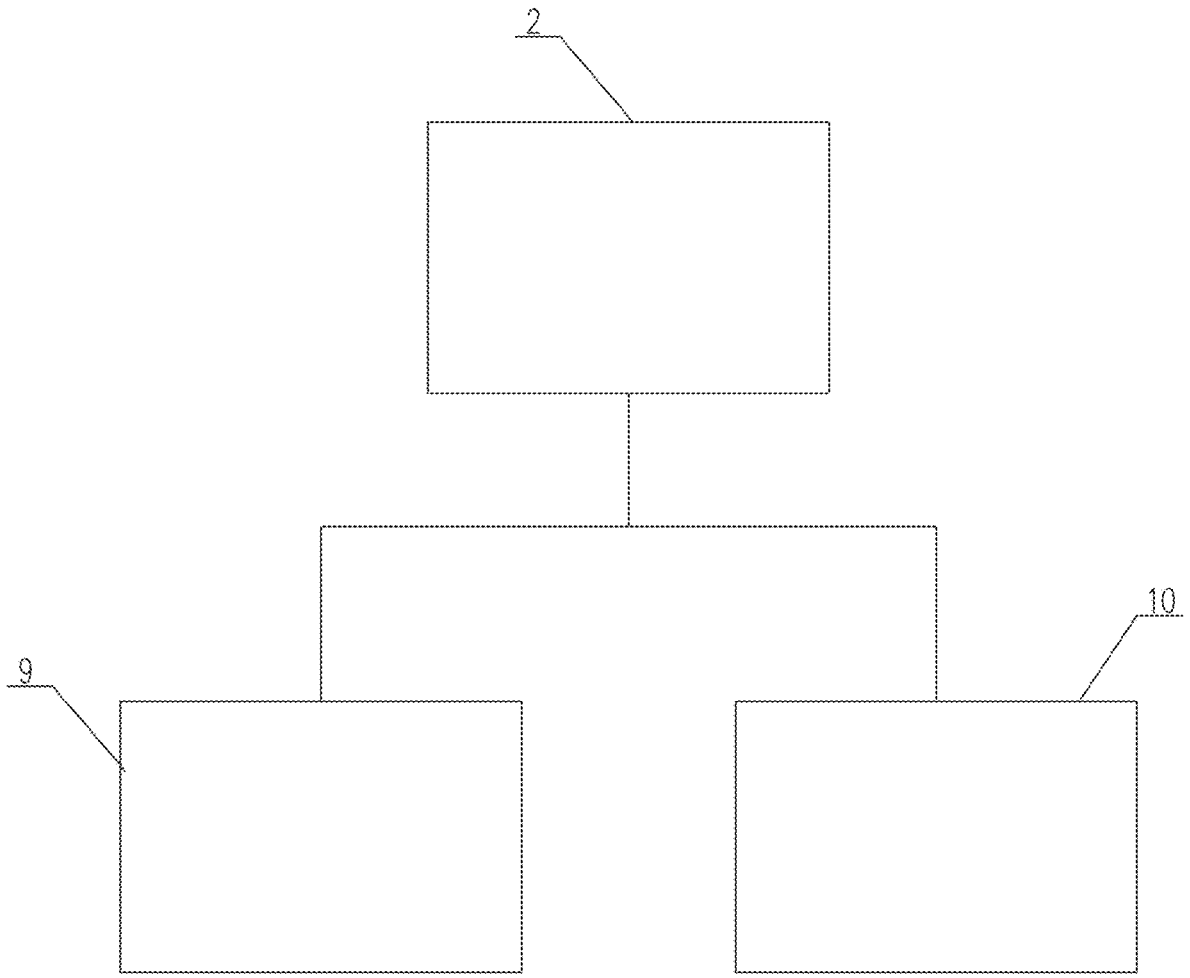
FIG. 4 is a schematic structural diagram of an absorption refrigerating machine according to an embodiment of the present disclosure.

1 thermal storage device, 2 absorption refrigerating machine, 3 phase change thermal storage device, 4 sensible thermal storage device, 5 molten salt thermal storage device, 6 metal phase change thermal storage device, 7 high temperature refractory or a refractory brick thermal storage device, 8 thermal conductive oil thermal storage device, 9 lithium bromide absorption refrigerating machine, 10 ammonia absorption refrigerating machine, 11 the molten salt thermal storage outer shell, 12 molten salt thermal storage inner shell, 13 molten salt, 14 power supply, 15 an electric heating device, 16 molten salt inlet interface, 17 molten salt output interface, 18 upper cylinder, 19 lower cylinder, 20 condenser, 21 first condenser interface, 22 second condenser interface, 23 water collecting tray, 24 steam, 25 condensed water connection pipe, 26 generator, 27 first generator interface, 28 second generator interface, 29 lithium bromide solution, 30 lithium bromide solution outlet interface, 31 lithium bromide solution interface, 32 spraying device, 33 spraying interface, 34 evaporator, 35 first evaporator interface, 36 second evaporator interface, 37 evaporator water receiving tray, 38 refrigerant low temperature steam, 39 refrigerant water interface, 40 refrigerant pump, 41 lithium bromide solution spraying interface, 42 solution spraying device, 43 absorber, 44 first absorber interface, 45 second absorber interface, 46 diluted lithium bromide solution, 47 first diluted lithium bromide solution interface, 48 solution spraying pump, 49 second diluted lithium bromide solution interface, 50 solution spraying pump, 51 concentrate storage cylinder, 52 concentrated lithium bromide solution, 53 concentrated liquid discharge pipe, 54 concentrated liquid exhaust port, 55 concentrated liquid interface, 56 solution heat exchanger, 57 secondary side of the solution heat exchanger, 58 primary side of the solution heat exchanger, 59 condensate water, 60 high pressure and low temperature liquid water spraying device, 61 high pressure and low temperature liquid water, 62 high temperature generator, 63 high temperature lithium bromide solution, 64 low temperature lithium bromide solution, 65 high temperature generator cylinder, 66 low temperature generator, 67 high temperature heat exchanger, 68 low temperature generator cylinder, 69 high temperature dilution returning port, 70 low temperature lithium bromide solution interface, 71 low temperature dilution returning port, 72 lithium bromide solution spraying pump, 73 high temperature solution heat exchanger, 74 low temperature solution heat exchanger, 75 high temperature solution heat exchanging interface, 76 high temperature solution heat exchanger interface, 77 low temperature solution interface, 78 concentrated liquid interface, 79 molten salt circulating pump, 80 thermal conductive oil storage heat external shell, 81 thermal conductive oil storage inner housing, 82 thermal conductive oil, 83 power supply of the thermal conductive oil, 84 electric heating device, 85 first thermal conductive oil interface, 86 second thermal conductive oil, 87 thermal conductive oil circulating pump, 88 molten salt heat exchanger, 89 thermal conductive oil heat storing and exchanging outer shell, 90 thermal conductive oil heat storing and exchanging internal shell, 91 thermal conductive oil heat exchanging interface, 92 thermal conductive oil heat exchanging interface, 93 thermal conductive oil output interface, 94 thermal conductive oil output interface, 95 molten salt heat changing and circulating pump, 96 thermal conductive oil heat circulating pump, 97 molten salt thermal storage outer shell, 98 molten salt thermal storage inner shell, 99 steam generator, 100 first molten salt interface, 101 second molten salt interface, 102 first molten salt heat exchanger interface, 103 second molten salt heat exchanger interface, 104 check valve, 105 water pump, 106 water source interface, 107 steam input interface, 108 steam tank outer shell, 109 steam tank inner shell, 110 heat insulating material, 111 steam, 112 steam output interface, 113 value, 114 check valve, 115 molten salt heat exchanger, 116 first interface of molten salt heat exchanger, 117 second interface of molten salt heat exchanger, 118 molten salt heat exchanging and circulating pump, 119 thermal conductive oil storage and heat transfer steam shell, 120 thermal conductive oil storage and heat exchange inner shell, 121 thermal conductive oil steam generator, 122 first molten salt thermal conductive oil heat exchanging interface, 123 second molten salt thermal conductive oil heat exchanging interface, 124 thermal conductive oil steam output interface, 125 steam water source inlet, 126 hot water exchanging outer tank, 127 hot water exchanging inner tank, 128 hot water exchanging inner tank thermal insulation material, 129 hot water, 130 hot water heat exchanger, 131 first hot water heating heat exchanger interface, 132 second hot water heating heat exchanger interface, 133 heat collecting and supplying circulating pump, 134 radiator, 135 underfloor heating pipe, 136 fan coil, 137 domestic hot water heat exchanger, 138 shower head, 139 tap water interface, 140 single-phase power molten salt thermal storage outer shell, 141 single-phase power molten salt thermal storage outer shell, 142 single-phase power supply, 143 electric heating device, 144 first winter/summer conversion valve, 145 second winter/summer conversion valve, 146 third winter/summer conversion valve, 147 fourth winter/summer conversion valve, 148 solid state sensible heat storage device, 149 firebrick, 150 molten salt heat exchanger, 151 solid state thermal storage power supply, 152 electric heating device, 153 molten salt circulating pump, 154 first molten salt or phase change material interface, 155 second molten salt or phase change material interface, 156 high temperature insulation material, 157 vacuum insulation state, 158 single phase conductive hot oil heat storing and exchanging outer shell, 159 single phase conductive hot oil heat storing and exchanging inner shell, 160 single phase conductive hot oil heat exchanger, 161 thermal conductive oil first heat exchanger, 162 thermal conductive oil second heat exchanger, 163 original lithium bromide direct fired furnace body, 164 domestic hot water heat exchanger, 165 heat collecting and supplying heat exchanger, 166 domestic hot water interface, 167 domestic hot water interface, 168 lithium bromide inlet interface, 169 electromagnetic thermal storage shell, 170 electromagnetic thermal storage internal shell, 171 electromagnetic vacuum or/and high temperature insulation material, 172 electromagnetic induction disk induction coil, 173 electromagnetic induction disk, 174 coil connector, 175 coil connector, 176 high frequency power distribution control device, 177 ceramic insulation, 178 electromagnetic thermal storage power supply, 179 magnetic wire, 180 first electromagnetic thermal conductive oil output interface, 181 second electromagnetic thermal conductive oil output interface, 182 electromagnetic thermal storage internal shell electromagnetic induction coil, 183 molten salt steam output interface, 184 steam jet refrigerating machine, 185 external insulation and protective layer of solid sensible heat storage device, 186 steam condensate heat exchanger, 187 high temperature steam outlet, 188 lower temperature steam outlet, 189 high temperature generator inlet, 190 high temperature generator outlet.

DETAILED DESCRIPTION OF THE EMBODIMENTS

The technical solutions in the embodiments of the present disclosure will be described clearly and completely with reference to the accompanying drawings in the embodiments of the present disclosure. Obviously, the described embodiments are only a part of the embodiments of the present disclosure rather than all of them. Based on the embodiments in the present disclosure, all other embodiments obtained by those skilled in the art without creative work shall fall within the scope of protection of the present disclosure.

In the description of the present disclosure, it should be understood that the terms "center", "longitudinal", "transverse", "length", "width", "thickness", "up", "down", "front", "rear", "left", "right", "vertical", "horizontal", "top", "bottom", "inner", "outer", "clockwise," "counterclockwise" and other directional or positional relationships refer to the orientations or positions based on the FIGs. provided. These terms are used solely for the convenience of describing the disclosure and simplifying the description, and are not meant to indicate or imply that the device or component referred to must have a specific orientation, structure, or operation. Therefore, they should not be construed as limitations of the present disclosure.

Additionally, the terms "first" and "second" are used only for descriptive purposes and should not be understood to indicate or imply relative importance or the quantity of the technical features indicated. Thus, features described as "first" or "second" may explicitly or implicitly include one or more such features. In the description of the present disclosure, the term "plurality" means two or more, unless otherwise specifically defined. Moreover, the terms "mounting", "connecting" and "coupling" should be broadly interpreted. For example, they may refer to either fixed connections, detachable connections, or integral connections; mechanical connections or electrical connections; direct connections or connections through intermediate media; or internal communications between two components. For those skilled in the art, the specific meaning of these terms in the context of the present disclosure can be understood based on the specific circumstances.

As shown in FIGS. 1-4, this embodiment provides a thermal storage absorption refrigeration unit, includes a thermal storage device 1 and an absorption refrigerating machine 2.

An output end of the thermal storage device 1 is connected to an input end of the absorption refrigerating machine 2.

The thermal storage device 1 includes a phase change thermal storage device 3 or a sensible thermal storage device 4.

The phase change thermal storage device 3 is a molten salt thermal storage device 5 or a metal phase change thermal storage device 6.

The sensible thermal storage device 4 is a high temperature refractory or a refractory brick thermal storage device 7 or a thermal conductive oil thermal storage device 8.

The absorption refrigerating machine 2 is a lithium bromide absorption refrigerating machine 9, an ammonia absorption refrigerating machine 10 or a steam jet refrigerating machine 184.

Figure 5:
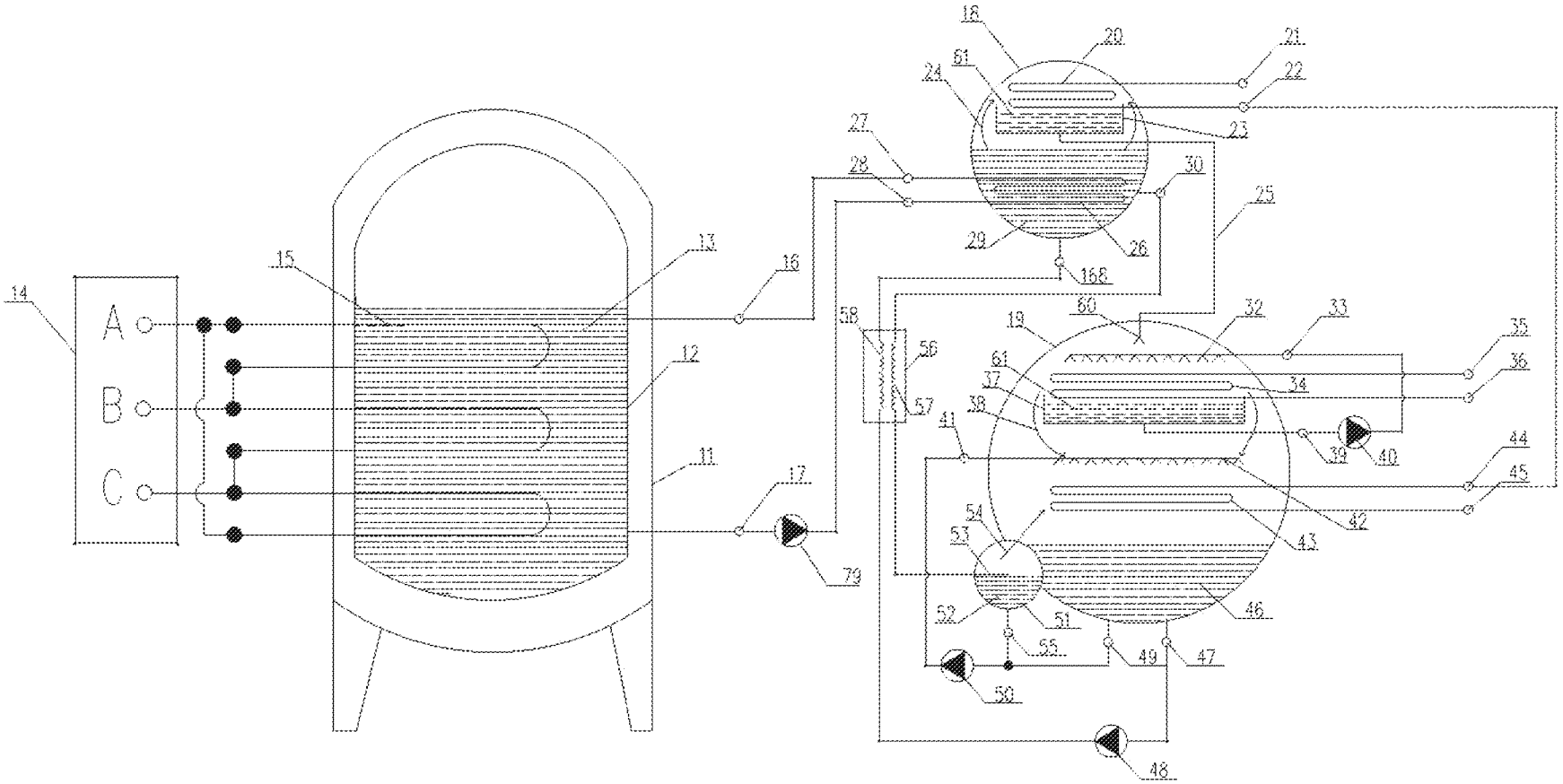
FIG. 5 is a schematic structural diagram of an absorption refrigerating machine with a molten salt thermal storage device according to an embodiment of the present disclosure.

FIG. 5 is a schematic structural diagram of an absorption refrigerating machine with a molten salt thermal storage device according to an embodiment of the present disclosure. the thermal storage device 1 is a molten salt thermal storage device 5, and the absorption refrigerating machine 2 is a lithium bromide absorption refrigerating machine 9.

The molten salt thermal storage device 5 includes the molten salt thermal storage outer shell 11, a molten salt thermal storage inner shell 12, molten salt 13, a power supply 14, an electric heating device 15, and a molten salt circulating pump 79.

As shown in FIG. 5, the molten salt 13 is disposed in the molten salt thermal storage inner shell 12 and the electric heating device 15 is disposed in the molten salt 13. The lithium bromide absorption refrigerating machine 9 includes an upper cylinder 18 and a lower cylinder 19.

As shown in FIG. 5, the upper cylinder 18 includes a condenser 20, a generator 26, and lithium bromide solution 29; the lithium bromide solution 29 is provided within the upper cylinder 18 and the generator 26 is immersed in the lithium bromide solution 29, the condenser 20 is located above the generator 26, the condenser 20 is set below a water collecting tray 23.

FIG. 5 shows that one end of the molten salt circulating pump 79 is connected with the molten salt thermal storage shell 12 and connected with the molten salt 13, another end of the molten salt circulating pump 79 is connected with one end of the generator 26, another end of the generator 26 is connected with the molten salt thermal storage inner shell 12 and connected with the molten salt 13.

The lower cylinder 19 includes an evaporator 34, a refrigerant pump 40, a spraying device 32, a solution spraying device 42, an absorber 43, lithium bromide solution 46, a solution purification pump 48, a solution spraying pump 50, a concentrate storage cylinder 51, concentrate 52, a concentrated liquid discharge pipe 53 and a solution heat exchanger 56.

The evaporator 34 is set below a water collecting tray 37, the water collecting tray 37 is located above the absorber 43, the solution spraying device 42 is set above the absorber 43, and the absorber 43 is provided above the lithium bromide solution 46.

One end of the refrigerant pump 40 is connected to the water collecting tray 37, another end of the refrigerant pump 40 is connected to the spraying device 32, and the spraying device 32 is located above the evaporator 34.

One end of the solution purification pump 48 is connected to a lower end of the lower cylinder 19, and communicated with the lithium bromide solution 46; another end of the solution spraying pump 48 is connected to a lower end of the upper cylinder 18 through a primary side 58 of the solution heat exchanger 56, and communicated with the lithium bromide solution 29. One end of the solution spraying pump 50 is connected to the lower end of the lower cylinder 19, and communicated with the lithium bromide solution 46, another end of the solution spraying pump 50 is connected to the solution spraying device 42. One end of the secondary side 57 of the solution heat exchanger 56 is connected to the lower part of the upper cylinder 18, and communicated with the lithium bromide solution 29, another end of the secondary side 57 of the solution heat exchanger 56 is connected to the concentrate storage cylinder 51, and communicated with the concentrated lithium bromide solution 52 in the concentrate storage cylinder 51.

The lithium bromide refrigeration machine is a commonly used type of absorption refrigeration unit worldwide. It is a system that produces low temperature chilled water above 0° C., typically used in central air conditioning systems. The refrigeration process utilizes the characteristic of lithium bromide absorption refrigeration, where the boiling point of water decreases under vacuum only 4° C. This principle allows for refrigeration by utilizing the latent heat of vaporization when water boils at low temperatures. Therefore, water is used as the refrigerant, and a lithium bromide-water solution serves as the absorbent. This type of refrigeration unit does not use traditional refrigerants, making it an environmentally friendly air conditioning system that aligns with the Montreal Protocol. As such, it is one of the environmentally sustainable refrigeration and air conditioning systems. In the context of the increasingly severe greenhouse effect, the promotion and application of absorption refrigeration machines should be vigorously encouraged. Additionally, it represents a strong development project for the use of wind and photovoltaic green electricity as energy storage. Compared to battery storage, air compressor storage, and pumped storage, it has advantages in safety, efficiency, energy conservation, and lower initial investment. Given the current energy storage bottleneck in wind and photovoltaic power generation, the thermal storage absorption refrigeration machine is an ideal choice for energy storage.

As shown in FIG. 5, during operation, energy storage utilizes off-peak electricity, wind, photovoltaic power generation, or grid off-peak electricity to supply power. The molten salt power supply 14 is connected to supply power to the electric heating device 15, heating the molten salt 13 to transition from a solid phase to a liquid phase. The heating temperature of the molten salt is typically around 600° C., with reports indicating it can be heated up to 900° C. or higher. Of course, the higher the molten salt temperature, the greater the heat storage capacity. However, the ability of the molten salt storage tank to withstand such high temperatures, particularly the cost-effectiveness of the molten salt storage inner shell, should be evaluated comprehensively in terms of cost-performance ratio. The high temperature liquid molten salt 13 is circulated by the molten salt circulating pump 79 and enters the generator 26 through the generator interface 28. The high temperature molten salt 13 heats the high concentration lithium bromide solution 29 in the generator 26. As the water in the lithium bromide solution 29 continuously vaporizes and evaporates, a large amount of steam 24 is produced. This steam is cooled by the circulating cooling water inside the condenser 20, forming high pressure and low temperature liquid water 61. The high pressure and low temperature liquid water 61 collects in the condensation water collecting tray 23 beneath the condenser 20 and is sprayed into the evaporator 34 through the high pressure and low temperature liquid water spraying device 60. The cooling water enters the condenser 20 via the first condenser interface 21, flows out through the second condenser interface 22, and enters the absorber 43 via the first absorber interface 44. After cooling in the cooling tower, the cooling water returns to the condenser 20 and the absorber 43, completing the cooling cycle. After the high temperature liquid molten salt 13 releases heat to the lithium bromide solution 29 in the generator, the over cooled high temperature molten salt 13 is cycled back to the molten salt storage inner shell 12 through the molten salt input interface 16 at the generator interface 27. It is then reheated by the electric heating device 15 to become high temperature molten salt again. The molten salt circulating pump 79 then circulates the molten salt, repeating the process of heating the high temperature and concentrated lithium bromide solution 29 in the generator to evaporate and concentrate it.

Due to the heating of the high temperature concentrated lithium bromide solution 29 in the generator 26, the steam 24 above the surface of the lithium bromide solution has a lower saturated partial pressure than pure water. Moreover, as the concentration of the lithium bromide solution increases, the saturated partial pressure of the steam on the surface decreases, resulting in better refrigeration efficiency. The steam 24 is condensed after being cooled by the circulating cooling water in the condenser, forming high pressure and low temperature liquid water 61. The liquid water 61 passes through a throttling valve and is sprayed into the evaporator 34 via the high pressure and low temperature liquid water spraying device 60, where it rapidly expands and vaporizes to form refrigerant low temperature steam 38. During this vaporization process, a large amount of heat is absorbed from the circulating air-conditioning refrigerant water in the evaporator 34, lowering the temperature of the refrigerant water and achieving the refrigeration effect. During this process, the low temperature steam 38, which absorbs the heat from the refrigerant water in the evaporator, enters the absorber 43, where it is absorbed by the lithium bromide solution sprayed by the lithium bromide solution spraying device 42. Due to the strong hygroscopic nature of lithium bromide, the concentration of the lithium bromide solution gradually decreases. The diluted lithium bromide solution 46 then passes through the diluted lithium bromide solution interface 47, and is pumped by the solution purification pump 48 to the secondary heat exchange side 58 of the solution heat exchanger 56, where it is heated by the high temperature concentrated lithium bromide solution 29 exiting the solution heat exchanger through the primary heat exchange side 57. After heating, the diluted lithium bromide solution enters the high temperature concentrated lithium bromide solution 29 through the lithium bromide entry interface 168 in the upper cylindrical body 18, and is further concentrated in the generator 26.

In another path, after heat exchange in the primary heat exchange side 57 of the solution heat exchanger, the high temperature concentrated lithium bromide solution 29 is sent to the concentrated solution storage cylinder 51 through the concentrated liquid discharge pipe 53. It is then mixed with the diluted lithium bromide solution 46 exiting from the diluted lithium bromide solution interface 49, and the mixture is pumped by the solution spraying pump 50 through the lithium bromide solution spraying interface 41 into the lithium bromide solution spraying device 42, where it is sprayed into the absorber 43. This allows the mixed lithium bromide solution to absorb the steam 38 evaporated from the evaporator. The lithium bromide solution undergoes a cycle of dilution, heating, concentration, and spraying, ultimately achieving the lithium bromide absorption refrigeration effect.

The cooling water enters the condenser 20 from the cooling tower through the first condenser interface 21, then flows into the absorber 43 through the condenser interface 22 and the first absorber interface 44, and finally returns to the cooling tower through the second absorber interface 45, completing the cooling water cycle.

The air-conditioning refrigerant water enters the evaporator 34 through the evaporator interface 35, where it is sprayed, evaporates, and absorbs heat to lower its temperature, becoming chilled water. This chilled water is then discharged from the evaporator through the first evaporator interface 36, forming the chilled water circulation loop.

The thermal storage absorption refrigeration unit has several advantages over conventional steam, fuel oil, and gas-fired absorption refrigeration systems: it can compensate for the heat loss in steam condensation which is typically 80° C. to 90° C. and gas flue gas which is typically 120° C. to 150° C. Therefore, the efficiency of the thermal storage absorption refrigeration system is much higher than that of these three types of conventional absorption refrigeration systems. Additionally, thermal storage uses off-peak electricity pricing for operation, meaning that the operating cost of thermal storage refrigerants is more economical compared to steam, fuel oil, or gas-fired systems.

Figure 6:
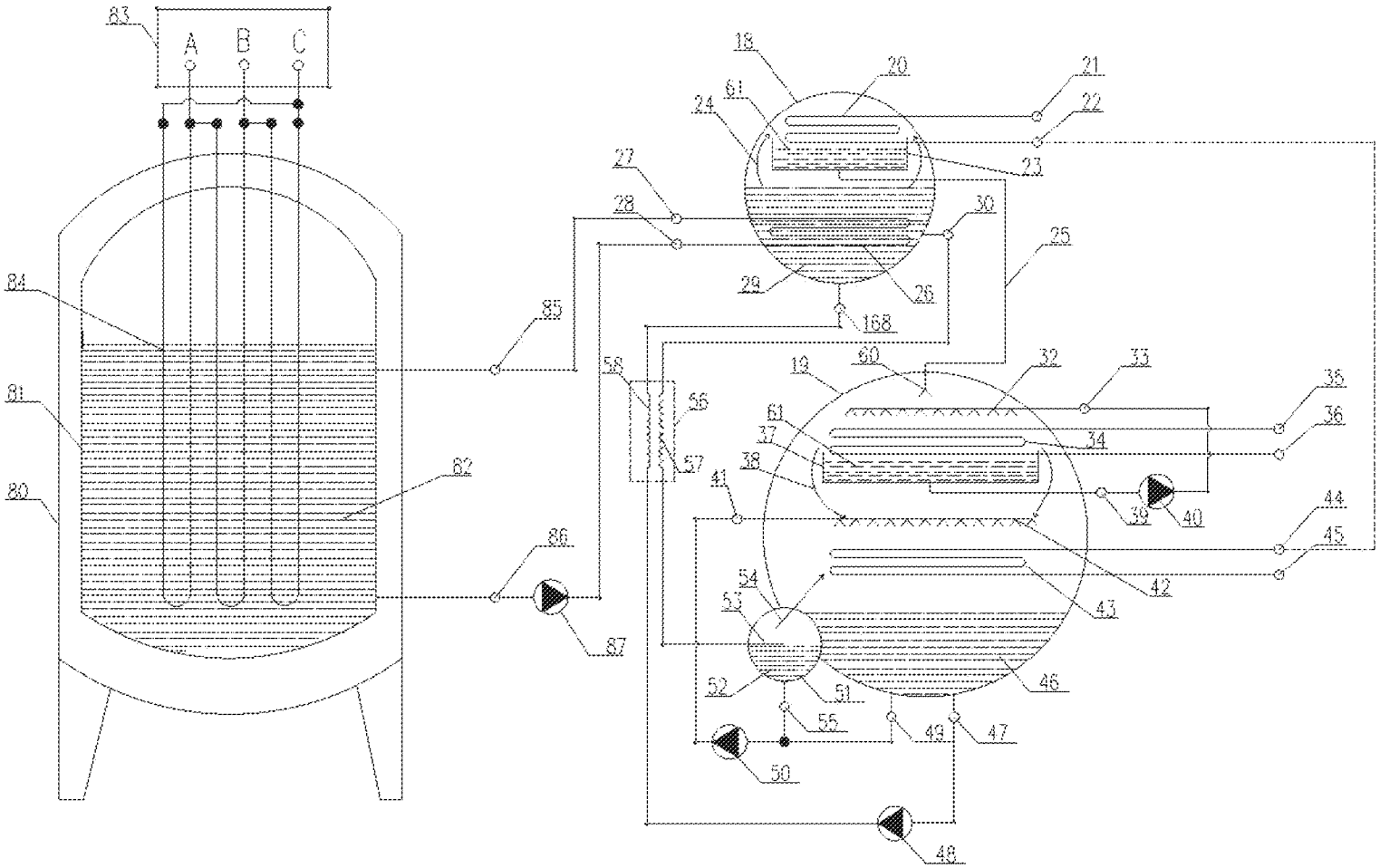
FIG. 6 is a schematic structural diagram of a lithium bromide absorption refrigerating machine with a thermal conductive oil thermal storage device according to an embodiment of the present disclosure.

FIG. 6 is a schematic structural diagram of a lithium bromide absorption refrigerating machine with a thermal conductive oil thermal storage device according to an embodiment of the present disclosure. The only difference between FIG. 6 and FIG. 5 is the heat storage method. FIG. 5 adopts molten salt phase-change thermal storage, while FIG. 6 utilizes sensible heat storage with thermal conductive oil. As for the lithium bromide absorption refrigerating machine, they are exactly the same. The thermal storage device 1 is a thermal conductive oil thermal storage device 8, and the absorption refrigerating machine 2 is a lithium bromide absorption refrigerating machine 9

As shown in FIG. 6, the thermal conductive oil thermal storage device 8 includes a thermal conductive oil storage heat external shell 80, a thermal conductive oil storage heat internal shell 81, thermal conductive oil 82, a power supply 83, an electric heating device 84 and a thermal conductive oil circulating pump 87. The lithium bromide absorption refrigerating machine 9 includes the upper cylinder 18 and the lower cylinder 19.

The thermal conductive oil 82 is stored in the internal housing 81 and the electric heating device 84 is immersed in the thermal conductive oil 82.

One end of the thermal conductive oil circulating pump 87 is connected to the thermal conductive oil storage heat internal shell 81 and connected to the thermal conductive oil 82. Another end of the thermal conductive oil circulating pump 87 is connected to an end of the generator 26 in the upper cylinder 18. And another end of the generator 26 is connected to the thermal conductive oil storage inner housing 81 and communicated to the thermal conductive oil 82.

During operation, the power supply 83 is connected to the power source, and the electric heating device 84 heats the thermal conductive oil 82, generally up to 300° C., with a maximum heating temperature of 350° C. Going beyond this temperature may cause oil sludge to form on the inner walls of the pipes, which is detrimental to the thermal conductive oil system.

The high temperature thermal conductive oil circulates through the thermal conductive oil circulating pump 87, entering the generator 26 from the generator interface 28. The high temperature thermal conductive oil 82 heats the high-concentration lithium bromide solution 29 in the generator 26, causing the water in the lithium bromide solution to continuously vaporize and evaporate, thereby concentrating the lithium bromide solution. The subcooled thermal conductive oil 82 returns from the generator interface 27 through the thermal conductive oil interface 85 to the thermal conductive oil storage inner shell 81, where it mixes with the high temperature thermal conductive oil and continues to be heated. The heated high temperature thermal conductive oil 82 is then input into the thermal conductive oil heat exchanger pump 87 via the thermal conductive oil interface 86, repeating the above cycle and the heating, evaporation, and concentration process of the lithium bromide high-concentration lithium bromide solution 29 in the generator 26. Other aspects are the same as in FIG. 5 and will not be repeated.

Figure 7A:
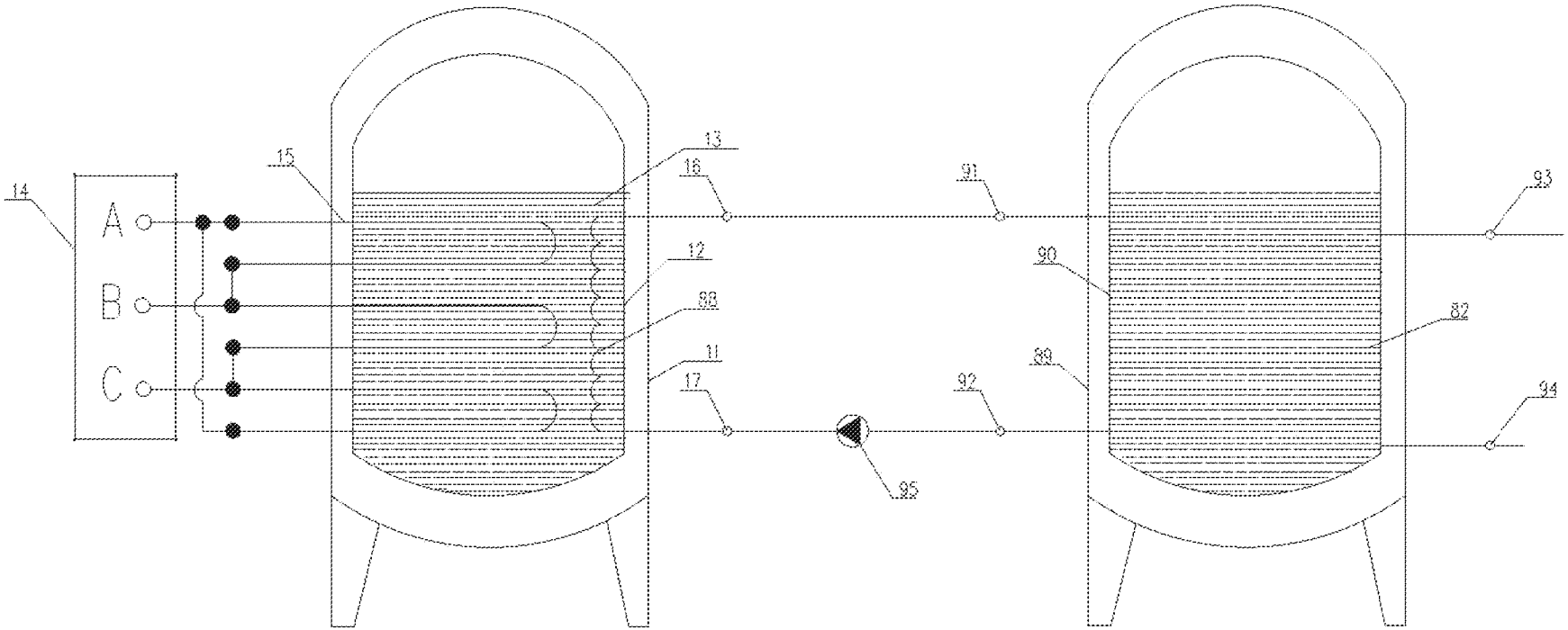
FIG. 7A is a schematic structural diagram of the molten salt thermal storage device and the thermal conductive oil thermal storage device of the lithium bromide absorption refrigerating machine according to an embodiment of the present disclosure.
Figure 7B:
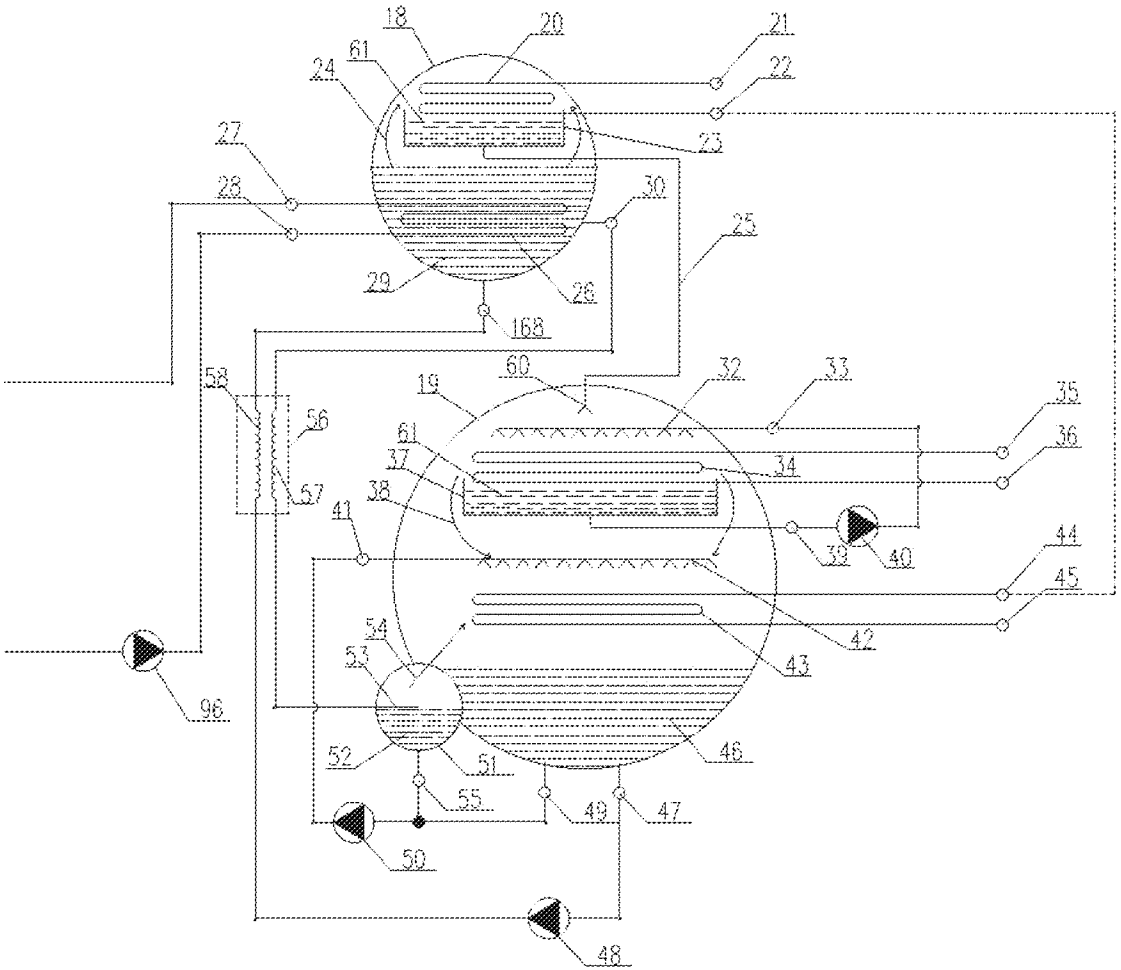
FIG. 7B is a schematic structural diagram of the lithium bromide absorption refrigerating machine with the molten salt thermal storage device and the thermal conductive oil thermal storage device according to an embodiment of the present disclosure.

FIG. 7A is a schematic structural diagram of the molten salt thermal storage device and the thermal conductive oil thermal storage device of the lithium bromide absorption refrigerating machine according to an embodiment of the present disclosure. FIG. 7B is a schematic structural diagram of the lithium bromide absorption refrigerating machine with the molten salt thermal storage device and the thermal conductive oil thermal storage device according to an embodiment of the present disclosure. The thermal storage absorption refrigerating machine is equipped with a two-stage molten salt thermal storage device, a thermal conductive oil storage and heat transfer device and an absorption lithium bromide refrigerating machine. FIG. 7 is an embodiment of a heat exchange structure derived from FIGS. 5 and 6, where the first-stage adopts molten salt for high temperature thermal storage, and the second- stage uses thermal conductive oil for low temperature thermal storage.

A first-stage of molten salt thermal storage device adopts molten salt, includes the molten salt thermal storage outer shell 11, the molten salt thermal storage inner shell 12, the molten salt 13, the power supply 14, the electric heating device 15, the molten salt exchanger 88, the molten salt heat circulating pump 95. The molten salt exchanger 88 is provided inside the molten salt 13.

The low temperature thermal conductive oil storage and heat transfer device includes the thermal conductive oil heat storing and exchanging outer shell 89, the thermal conductive oil heat storing and exchanging internal shell 90, the thermal conductive oil 82, and the thermal conductive oil heat circulating pump 96. The molten salt exchanger 88 is provided inside the thermal conductive oil heat storing and exchanging internal shell 90.

During operation, the electric heating device 15 heats the molten salt 13 to approximately 600° C. The molten salt heat exchange circulating pump 95 circulates the thermal conductive oil 82 into the molten salt heat exchanger 88, where the thermal conductive oil 82 is heated by the molten salt at around 600° C. to the required temperature up to ≤350° C. and stored in the thermal conductive oil heat storing and exchanging inner shell 90.

The thermal conductive oil heat exchange circulating pump 96 adjusts the circulation heat exchange based on the desired ideal temperature for the generator 26, ensuring the efficient, energy-saving, and stable heating of the lithium bromide solution in the generator 26. The molten salt heat exchange circulating pump 95 and the thermal conductive oil output circulating pump 96 can be controlled by variable frequency technology to achieve optimal rotation speeds for energy-saving and efficient operation. Other aspects are the same as in FIGS. 5 and 6, and will not be repeated.

Figure 8A:
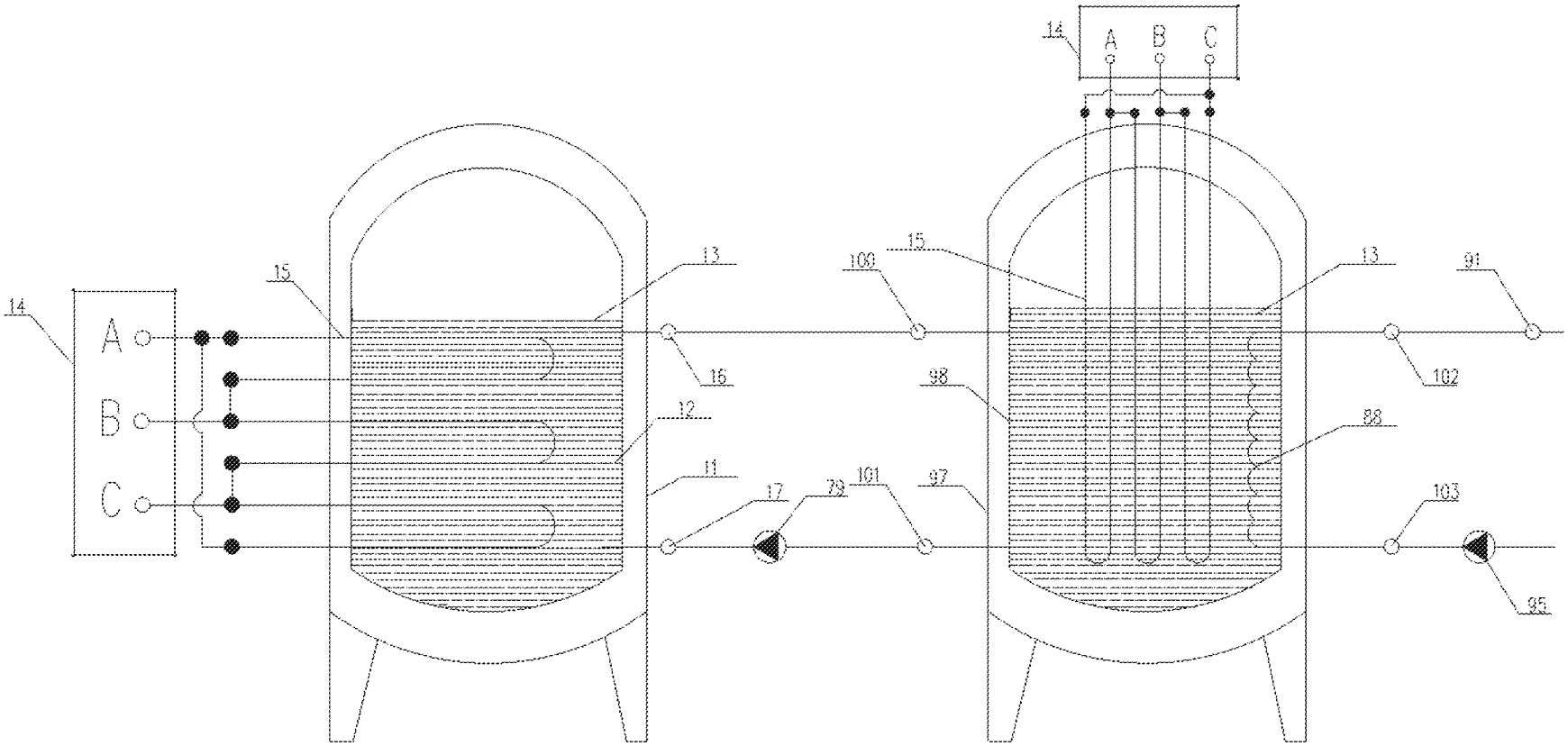
FIG. 8A is a schematic structural diagram of a two-stage molten salt thermal storage device and a thermal conductive oil storage and heat transfer device according to an embodiment of the present disclosure.
Figure 8B:
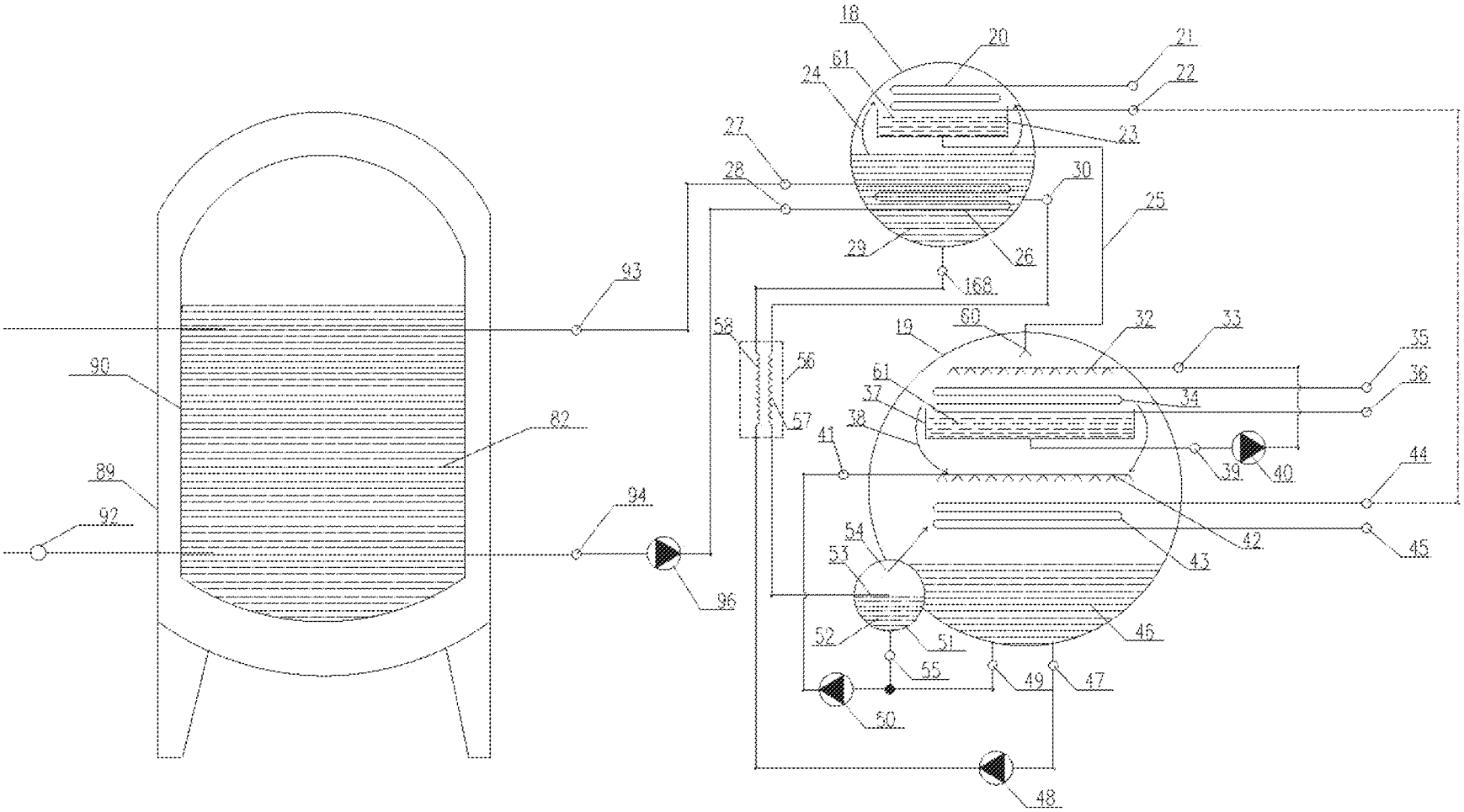
FIG. 8B is a schematic structural diagram of a dual-effect lithium bromide absorption refrigerating machine according to an embodiment of the present disclosure.

FIG. 8A is a schematic structural diagram of a two-stage molten salt thermal storage device and a thermal conductive oil storage and heat transfer device according to an embodiment of the present disclosure. FIG. 8B is a schematic structural diagram of a dual-effect lithium bromide absorption refrigerating machine according to an embodiment of the present disclosure.

As shown in FIGS. 8A and 8B, the first-stage of molten salt thermal storage device includes the molten salt thermal storage outer shell 11, the molten salt thermal storage inner shell 12, the molten salt 13, the power supply 14, the electric heating device 15, and the molten salt circulating pump 79. The second-stage of molten salt thermal storage device includes a molten salt thermal storage outer shell 97, a molten salt thermal storage inner shell 98, the molten salt 13, the electric heating device 14, the power supply 15, the molten salt heat exchanger 88, the molten salt heat circulating pump 95. The thermal conductive oil storage and heat transfer device includes the thermal conductive oil heat storing and exchanging outer shell 89, the thermal conductive oil heat storing and exchanging internal shell 90, the thermal conductive oil 82, and the thermal conductive oil heat circulating pump 96.

One end of the molten salt circulating pump 79 is connected to the molten salt thermal storage inner shell 12 and communicated with the molten salt 13, another end of the molten salt circulating pump 79 is connected to the molten salt heat inner shell 98 and communicated with the molten salt 13; and the molten salt thermal storage internal shell 12 is connected to the molten salt thermal storage inner shell 98 and communicated with the molten salt 13 of the two-stage molten salt thermal storage device.

During operation, the first-stage of molten salt thermal storage device heats the molten salt 13 to approximately 900° C. and stores it in the molten salt thermal storage inner shell 12. The second-stage of molten salt thermal storage device heats the molten salt 13 to approximately 600° C. or 300° C. and stores it in the molten salt thermal storage inner shell. The thermal conductive oil storage and heat transfer device heats the thermal conductive oil to the ideal temperature required for the efficient, energy-saving, and stable heating of the lithium bromide solution in the generator 26.

The reason for the second-stage of molten salt thermal storage device is also equipped with an electric heating device 15 and power supply 14 is that, in its initial state, molten salt is solid and cannot flow, making it difficult to circulate and heat the second-stage molten salt 13 using only the molten salt circulating pump 79. Therefore, the electric heating device 14 and power supply 15 make it more convenient to use, as they can either provide initial heating for heat exchange or independently heat the molten salt.

These three stages, controlled by a variable frequency control device, ensure efficient, energy-saving, and stable heating, thermal storage, and heat exchange, guaranteeing the stable operation of the lithium bromide absorption refrigerating machine 9, which is composed of the upper cylinder 18 and lower cylinder 19. Other aspects are the same as in FIGS. 5, 6, and 7 and will not be repeated. Other aspects are the same as in FIG. 7 and will not be repeated.

Figure 9A:
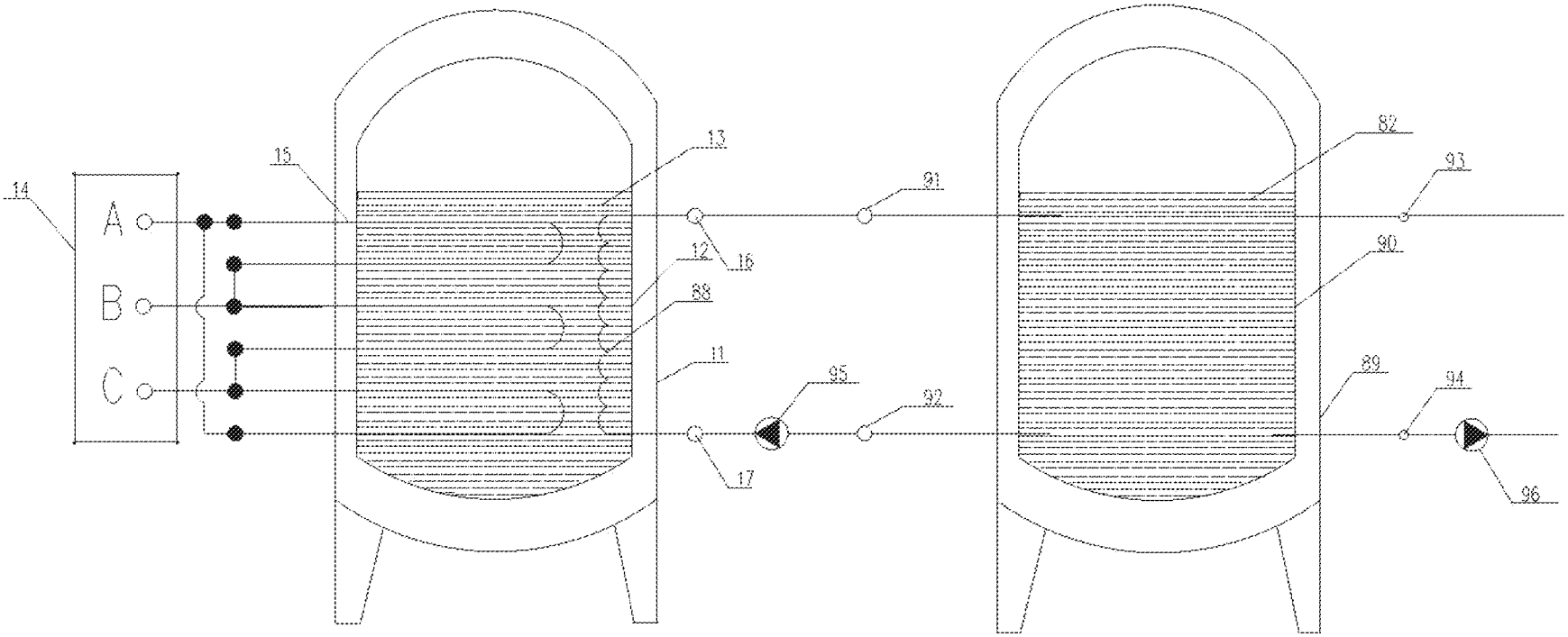
FIG. 9A is a schematic structural diagram of a molten salt thermal storage device and a thermal conductive oil storage and heat transfer device of a thermal storage absorption refrigerating unit with three-cylinder dual-effect lithium bromide absorption refrigerating machine according to an embodiment of the present disclosure.
Figure 9B:
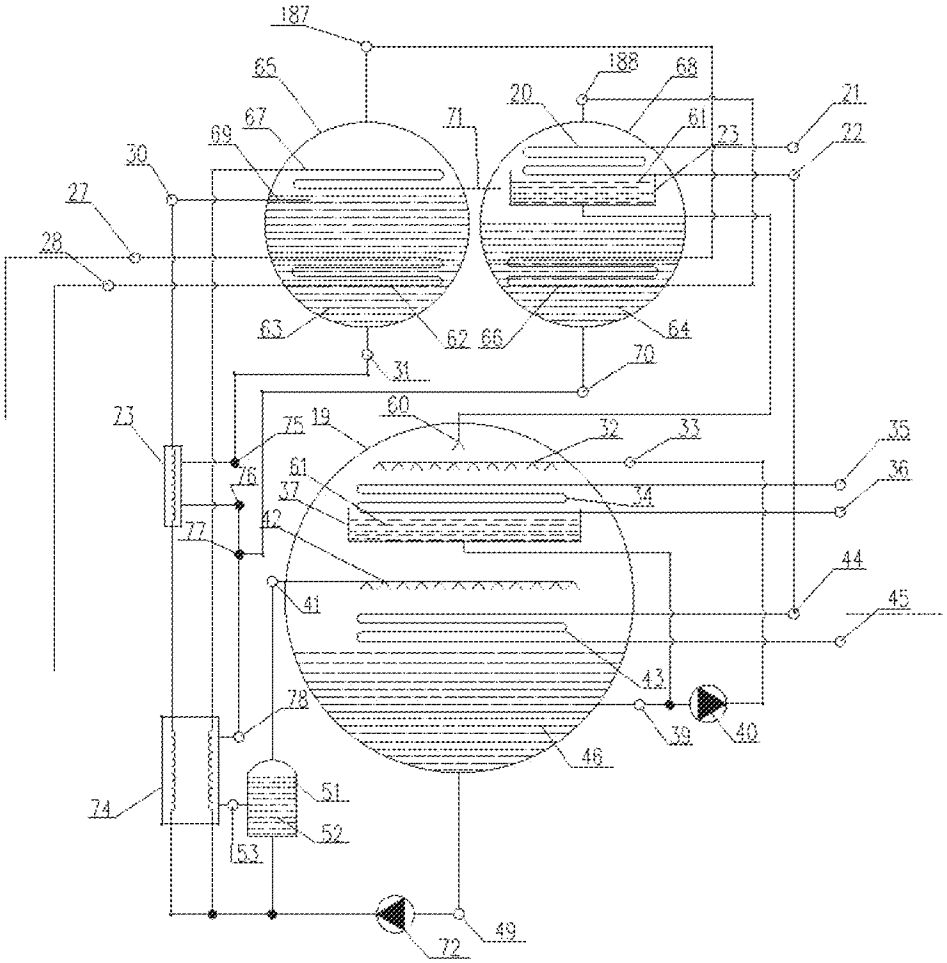
FIG. 9B is a schematic structural diagram of a three-cylinder dual-effect lithium bromide absorption refrigerating machine of a thermal storage absorption refrigerating unit according to an embodiment of the present disclosure.

FIG. 9A is a schematic structural diagram of a molten salt thermal storage device and a thermal conductive oil storage and heat transfer device of a thermal storage absorption refrigerating unit with three-cylinder dual-effect lithium bromide absorption refrigerating machine according to an embodiment of the present disclosure. FIG. 9B is a schematic structural diagram of a three-cylinder dual-effect lithium bromide absorption refrigerating machine of a thermal storage absorption refrigerating unit according to an embodiment of the present disclosure. The thermal storage absorption refrigerating unit of FIGS. 9A and 9B are provided with a three-cylinder dual-effect lithium bromide absorption refrigerating machine. The molten salt thermal storage device and the thermal conductive oil thermal storage device are the same with that of FIG. 7A-7B, and the difference is that the thermal storage absorption refrigerating unit of FIG. 9A and 9B are provided with a three-cylinder dual-effect lithium bromide absorption refrigerating machine.

The basic working principle of the dual-effect lithium bromide absorption refrigerating machine is the same as that of the single-effect lithium bromide absorption refrigerating machine, except that the single-effect refrigerating machine's two-cylinder design is changed to a three-cylinder design. The upper cylinder 18 of the single-effect refrigerating machine is divided into two parts, creating separate high temperature and low temperature generator cylinders, while the lower cylinder 19 remains unchanged, forming a three-cylinder dual-effect lithium bromide absorption refrigerating machine.

The high temperature generator cylinder 65 includes a high temperature generator 62, high temperature lithium bromide solution 63, a high temperature heat exchanger 67, a high temperature dilution returning port 69, and a high temperature solution heat exchanger 73. The low temperature generator cylinder 68 includes the condenser 20, a low temperature lithium bromide solution 64, a low temperature generator 66, a low temperature dilution returning port 71, and a low temperature solution heat exchanger 74.

During operation, the high temperature thermal conductive oil heat circulating pump 96 circulates the high temperature thermal conductive oil 82 to the high temperature generator 62, where it heats the high temperature lithium bromide solution 63. After heat is released from the high temperature generator 62, the subcooled high temperature thermal conductive oil 82 is circulated back to the thermal conductive oil heat storing and exchanging internal shell 90. It is then further heated by the molten salt heat changing and circulating pump pump 95 through the molten salt heat exchanger 88 and continues the cycle of heating the high temperature generator 62.

When the high temperature thermal conductive oil heats the high temperature lithium bromide solution 63, a large amount of high temperature steam exits from the high temperature steam outlet 187 and enters the low temperature generator 66, where it heats the low temperature lithium bromide solution 64. The subcooled steam then enters the low temperature steam inlet 188 and flows into the low temperature generator cylinder 68, where it is cooled by circulating cooling water in the condenser 20, forming high pressure low temperature liquid water 61. The high pressure low temperature liquid water 61 collects in the water collection tray 23 below the condenser 20 and is sprayed into the evaporator 34 by the high pressure and low temperature liquid water spraying device 60.

A first flow of the dilute lithium bromide solution 46 is sent to the lithium bromide solution spraying device 42 via the lithium bromide solution spraying pump 72, after passing through the second diluted lithium bromide solution interface 49 and the concentrated liquid storage cylinder 51. The solution spraying device 42 sprays the diluted lithium bromide solution 46 into the absorber 43.

The second flow of diluted lithium bromide solution 46 is heated by a joint heat exchange with the high temperature lithium bromide solution 63 from the high temperature generator cylinder 65 via the high temperature lithium bromide solution interface 31 and the low temperature lithium bromide solution 64 from the low temperature generator cylinder 68 via the low temperature lithium bromide solution interface 70 in the low temperature solution heat exchanger 74. It is then input into the high temperature heat exchanger 67, where it exchanges heat with the high temperature generator cylinder 65, and the diluted low temperature return solution 71 enters the low temperature generator cylinder 68, where it is heated by the low temperature generator 66 and concentrated.

A joint heat exchanging flow runs from the high temperature lithium bromide solution interface 31 through the high temperature solution heat exchanger 73 to the high temperature solution heat exchanging interface 75 and then converges at the low temperature solution interface 77. The low temperature lithium bromide solution 64, entering through the low temperature lithium bromide solution interface 70, also converges at the low temperature solution interface 77. Both flow together via the concentrated liquid interface 78 and are sent to the concentrated liquid storage cylinder 51 via the concentrated liquid discharge pipe 53.

A third flow of diluted lithium bromide solution 46 is heat-exchanged on the other side of the low temperature solution heat exchanger 74, then flowing into the high temperature solution heat exchanger 73, where it is heated by the high temperature lithium bromide solution 63 from the high temperature generator cylinder 65 via the high temperature lithium bromide solution interface 31. After heat exchange, it exits through the lithium bromide solution discharge interface 30 and is returned via the high temperature diluted returning port 69 into the high temperature generator cylinder 65, where it is heated by the high temperature generator 62 and concentrated into the high temperature lithium bromide solution 63. Other aspects are the same as those of the dual-cylinder single-effect lithium bromide absorption refrigerating machine.

Figure 10A:
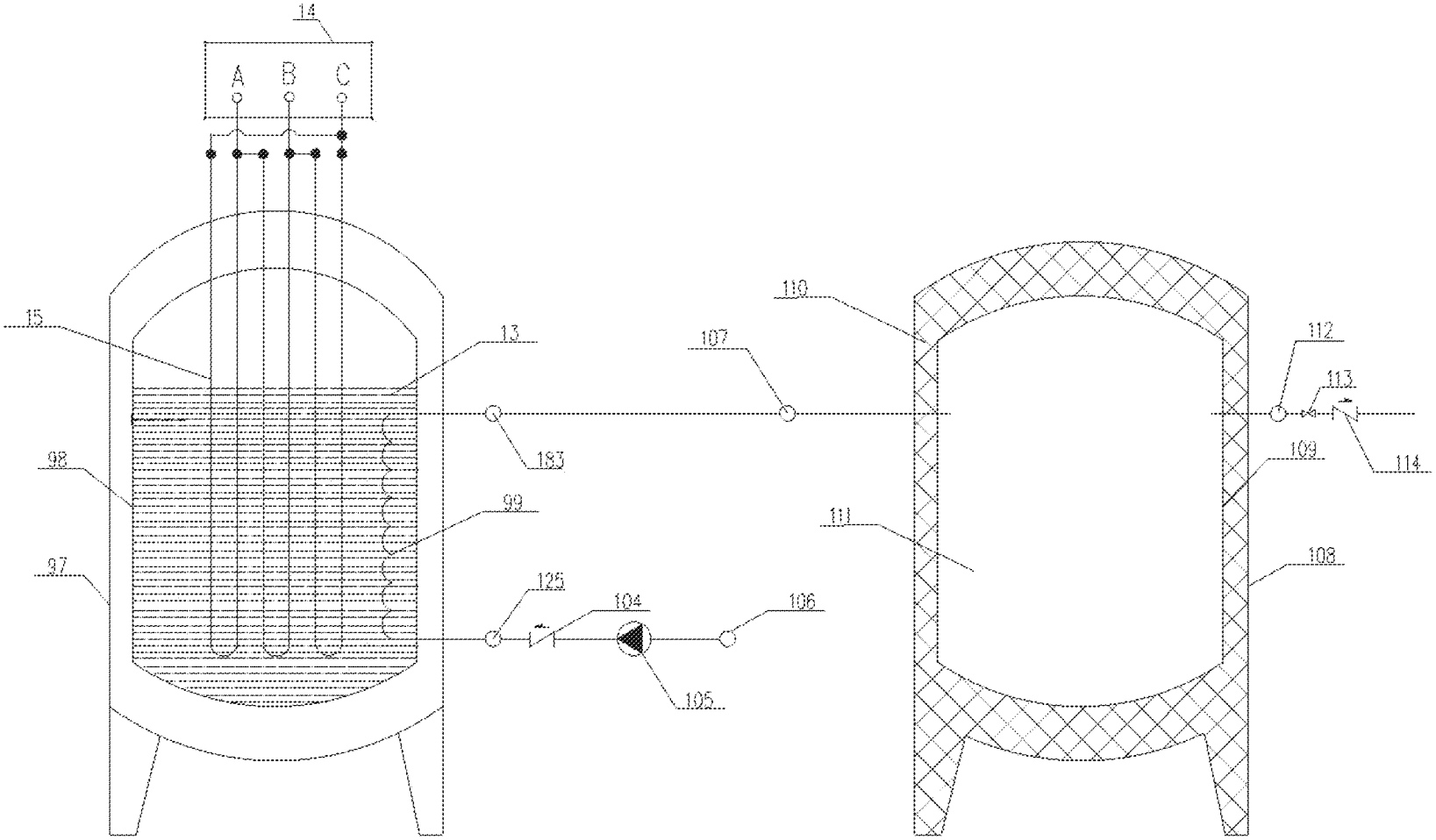
FIG. 10A is a schematic structural diagram of a molten salt thermal storage steam device according to an embodiment of the present disclosure.
Figure 10B:
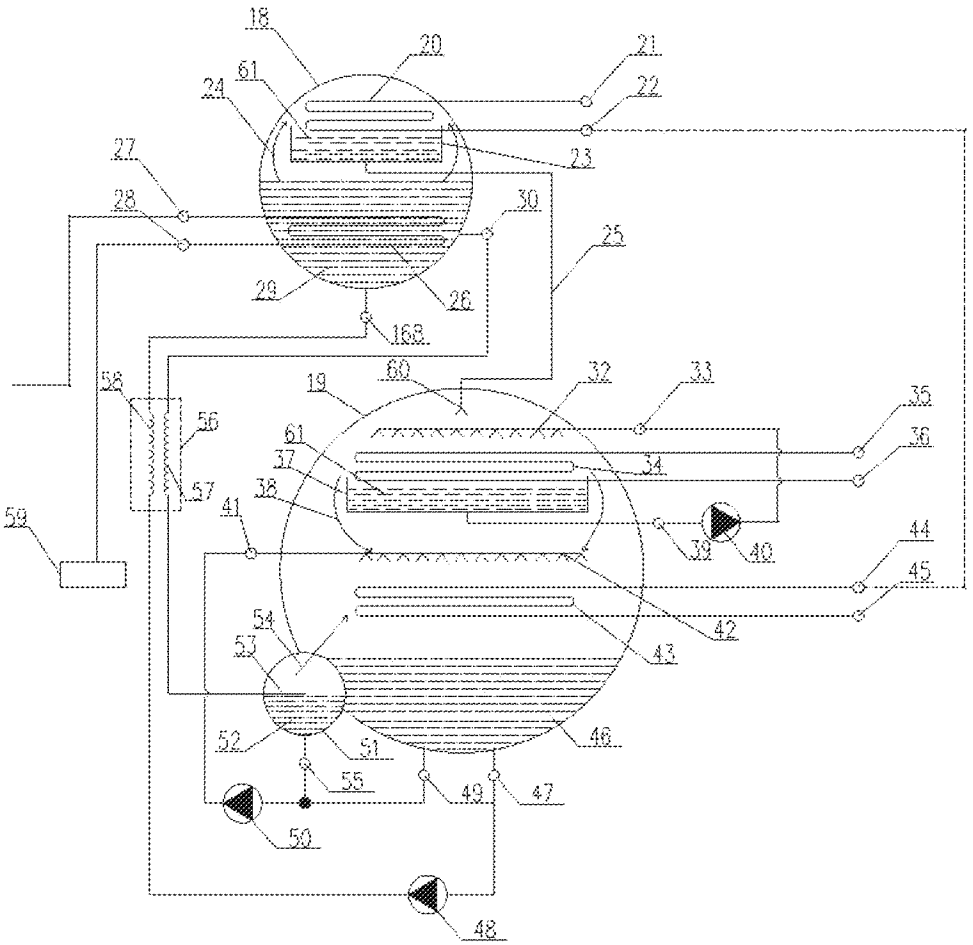
FIG. 10B is a schematic structural diagram of a single-acting steam lithium bromide absorption refrigerating machine according to an embodiment of the present disclosure.

FIG. 10A is a schematic structural diagram of a molten salt thermal storage steam device according to an embodiment of the present disclosure. FIG. 10B is a schematic structural diagram of a single-acting steam lithium bromide absorption refrigerating machine according to an embodiment of the present disclosure. As shown in FIG. 10, the thermal storage and absorption refrigerating unit further including a molten salt thermal storage steam device and a single-acting steam lithium bromide absorption refrigerating machine with two cylinders. It is developed to adapt to the dual carbon plan, where the existing steam type lithium bromide refrigeration unit is converted into a thermal storage steam type lithium bromide refrigeration unit.

China is a major manufacturer of steam lithium bromide refrigerating machines, with numerous production manufacturers. China has a large inventory of steam lithium bromide refrigerating machines in use. Converting these existing steam lithium bromide refrigerating machines into thermal storage lithium bromide refrigerating machines would have significant energy-saving and societal benefits.

The molten salt thermal storage steam device includes a molten salt thermal storage outer shell 97, a molten salt thermal storage inner shell 98, the molten salt 13, the power supply 14, the electric heating device 15, a steam generator 99, a water pump 105, a steam tank outer shell 108, a steam tank inner shell 109, steam 111, and a valve 113.

During operation, the water source for producing steam is supplied through the water source interface 106, via water pump 105, and a check valve 104. The steam enters the steam generator 99 through the steam water source inlet 125, where it is heated by molten salt 13 to generate the steam 111. This steam 111 exits through the molten salt steam output interface 183 and enters the system via the steam input interface 107, where it is stored in the steam tank inner shell 109.

The steam tank outer shell 108 of the steam storage tank is filled with heat insulating material 110 between it and the steam tank inner shell 109, which not only provides thermal insulation but also ensures that the steam tank inner shell 109 can withstand the high temperature insulation and the pressure exerted by the steam 111.

The steam 111 stored in the steam tank inner shell 109 of the steam storage tank exits through the steam output interface 112, passing through the valve 113 and the check valve 114, and enters the generator interface 27. After heating the concentrated high temperature lithium bromide solution 29, it is output through the second generator interface 28 to the condensate water 59, completing the heating and concentration process of the lithium bromide solution.

As shown in FIGS. 10A and 10B, the steam-type lithium bromide refrigerating machine suffers from thermal loss due to steam condensation at approximately 95° C., resulting in lower efficiency compared to the heating method depicted in FIGS. 5, 6, 7A, 7B, 8A, 8B, 9A and 9B of this application, which uses molten salt 13 or thermal conductive oil 82 to circulate through the generator 26 to heat the lithium bromide solution. This is because the direct circulation of molten salt or thermal conductive oil avoids the 95° C. steam condensation heat loss.

To overcome the thermal loss from the 95° C. steam condensation, the existing steam-type lithium bromide refrigerating machine can be converted to the heating operation mode shown in FIGS. 5, 6, 7A, 7B, 8A, 8B, 9A and 9B of this disclosure, which uses molten salt 13 or thermal conductive oil 82 circulating through the generator 26 to heat the lithium bromide solution.

Figure 11A:
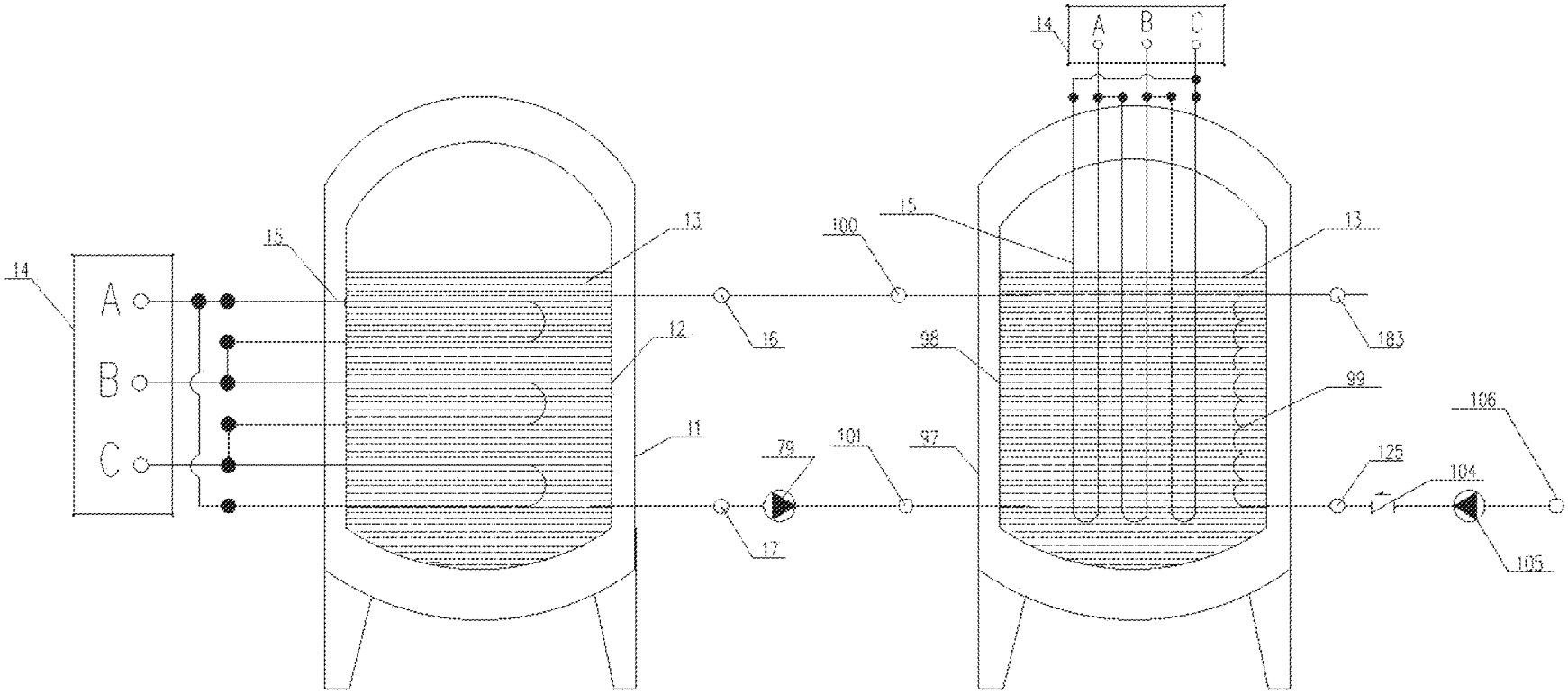
FIG. 11A is a schematic structural diagram of a two-stage thermal storage steam device according to an embodiment of the present disclosure.
Figure 11B:
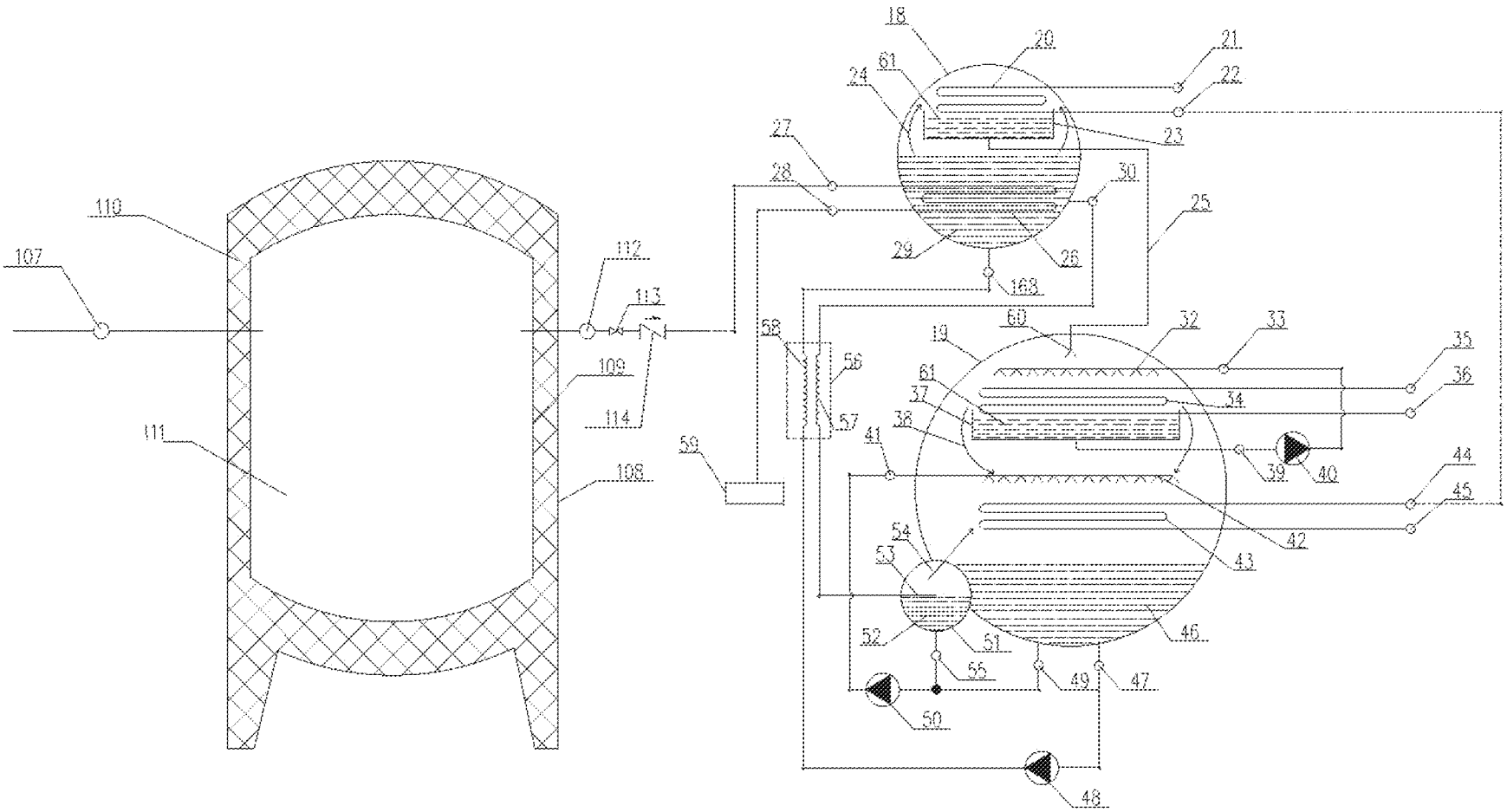
FIG. 11B is a schematic structural diagram of a single-acting steam lithium bromide refrigerating machine with two cylinders according to an embodiment of the present disclosure.

FIG. 11A is a schematic structural diagram of a two-stage thermal storage steam device according to an embodiment of the present disclosure. FIG. 11B is a schematic structural diagram of a single-acting steam lithium bromide refrigerating machine with two cylinders according to an embodiment of the present disclosure. As shown in FIGS. 11A and 11B, the first-stage molten salt thermal storage steam device includes molten salt thermal storage outer shell 11, the molten salt thermal storage inner shell 12, the molten salt 13, the power supply 14, the electric heating device 15, and molten salt circulating pump 79. The second-stage molten salt thermal storage steam device includes the molten salt thermal storage outer shell 97, the molten salt thermal storage inner shell 98, the molten salt 13, the power supply 14, the electric heating device 15, the steam generator 99, the water pump 105, the steam storage tank outer shell 108, the steam tank inner shell 109, the steam 111, and the valve 113.

During operation, the first-stage thermal storage system stores molten salt at 900° C. The molten salt circulating pump 79 circulates the molten salt to the second-stage molten salt storage inner shell 98, heating the molten salt 13 to a temperature range of 600° C. to 300° C. The water source for producing steam is supplied through the steam water source interface 106, via the steam supply pump 105, and a check valve 104. The steam enters the steam generation device 99 through the steam source inlet 125, where it is heated by molten salt 13 to generate steam 111. The steam then exits through the molten salt steam output interface 183, enters through the steam input interface 107, and is stored in the inner shell 109 of the steam storage tank.

The molten salt 13 in the second-stage thermal storage inner shell 98 is heated to approximately 600° C. to 300° C. to accommodate the production of steam at various temperatures. Other components remain the same as in FIGS. 9A and 9B.

Figure 12A:
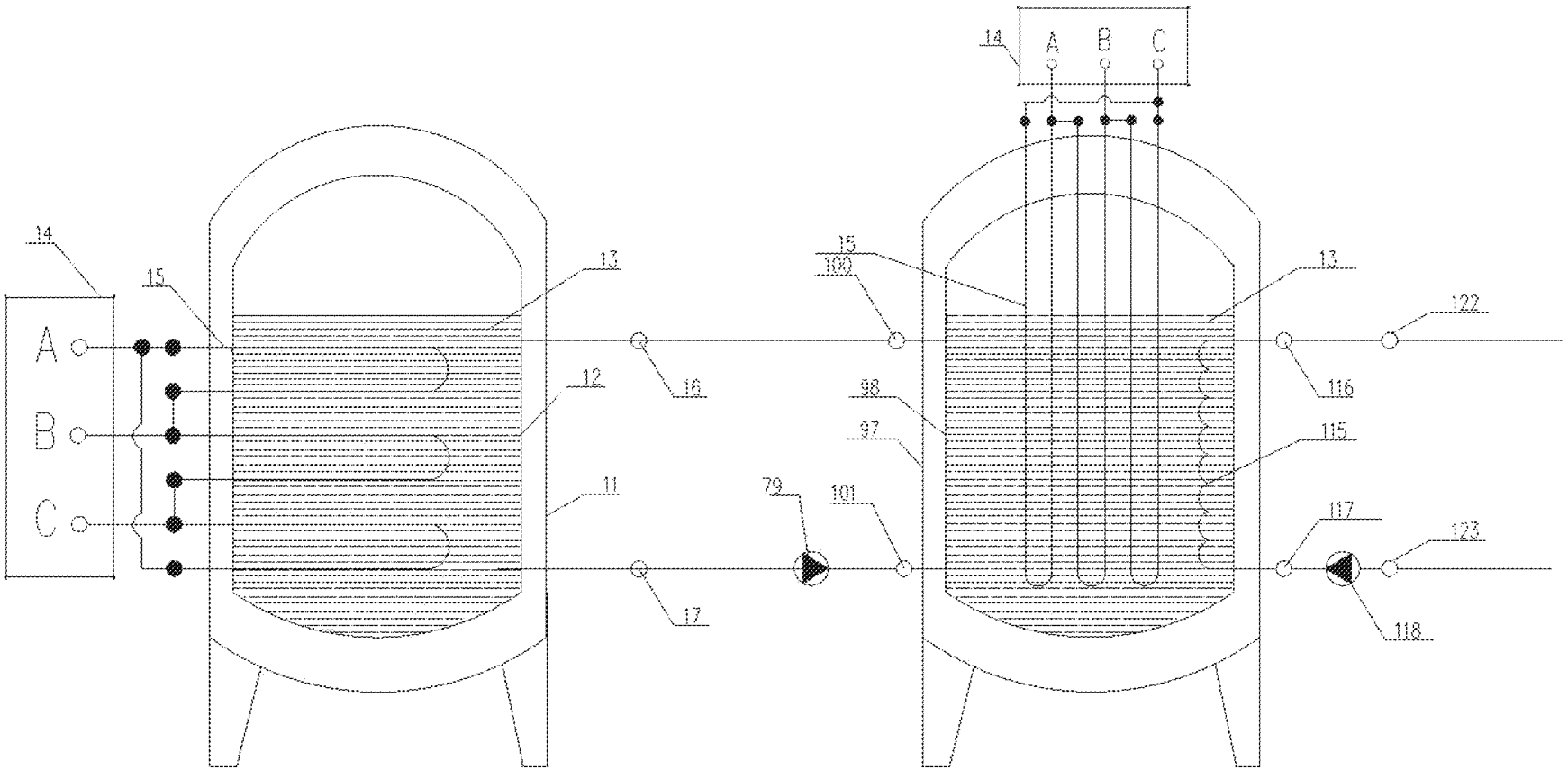
FIG. 12A is a schematic structural diagram of a two-stage molten salt heat storing device according to an embodiment of the present disclosure.
Figure 12B:
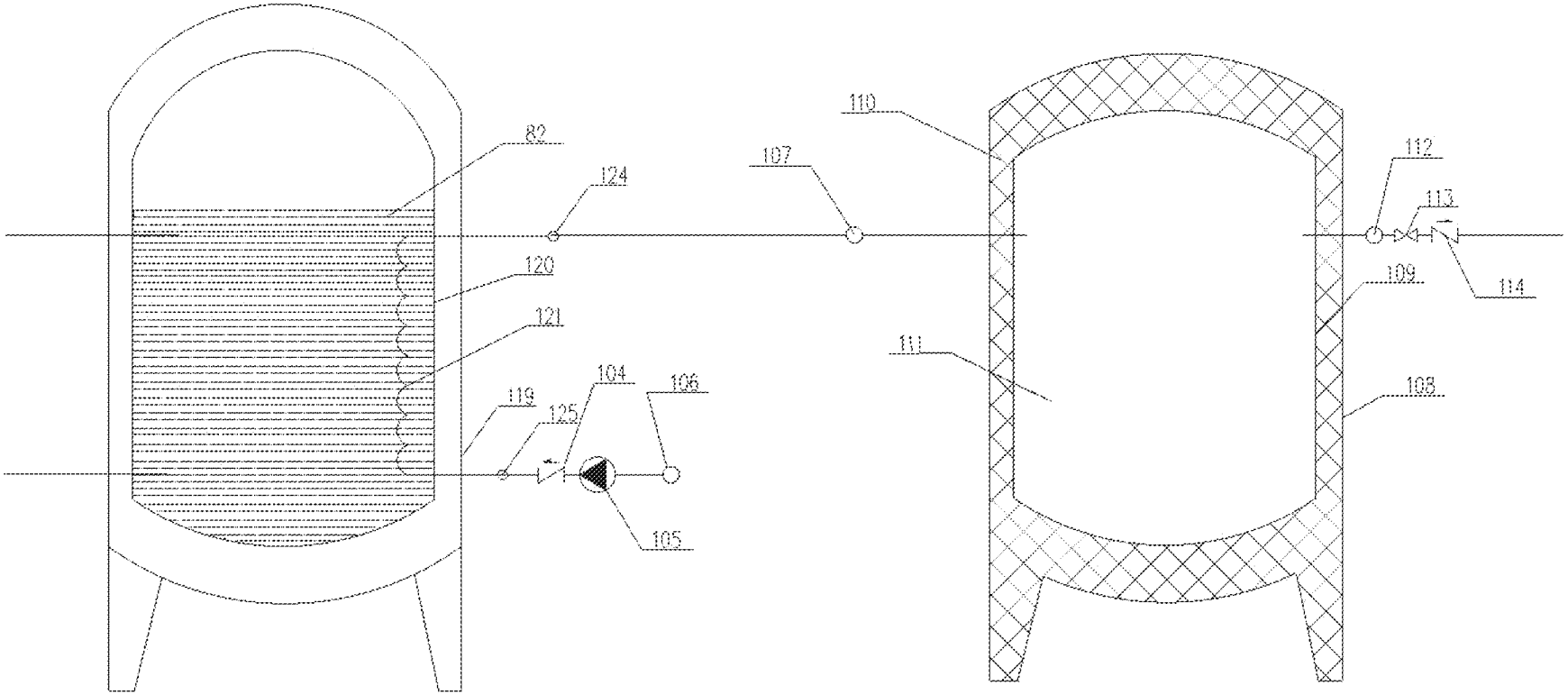
FIG. 12B is a schematic structural diagram of a thermal conductive oil storage and heat transfer steam device according to an embodiment of the present disclosure.
Figure 12C:
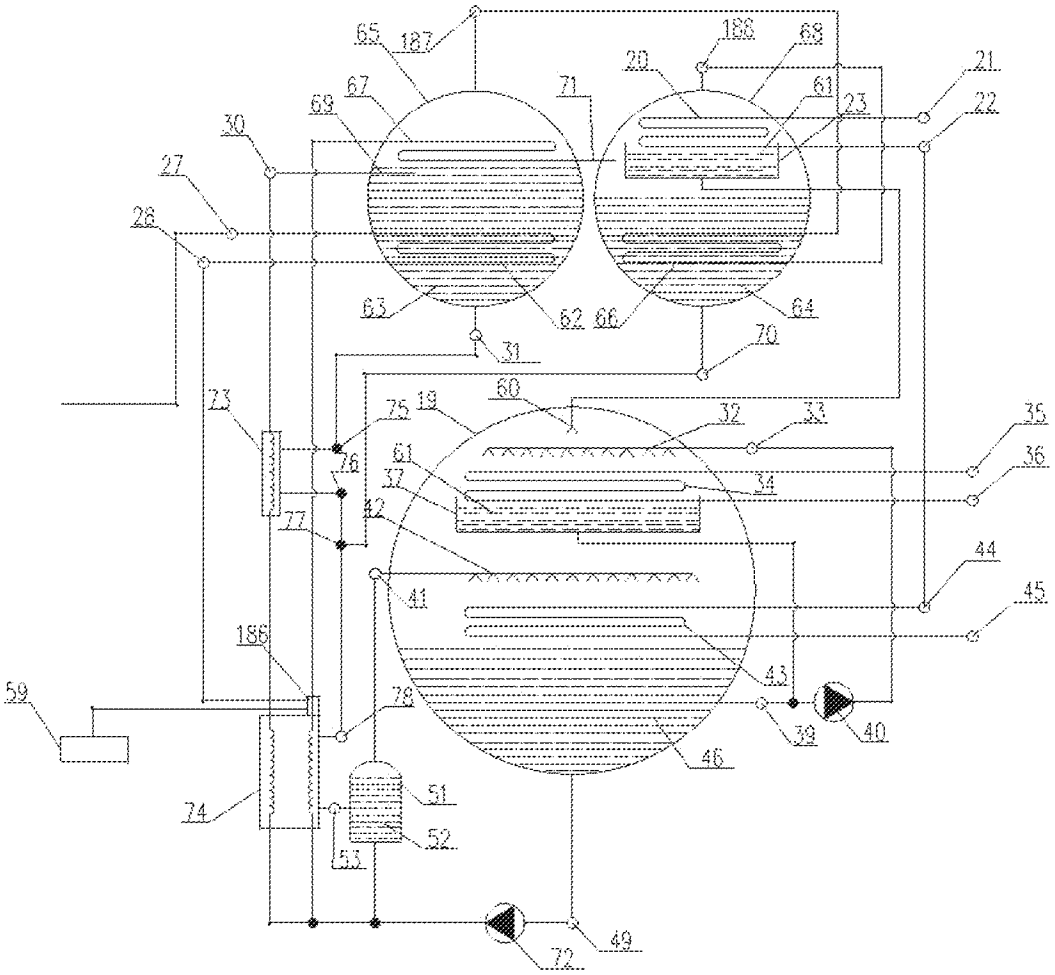
FIG. 12C is a schematic structural diagram of a steam dual-effect lithium bromide absorption refrigerating machine according to an embodiment of the present disclosure.

FIG. 12A is a schematic structural diagram of a two-stage molten salt heat storing device according to an embodiment of the present disclosure. FIG. 12B is a schematic structural diagram of a thermal conductive oil storage and heat transfer steam device according to an embodiment of the present disclosure. FIG. 12C is a schematic structural diagram of a steam dual-effect lithium bromide absorption refrigerating machine according to an embodiment of the present disclosure. FIGS. 12A-12C illustrate the configuration of a thermal conductive oil thermal storage heat exchange steam device, integrated with a double-effect steam lithium bromide absorption refrigerating machine, based on the implementations shown in FIGS. 10A, 10B, 11A and 11B.

As shown in FIGS. 12A and 12B, the heat conduction oil storage and heat transfer steam device includes the thermal conductive oil storage and heat transfer steam shell 119, the thermal conductive oil storage and heat transfer steam shell 120, the thermal conductive oil 82, the thermal conductive oil steam generator 121, the water pump 105, the steam storage tank outer shell 108, the steam tank inner shell 109, the steam 111, the valve 113 and a check valve 114.

During operation, the first-stage molten salt is heated to a high temperature of 900° C. The molten salt is then circulated via molten salt circulating pump 79 to the second-stage molten salt thermal storage inner shell 98, where molten salt 13 is heated to approximately 600° C. Next, the molten salt thermal conductive oil heat exchanging pump 118 circulates thermal conductive oil 82, heating it to around 300° C., which in turn generates steam 111. The steam 111 passes through the valve 113 and the check valve 114, entering the high temperature generator 62 via the generator interface 27. In the generator, the high temperature lithium bromide solution 63 is heated and concentrated, and the steam then exits through the generator interface 28. After exchanging heat with the steam condensate heat exchanger 186, the condensate water 59 is discharged. Other components remain the same as in FIGS. 9A to 11B, and will not be repeated.

Figure 13A:
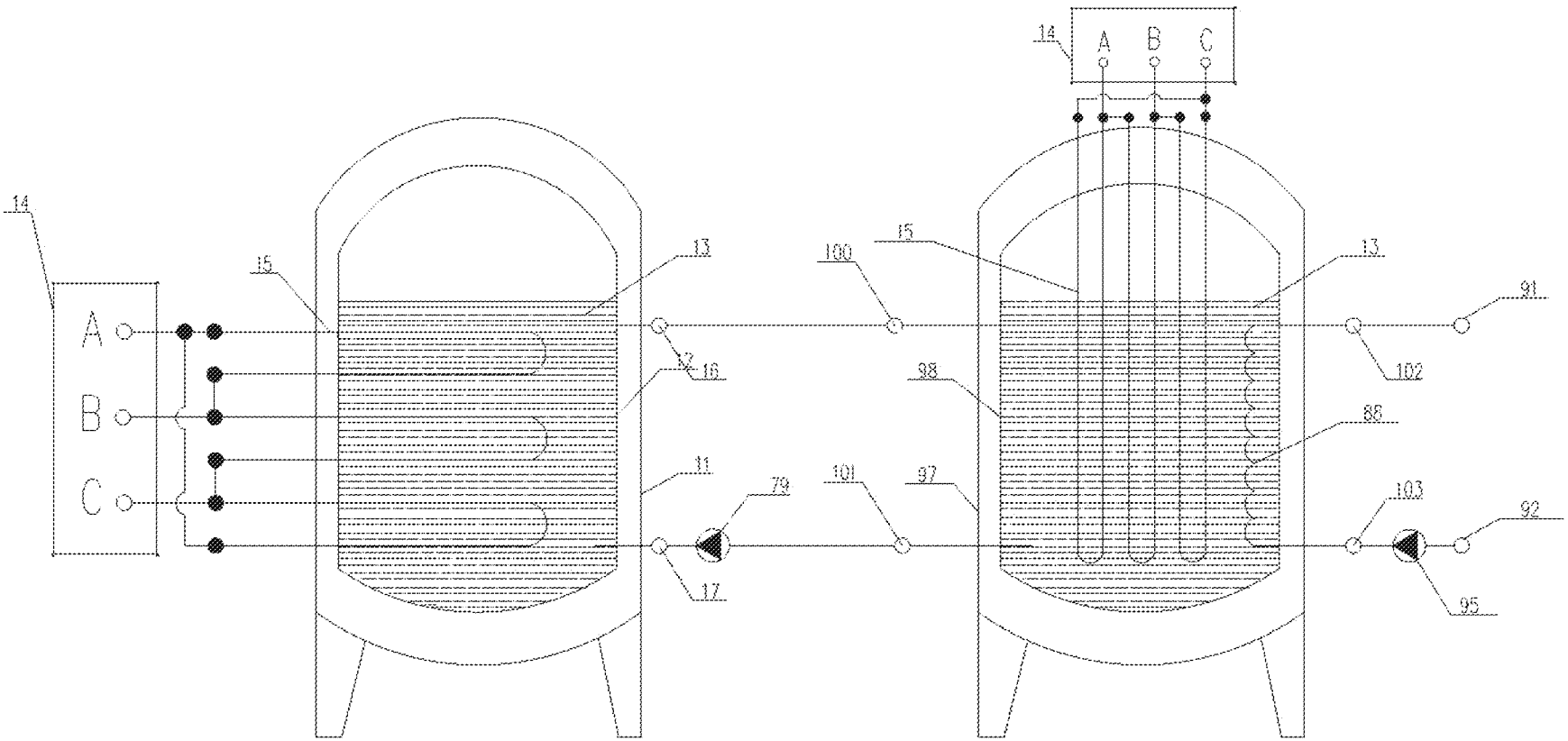
FIG. 13A is a schematic structural diagram of a two-stage molten salt thermal storage device of the thermal storage absorption refrigerating unit with a direct fired lithium bromide absorption refrigerating machine according to an embodiment of the present disclosure.
Figure 13B:
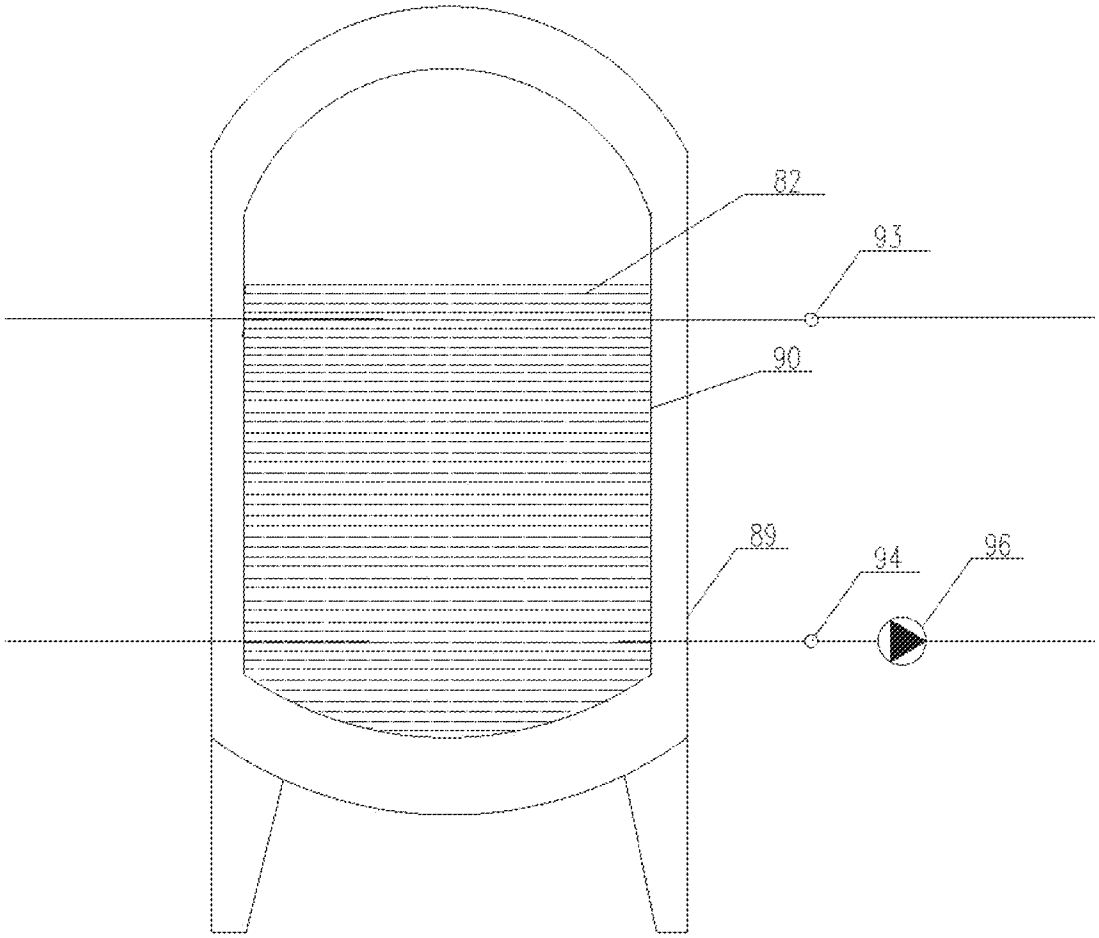
FIG. 13B is a schematic structural diagram of a thermal conductive oil storage and heat transfer steam device of the thermal storage absorption refrigerating unit with the direct fired lithium bromide absorption refrigerating machine according to an embodiment of the present disclosure.
Figure 13C:
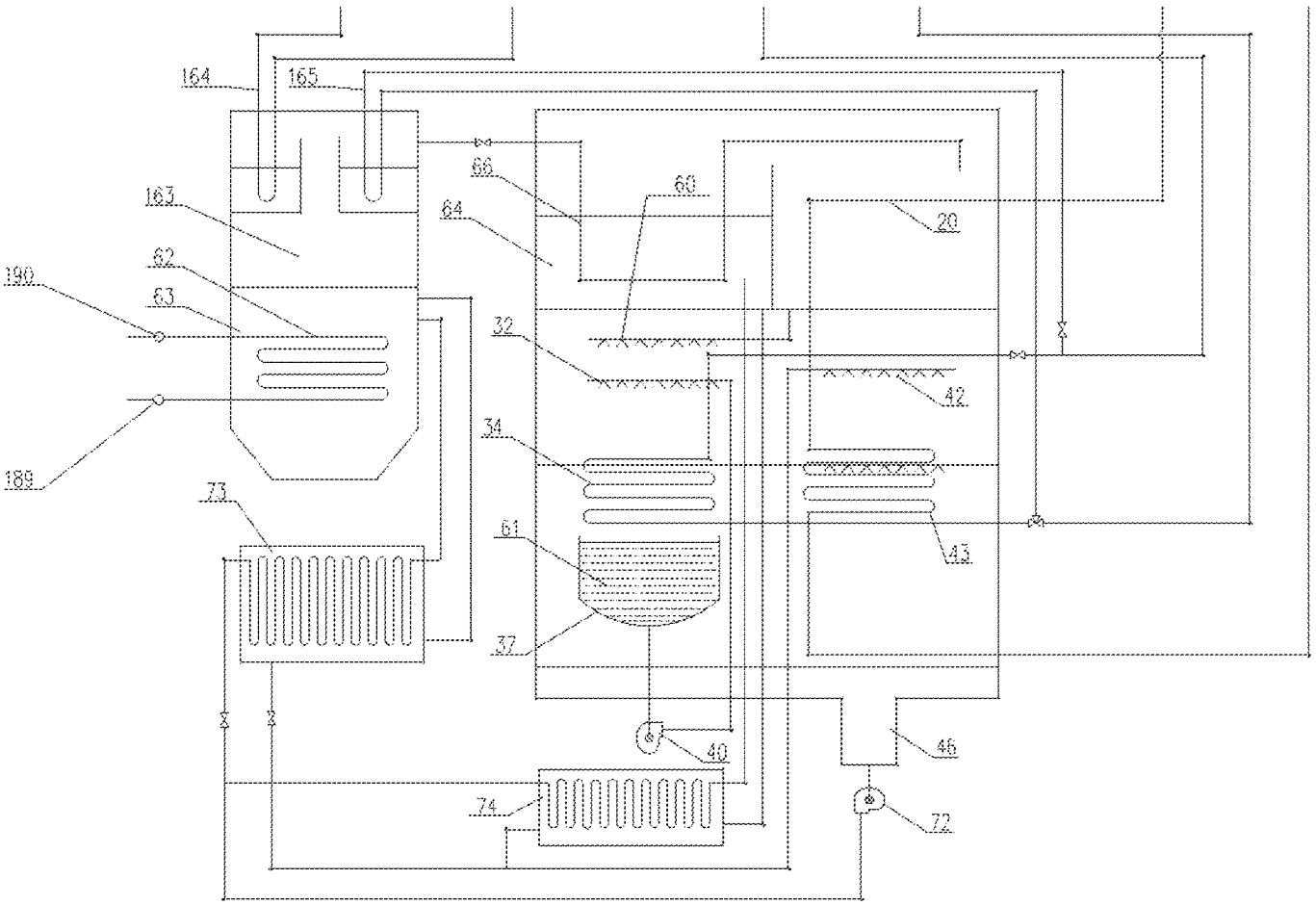
FIG. 13C is a schematic structural diagram of the direct fired lithium bromide absorption refrigerating machine according to an embodiment of the present disclosure.

FIG. 13A is a schematic structural diagram of a two-stage molten salt thermal storage device of the thermal storage absorption refrigerating unit with a direct fired lithium bromide absorption refrigerating machine according to an embodiment of the present disclosure. FIG. 13B is a schematic structural diagram of a thermal conductive oil storage and heat transfer steam device of the thermal storage absorption refrigerating unit with the direct fired lithium bromide absorption refrigerating machine according to an embodiment of the present disclosure. FIG. 13C is a schematic structural diagram of the direct fired lithium bromide absorption refrigerating machine according to an embodiment of the present disclosure. The thermal storage and absorption refrigerating unit of FIGS. 13A to 13B is designed based on that of FIGS. 8A to 8B and the direct fired lithium bromide absorption refrigeration machine in existing technology. And innovate to become an implementation embodiment of the thermal storage lithium bromide absorption refrigeration machine according to the goals of the dual carbon plan.

The direct fired lithium bromide absorption refrigerating machine and steam lithium bromide absorption refrigerating machine are the most commonly used types of absorption refrigerating machines in China. Apart from the difference in heating methods, they are essentially the same. One uses natural gas combustion to heat the concentrated lithium bromide solution, while the other uses steam to heat the concentrated lithium bromide solution. Due to carbon emission restrictions under the dual-carbon plan, the application of both the direct fired lithium bromide absorption refrigerating machine and steam lithium bromide absorption refrigerating machine has been affected. Therefore, the thermal storage lithium bromide absorption refrigerating machine proposed in this application, which utilizes wind, photovoltaic power generation, and off-peak electricity from the grid for thermal storage, represents an innovation and integration of traditional lithium bromide absorption refrigerating machines. This approach holds significant importance in the context of current energy storage trends.

As shown in FIGS. 13A, 13B and 13C, the original lithium bromide direct fired furnace body 163, equipped with a natural gas, oil, or liquefied petroleum burner, is removed and replaced by a high temperature generator 62. The high temperature generator heats the high temperature lithium bromide solution 63, replacing the role of the natural gas, oil, or liquefied petroleum burner.

During operation, the high temperature thermal conductive oil 82, circulated by the thermal conductive oil circulating pump 96, enters the high temperature generator 62 through the high temperature generator inlet 189, replacing the burner for heating the high temperature lithium bromide solution 63. After heat release and cooling, the thermal conductive oil 82 exits the high temperature generator via the generator outlet 190, flows through the thermal conductive oil output interface 93, and returns to the thermal conductive oil heat storing and exchanging internal shell 90, where it is further heated by molten salt 13, circulated by the molten salt heat circulating pump 95. The heated thermal conductive oil 82 continues to circulate through the thermal conductive oil heat exchanger, repeating the process of using molten salt and thermal conductive oil to replace the natural gas, oil, or liquefied petroleum burner for heating.

The direct fired lithium bromide absorption refrigerating machine is often equipped with a domestic hot water heat exchanger 164 and a heat collecting and supplying heat exchanger 165. Domestic hot water is circulated and heated via a domestic hot water interface 166 and a domestic hot water interface 167. The heating water is circulated via a first evaporator interface 35 and a second evaporator interface 36. Cooling water is circulated through the condenser interface 21 and absorber interface 45 for cooling. Other components are the same as those in the double-effect lithium bromide absorption refrigerating machine, and will not be repeated.

Figure 14A:
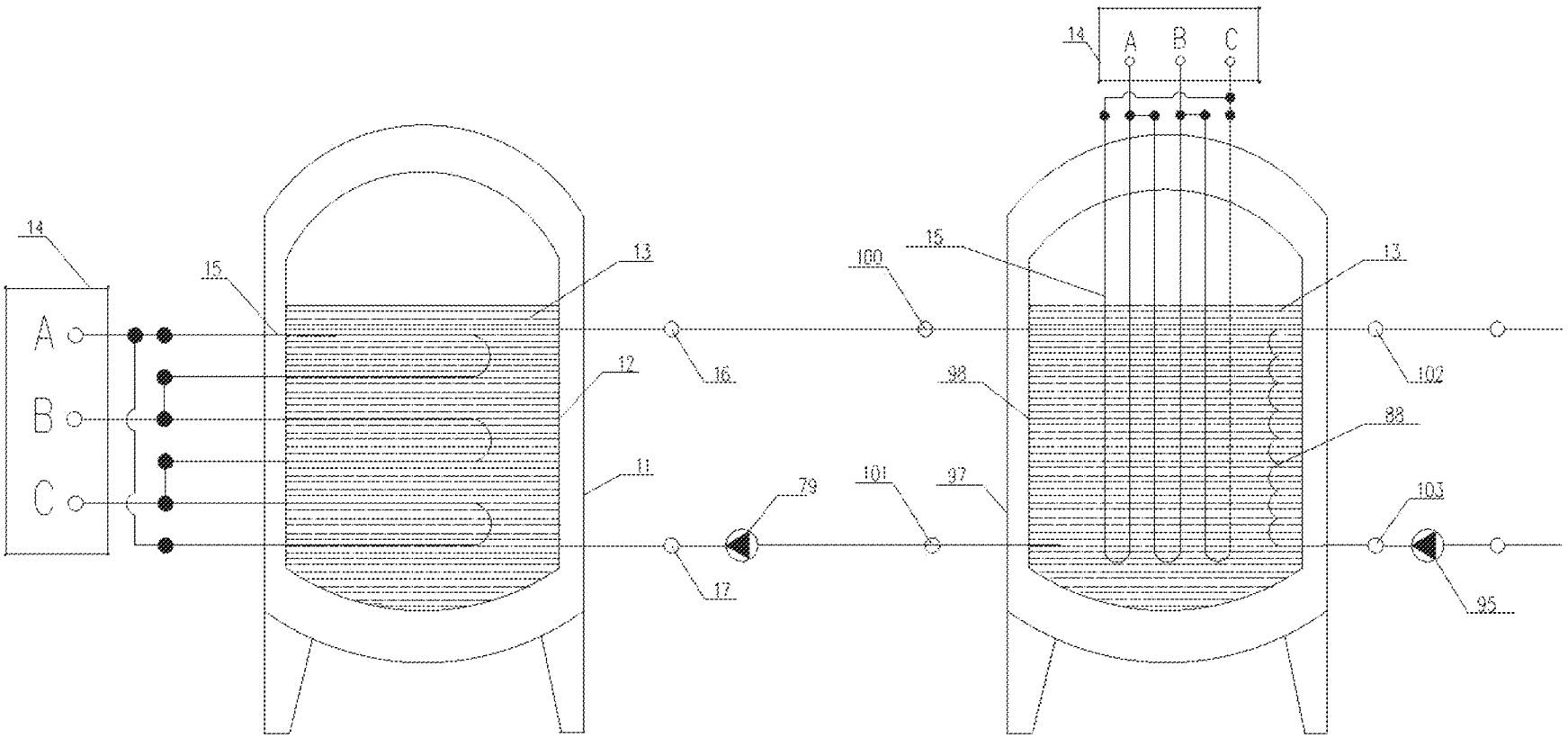
FIG. 14A is a schematic structural diagram of a two-stage molten salt thermal storage device of the thermal storage and absorption refrigerating unit with heat collecting and supplying system according to an embodiment of the present disclosure.
Figure 14B:
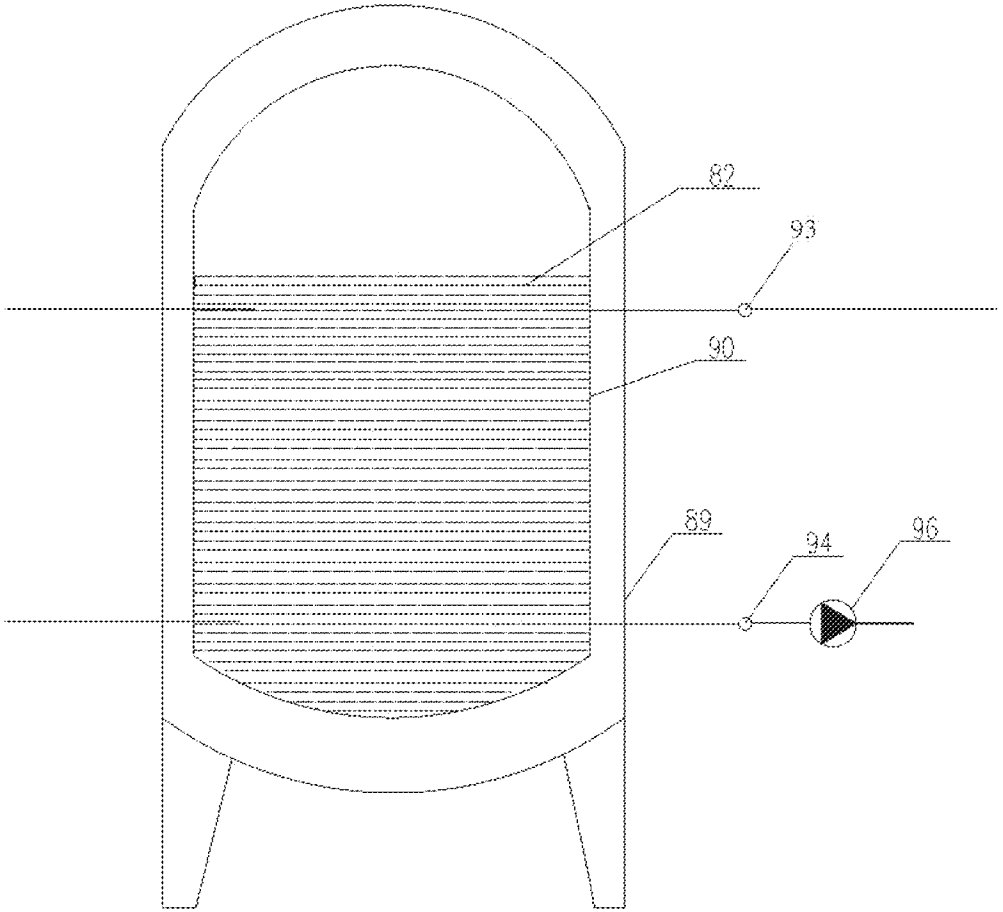
FIG. 14B is a schematic structural diagram of a heat collecting system of the thermal storage and absorption refrigerating unit with heat collecting and supplying system according to an embodiment of the present disclosure.
Figure 14C:
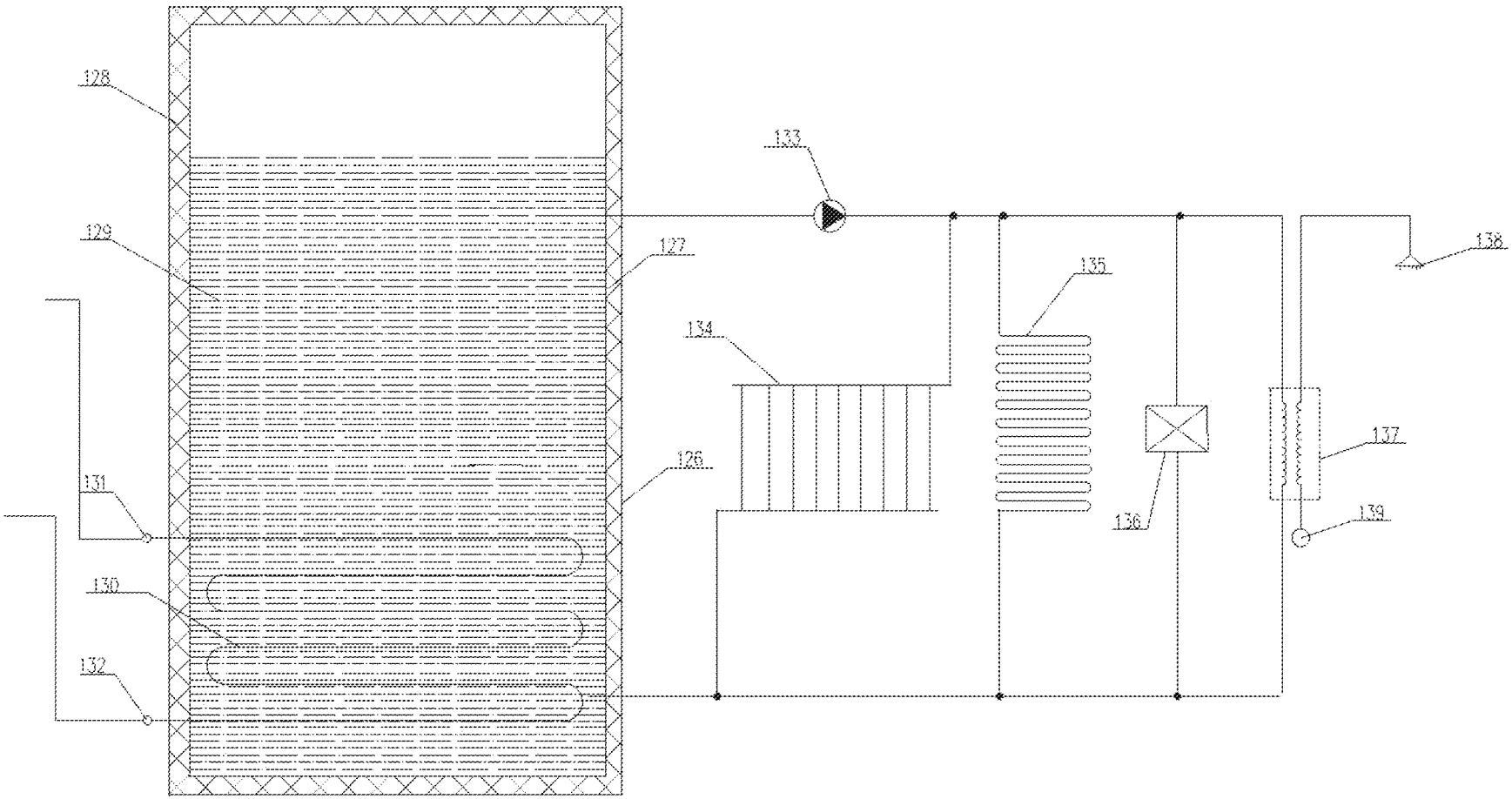
FIG. 14C is a schematic structural diagram of a heat supplying system of the thermal storage and absorption refrigerating unit with heat collecting and supplying system according to an embodiment of the present disclosure.

FIG. 14A is a schematic structural diagram of a two-stage molten salt thermal storage device of the thermal storage and absorption refrigerating unit with heat collecting and supplying system according to an embodiment of the present disclosure. FIG. 14B is a schematic structural diagram of a heat collecting system of the thermal storage and absorption refrigerating unit with heat collecting and supplying system according to an embodiment of the present disclosure. FIG. 14C is a schematic structural diagram of a heat supplying system of the thermal storage and absorption refrigerating unit with heat collecting and supplying system according to an embodiment of the present disclosure. The two-stage molten salt thermal storage device, the thermal conductive oil thermal storage and heat transfer device, and a heat collecting and supplying system are provided As shown in FIGS. 14A-14C, the heat collecting and supplying system includes a hot water exchanging outer tank 126, a hot water exchanging inner tank 127, hot water exchanging inner tank thermal insulation material 128, hot water 129, a hot water exchanger 130, a first hot water heating heat exchanger interface 131, a second hot water heating heat exchanger interface 132, a heat collecting and supplying circulating pump 133, a radiator 134 or a underfloor heating pipe 135 or a fan coil 136, and/or a domestic hot water heat exchanger 137, a shower head 138, and a tap water interface 139.

During heat collecting and supplying operation, the thermal conductive oil circulating pump 96 circulates the high temperature thermal conductive oil 82 through the first hot water heating heat exchanger interface 131 into the hot water heat exchanger 130, where it heats the hot water 129. The cooled thermal conductive oil 82 exits the second hot water heating heat exchanger through interface 132 and is directed through the thermal conductive oil output interface 93 to the thermal conductive oil heat storing and exchanging internal shell 90. It is then further heated by the molten salt 13, which is circulated by the molten salt heat transfer pump 95 and passes through the molten salt heat exchanger 88, where it is heated by the high temperature solution. The heated thermal conductive oil 82 is returned through the thermal conductive oil output interface 94 to the thermal conductive oil circulating pump 96, repeating the cycle to continuously heat the hot water 129.

During heat collecting and supplying operation, the heat collecting and supplying circulating pump 133 circulates the hot water 129 to the radiator 134, underfloor heating pipe 135, fan coil units 136, and/or the domestic hot water heat exchanger 137. The heating is provided through radiator 134, underfloor heating pipe 135, fan coil 136, or the domestic hot water heat exchanger 137. The bathing hot water enters the domestic hot water heat exchanger 137 through the tap water interface 139 and is heated by the hot water 129 circulating through the heating side of the heat exchanger 137. The heated water is then used for bathing via the shower head 138.

FIGS. 14A-14C illustrates the system designed to provide heating and hot water in northern regions that require heating during winter, using the thermal storage lithium bromide absorption refrigerating machine for combined heating and hot water supply.

Figure 15A:
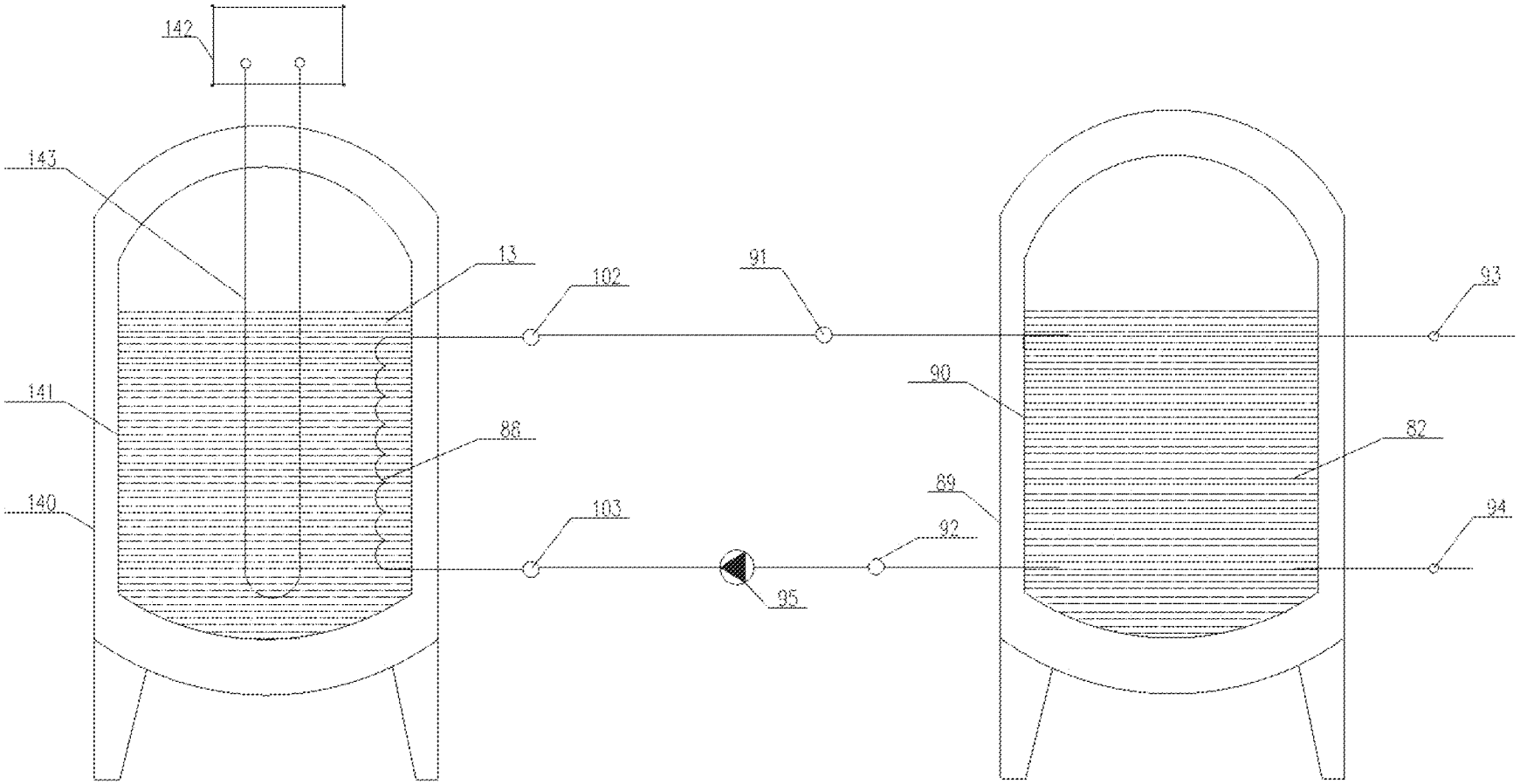
FIG. 15A is a schematic structural diagram of a molten salt thermal storage device and a thermal conductive oil thermal storage and heat transfer device of the thermal storage and absorption refrigerating unit with heat collecting and supplying system according to an embodiment of the present disclosure.
Figure 15B:
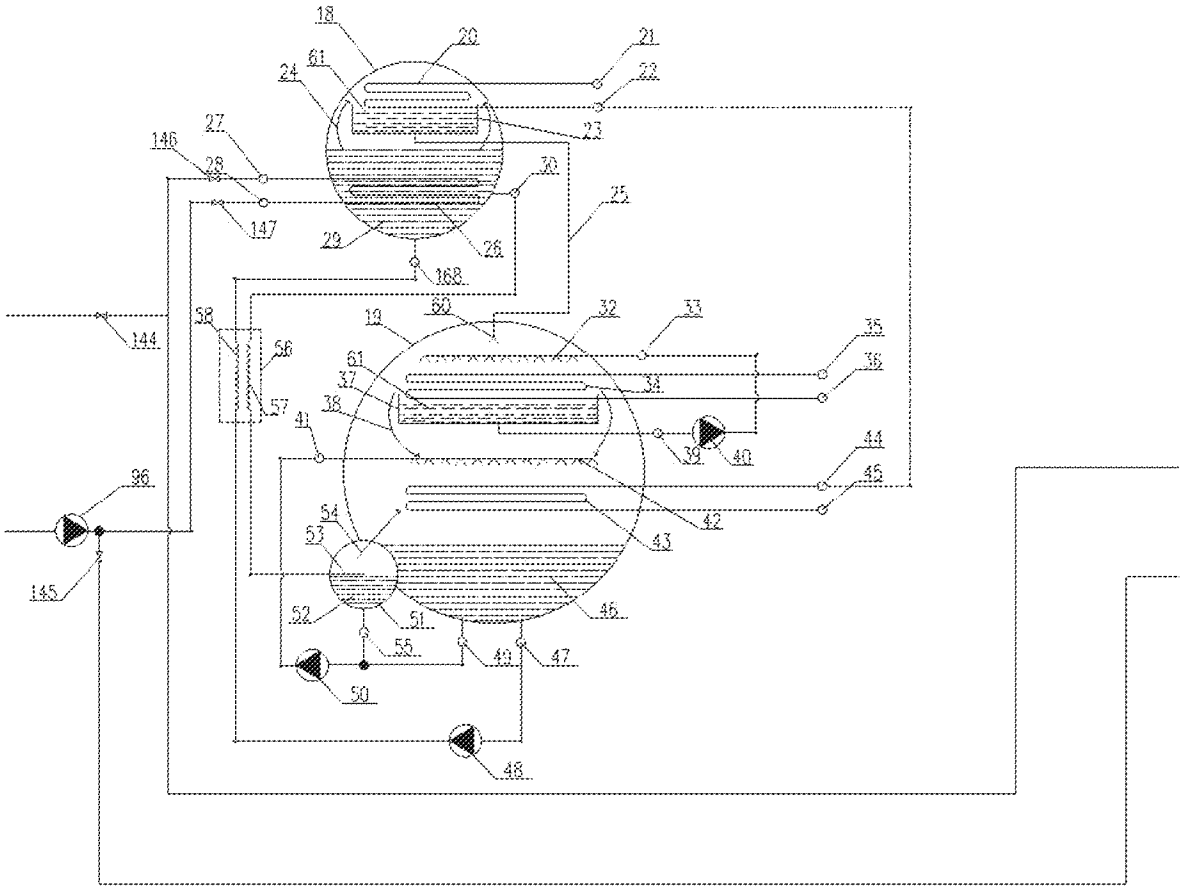
FIG. 15B is a schematic structural diagram of a lithium bromide absorption refrigerating machine of the thermal storage and absorption refrigerating unit with heat collecting and supplying system according to an embodiment of the present disclosure.
Figure 15C:
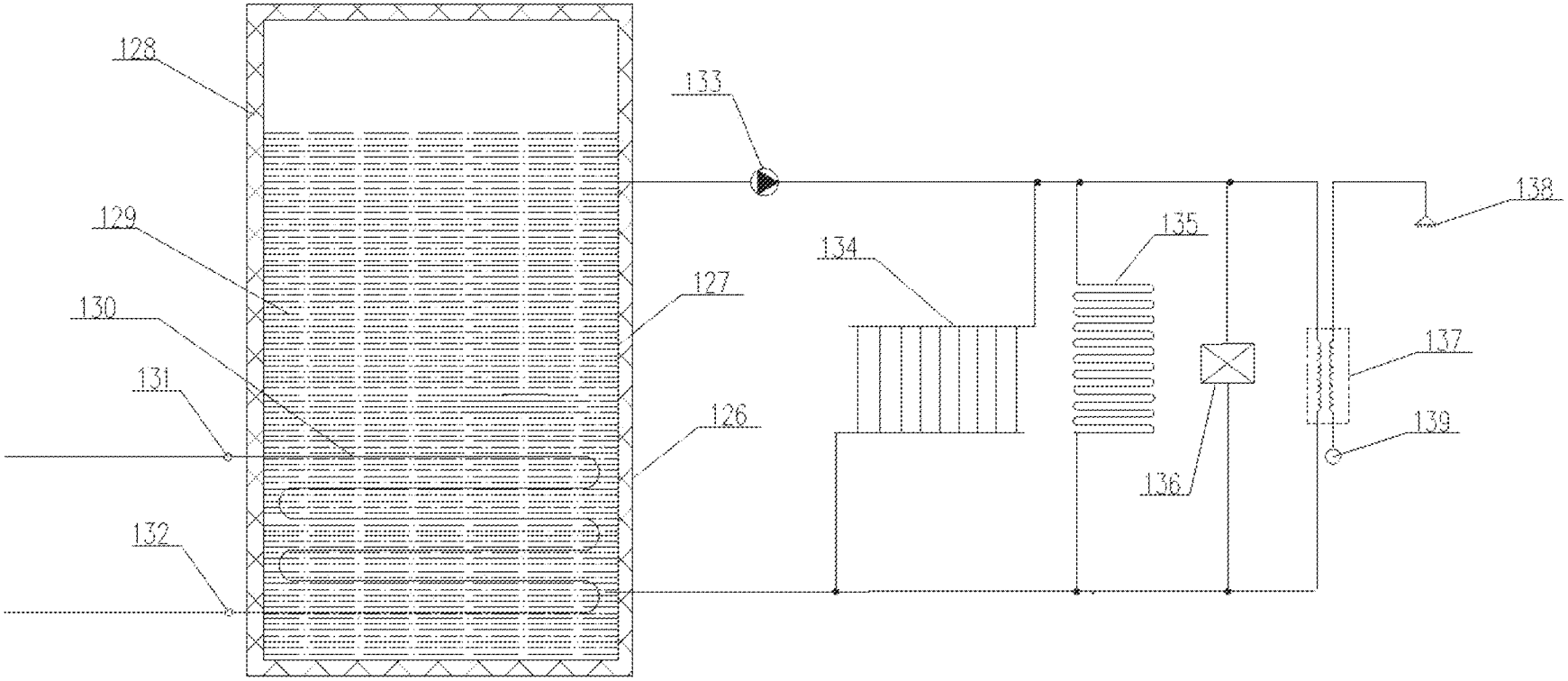
FIG. 15C is a schematic structural diagram of a heat collecting and supplying system of the thermal storage and absorption refrigerating unit with heat collecting and supplying system according to an embodiment of the present disclosure.

FIG. 15A is a schematic structural diagram of a molten salt thermal storage device and a thermal conductive oil thermal storage and heat transfer device of the thermal storage and absorption refrigerating unit with heat collecting and supplying system according to an embodiment of the present disclosure. FIG. 15B is a schematic structural diagram of a lithium bromide absorption refrigerating machine of the thermal storage and absorption refrigerating unit with heat collecting and supplying system according to an embodiment of the present disclosure. FIG. 15C is a schematic structural diagram of a heat collecting and supplying system of the thermal storage and absorption refrigerating unit with heat collecting and supplying system according to an embodiment of the present disclosure.

FIGS. 15A-15C show an implementation embodiment that combines FIGS. 7A-7B and 14A-14C, which is more suitable for applications in heat collecting and supplying areas. In existing lithium bromide absorption refrigeration technology, the lithium bromide generator is used to heat the lithium bromide solution, which then exchanges heat with the heating supply heat exchanger to provide heating. However, each heat exchange process results in some heat loss, which not only reduces the efficiency of the lithium bromide absorption refrigerating machine for heating but also consumes a certain amount of lithium bromide solution, leading to a low overall cost-effectiveness for heating. This application directly utilizes thermal storage for heating, eliminating the heat exchange losses and the consumption of lithium bromide solution, thereby further improving the overall cost-effectiveness of the lithium bromide absorption refrigerating machine for both cooling and heating.

During operation, the conversion between cooling air conditioning and heating is achieved through the mutual switching of the winter/summer valves: a first winter/summer conversion valve 144, a second winter/summer conversion valve 145, a third winter/summer conversion valve 146 and a fourth winter/summer conversion valve 147. In summer, when cooling is required, the first winter/summer conversion valve 144, the second winter/summer conversion valve 145, the third winter/summer conversion valve 146 and the fourth winter/summer conversion valve 147 are opened, while the second winter/summer conversion valve 145 is closed. The thermal conductive oil 82 is circulated by the thermal conductive oil circulating pump 96, which heats the high-temperature concentrated lithium bromide solution 29 in the generator 26, thus enabling cooling operation in the summer. In winter, when heating is required, the first winter/summer conversion valve 144 and the second winter/summer conversion valve 145 are opened, while the third winter/summer conversion valve 146 and the fourth winter/summer conversion valve 147 are closed, enabling heating operation in the winter. Other components are the same as those in FIGS. 7A-7B and 14A-14C and are not repeated.

Figure 16A:
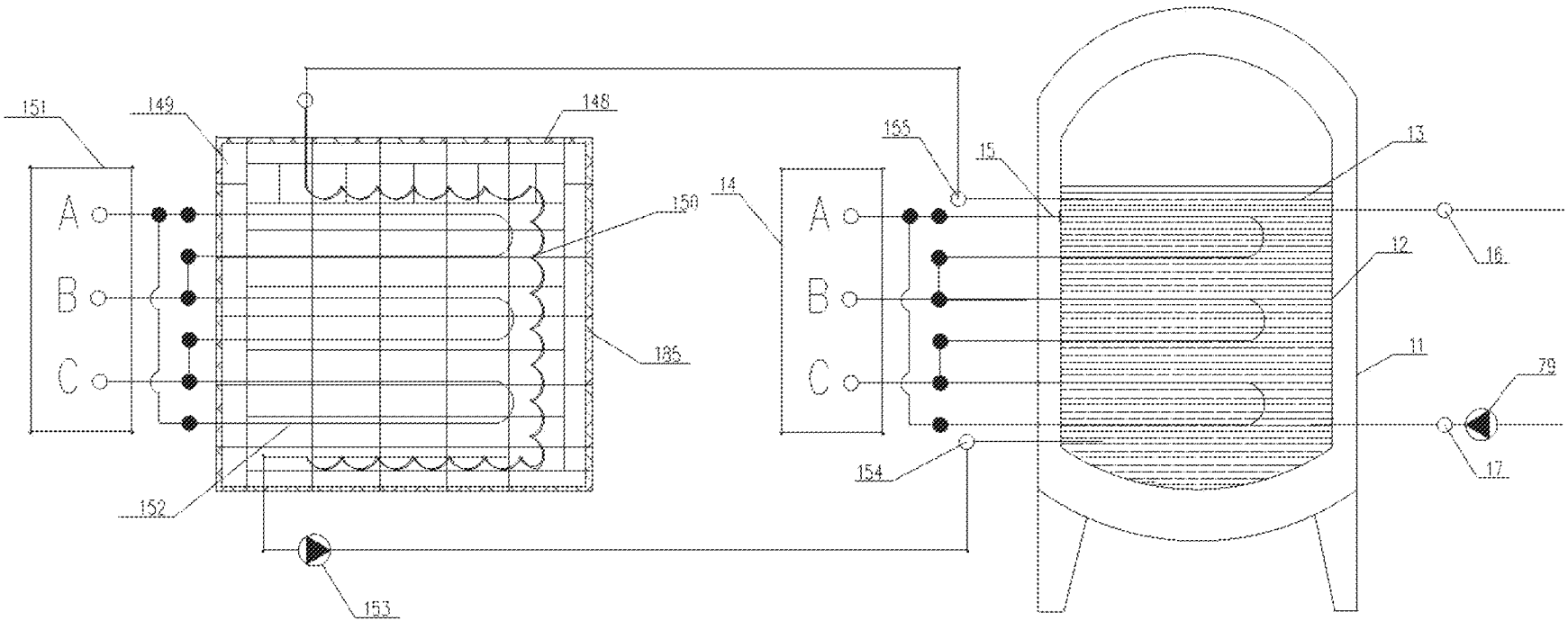
FIG. 16A is a schematic structural diagram of a refractory brick thermal storage device and a part of a molten salt heat transfer device according to an embodiment of the present disclosure.
Figure 16B:
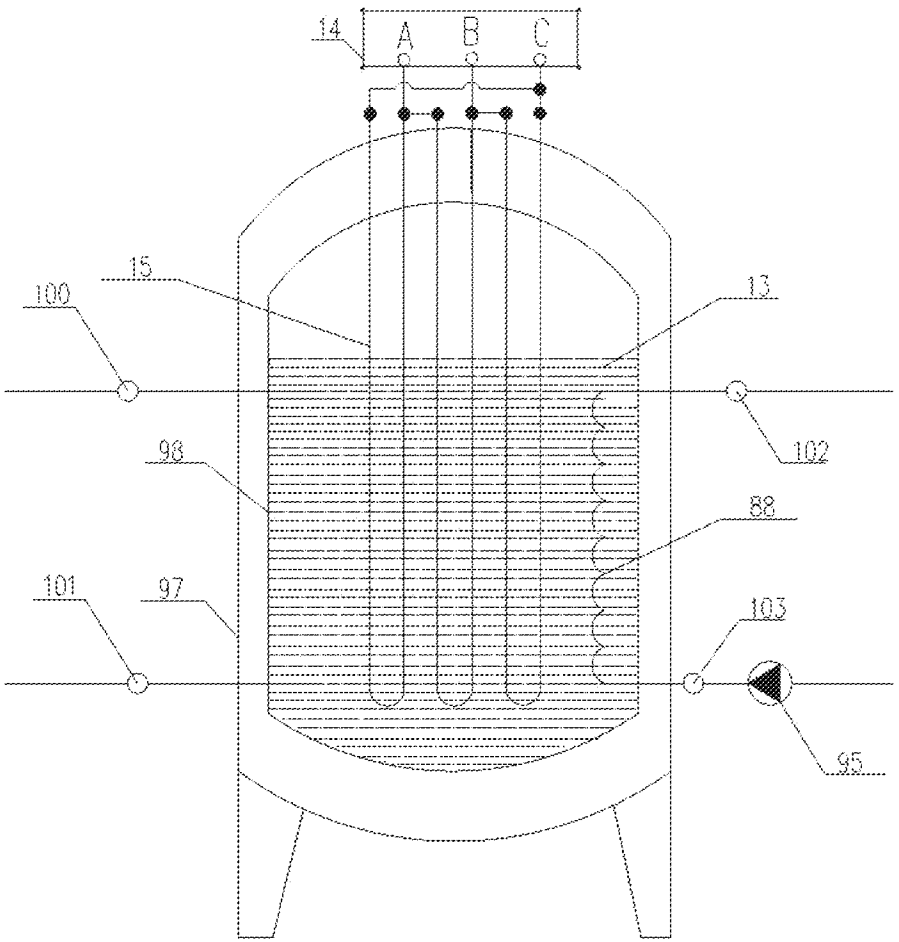
FIG. 16B is a schematic structural diagram of another part of the molten salt heat transfer device of that of FIG. 16A according to an embodiment of the present disclosure.
Figure 16C:
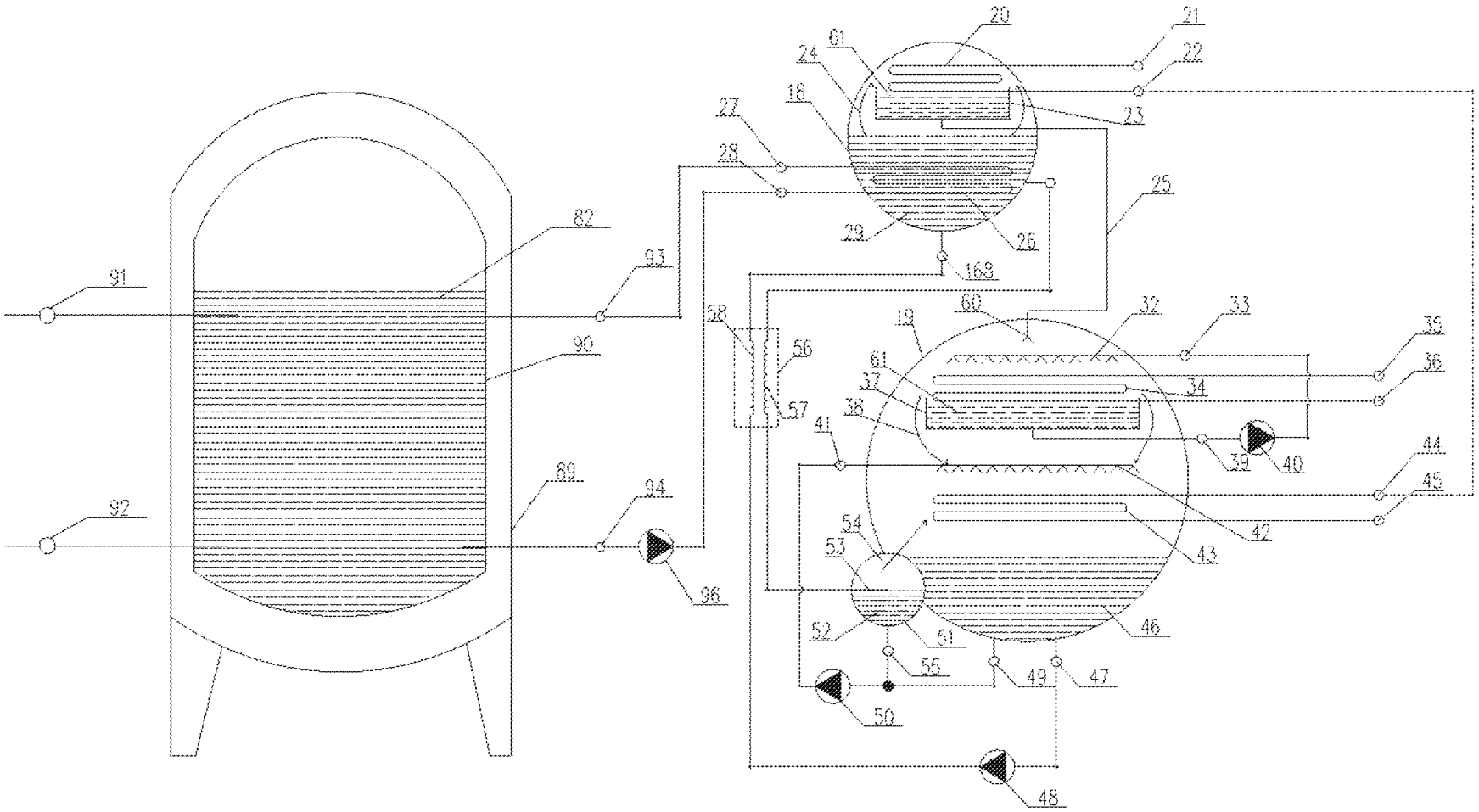
FIG. 16C is a schematic structural diagram of a thermal conductive oil storage and heat transfer device and a lithium bromide refrigerating machine according to an embodiment of the present disclosure.

FIG. 16A is a schematic structural diagram of a refractory brick thermal storage device and a part of a molten salt heat transfer device according to an embodiment of the present disclosure. FIG. 16B is a schematic structural diagram of another part of the molten salt heat transfer device of that of FIG. 16A according to an embodiment of the present disclosure. FIG. 16C is a schematic structural diagram of a thermal conductive oil storage and heat transfer device and a lithium bromide refrigerating machine according to an embodiment of the present disclosure. On the bases of FIGS. 8A and 8B, an ultra high temperature thermal storage device is composed by refractory brick thermal storage device 148, firebrick 149, a molten salt heat exchanger 150, a solid state thermal storage power supply 151, electric heating device 152, a molten salt circulating pump 153, a first molten salt or phase change material interface 154, a second molten salt or phase change material interface 155, a high temperature insulation material 156 and an external insulation and protective layer of solid sensible heat storage device 185. Using the refractory brick thermal storage device 148 to store heat at higher temperatures than molten salt, in order to increase energy storage capacity.

During operation, the solid state sensible heat storage device 148 stores heat at ultra-high temperatures around 1000° C. to 1250° C. Through the molten salt or phase change molten salt circulating pump 153, the molten salt or phase change material is circulated via the first molten salt or phase change material interface 154, transferring heat to the molten salt 13 inside the molten salt thermal storage inner shell 12, raising the temperature to about 900° C. The heated molten salt or phase change material then circulates through the second molten salt or phase change material interface 155 into the molten salt or phase change material heat exchanger 150, where it is further heated by the solid electric heating device 152 through the heat exchanger 150. The cycle is then repeated by the molten salt or phase change material circulating pump 153, enabling ultra-high temperature heating operation.

The temperature of the electric heating tube should not be too high, or the heating wire may vaporize. FIGS. 16A-16C shows the same system as in FIGS. 8A and 8B, except for the solid state sensible heat storage device 148, which is not repeated.

Figure 17A:
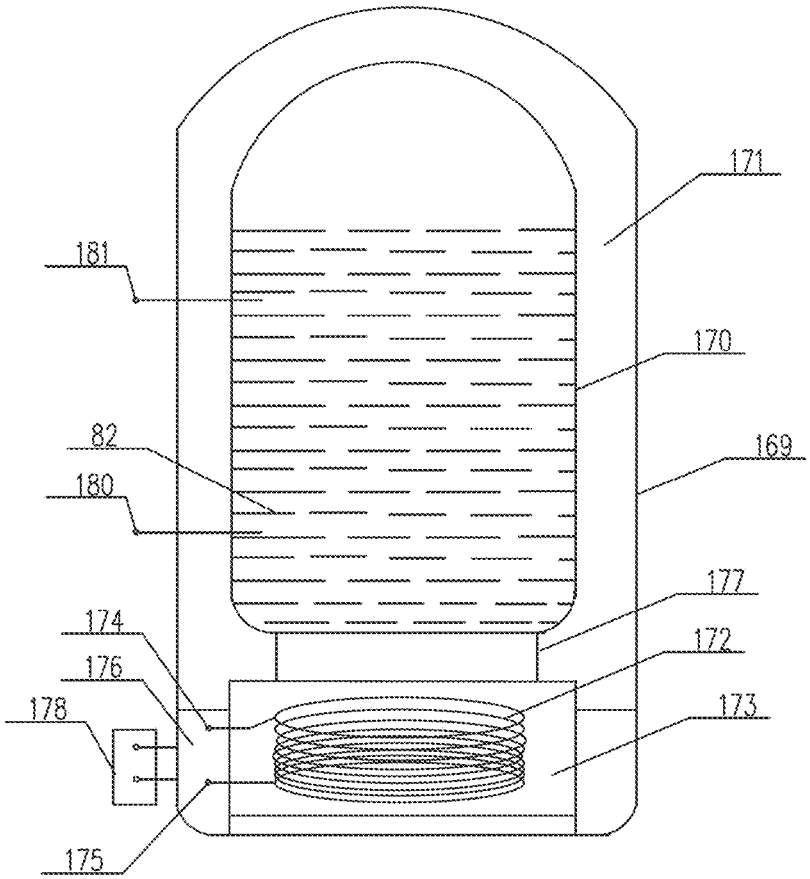
FIG. 17A is a schematic structural diagram of an electromagnetic current heating thermal conductive oil storage device according to a embodiment of the present disclosure.
Figure 17B:
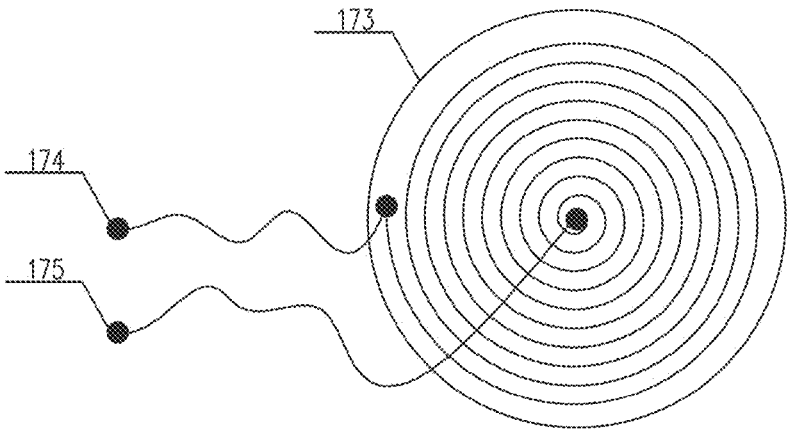
FIG. 17B is a schematic structural diagram of an electromagnetic induction coil according to another embodiment of the present disclosure.
Figure 17C:
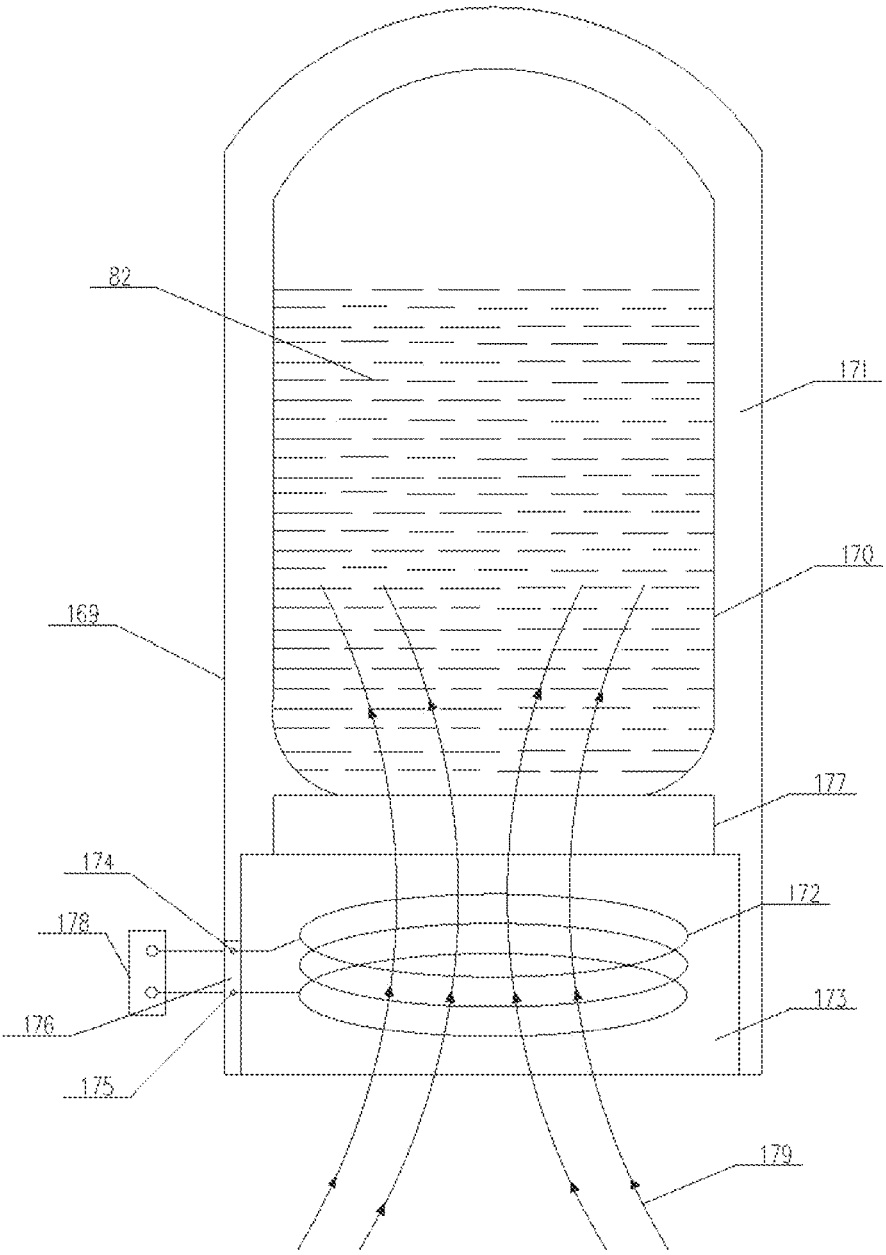
FIG. 17C is a schematic structural diagram of an electromagnetic current heating thermal conductive oil storage device according to another embodiment of the present disclosure.
Figure 17D:
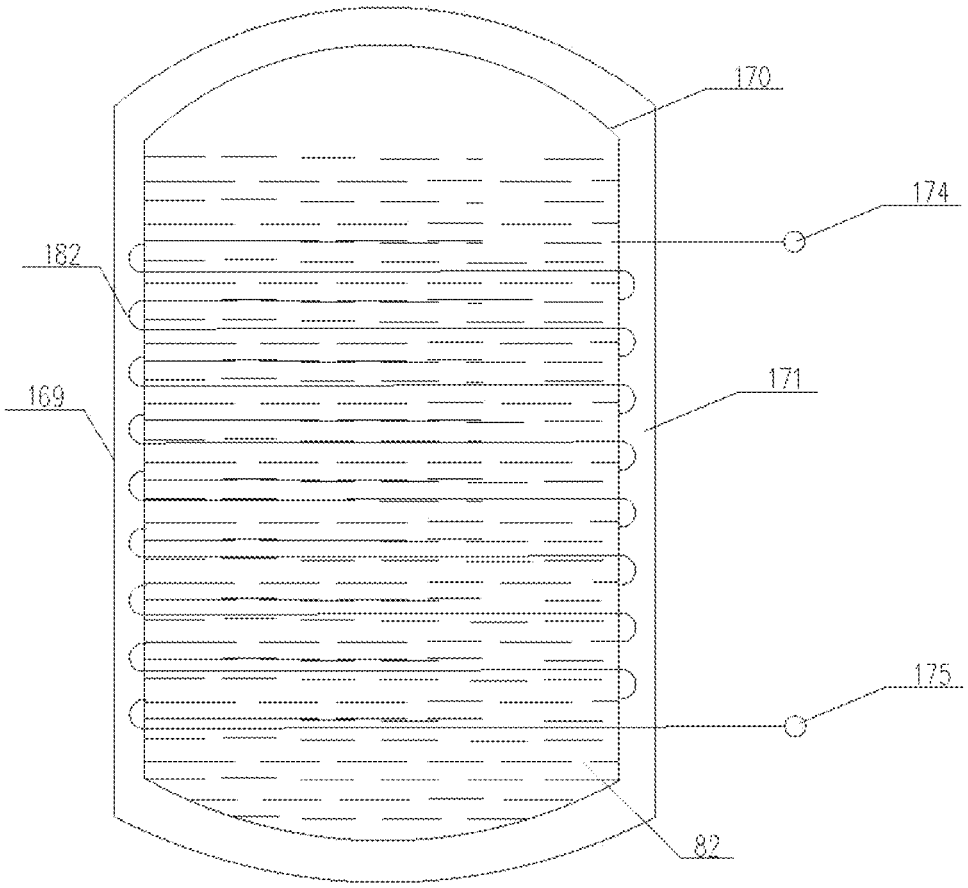
FIG. 17D is a schematic structural diagram of an electromagnetic current heating thermal conductive oil storage device according to another embodiment of the present disclosure.

FIG. 17A is a schematic structural diagram of an electromagnetic current heating thermal conductive oil storage device according to a embodiment of the present disclosure. FIG. 17B is a schematic structural diagram of an electromagnetic induction coil according to another embodiment of the present disclosure. FIG. 17C is a schematic structural diagram of an electromagnetic current heating thermal conductive oil storage device according to another embodiment of the present disclosure. FIG. 17D is a schematic structural diagram of an electromagnetic current heating thermal conductive oil storage device according to another embodiment of the present disclosure.

As shown in FIG. 7A, the thermal conductive oil thermal storage device 8 includes an electromagnetic thermal storage outer shell 169, an electromagnetic thermal storage internal shell 170, electromagnetic vacuum or/and high temperature insulation material 171, an electromagnetic induction disk induction coil 172, an electromagnetic induction coil 173, an coil connector 175, a high frequency power distribution control device 176, a ceramic insulation 177, an electromagnetic thermal storage power supply 178, a magnetic wire 179, a first electromagnetic thermal conductive oil output interface 180, a second electromagnetic thermal conductive oil output interface 181, and an electromagnetic thermal storage internal shell electromagnetic induction coil 182.

FIGS. 7A and 7B relate to the electromagnetic induction coil 173, different with that of electric heating tube, the electromagnetic induction coil 173 is positioned beneath the electromagnetic thermal storage inner shell 170. The electromagnetic induction coil 173 has an induction coil 172, and the high frequency power distribution control device 176 supplies high-frequency current to the induction coil 172. When the induction coil 172 is supplied with high-frequency current, a high-frequency magnetic field is generated around the electromagnetic induction coil 173. The high-frequency magnetic field produced by the electromagnetic induction forms numerous magnetic wires 179. When these magnetic wire 179 pass through the iron bottom plate of the electromagnetic thermal storage inner shell 170, electromagnetic eddy currents are generated in the bottom plate of the electromagnetic thermal storage inner shell 170. These eddy currents cause the bottom plate of the electromagnetic thermal storage inner shell 170 to heat up, thereby heating the thermal conductive oil inside the electromagnetic thermal storage inner shell 170. FIG. 17D shows an electromagnetic thermal storage internal shell electromagnetic induction coil 182 wound around the cylindrical body of the electromagnetic thermal storage internal shell 170, allowing the magnetic wires 179 to pass through the cylindrical body of the electromagnetic thermal storage internal shell 170, creating eddy currents and heating the cylindrical body of the electromagnetic thermal storage internal shell 170. FIGS. 17A-17D is characterized by the separation of the heating device from the thermal conductive oil, enhancing safety.

Figure 18A:
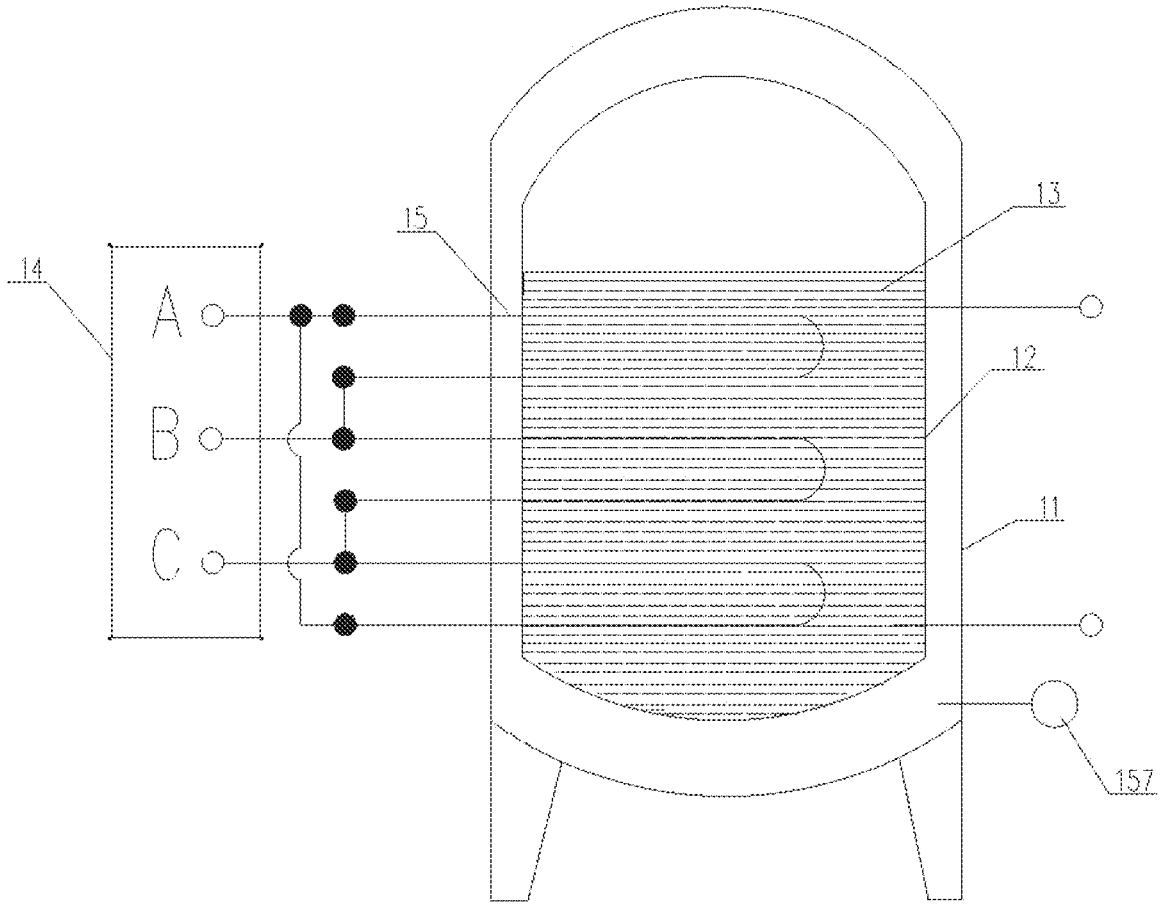
FIG. 18A is a schematic structural diagram of the molten salt thermal storage device according to another embodiment of the present disclosure.

FIGS. 18A-18D are schematic structural diagrams of the molten salt thermal storage device according to embodiments of the present disclosure. FIG. 18A shows the thermal insulation method where a vacuum insulation state 157 is created between the molten salt thermal storage outer shell 11 and the molten salt thermal storage inner shell 12, or the composite dual insulation structure is located between the molten salt thermal storage outer shell 97 and the molten salt thermal storage inner shell 98, or the composite dual insulation structure is located between the single-phase power molten salt thermal storage outer shell 140 and the single-phase power molten salt thermal storage inner shell 141. This utilizes the principle of vacuum insulation to achieve thermal insulation.

Figure 18B:
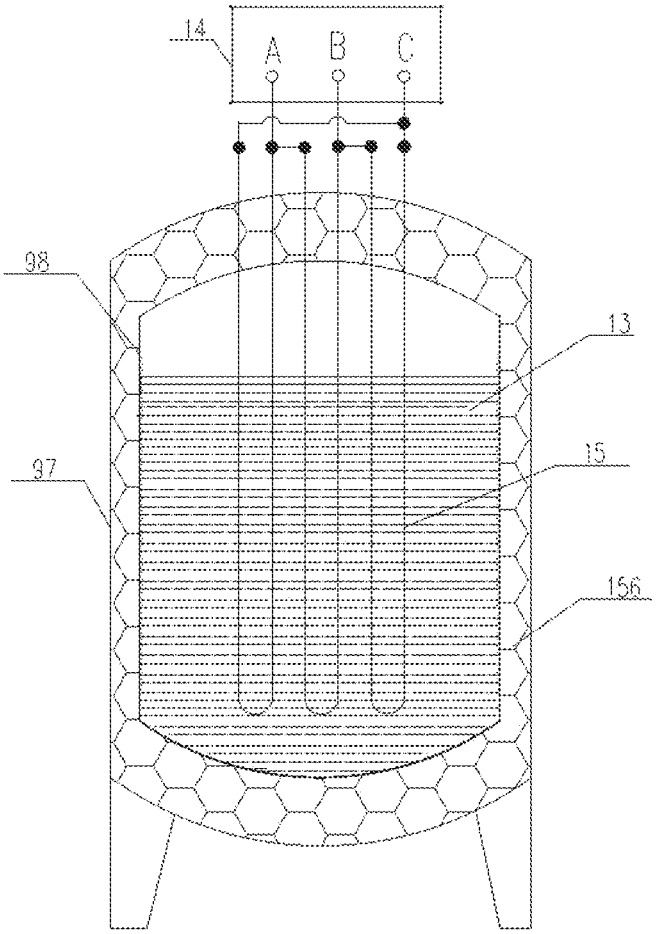
FIG. 18B is a schematic structural diagram of the molten salt thermal storage device according to another embodiment of the present disclosure.

FIG. 18B shows that high-temperature thermal insulation material 156 is filled between the composite dual insulation structure is located between the molten salt thermal storage outer shell 11 and the molten salt thermal storage inner shell 12, or the composite dual insulation structure is located between the molten salt thermal storage outer shell 97 and the molten salt thermal storage inner shell 98, or the composite dual insulation structure is located between the single-phase power molten salt thermal storage outer shell 140 and the single-phase power molten salt thermal storage inner shell 141, utilizing the high-temperature insulation material 156 to achieve thermal insulation.

Figure 18C:
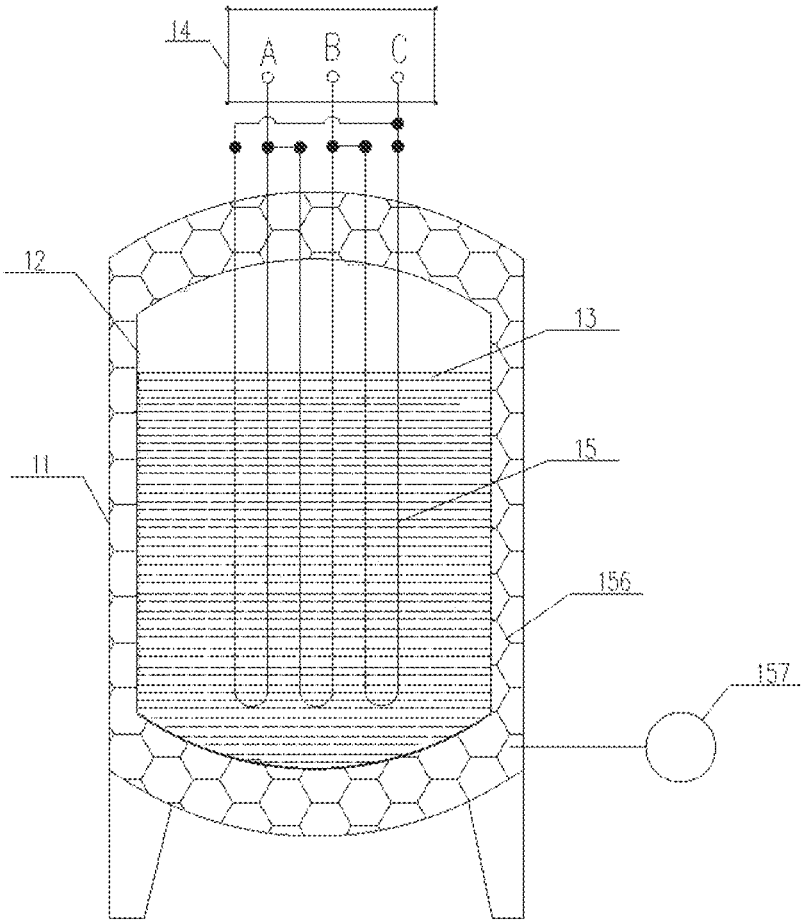
FIG. 18C is a schematic structural diagram of the molten salt thermal storage device according to another embodiment of the present disclosure.
Figure 18D:
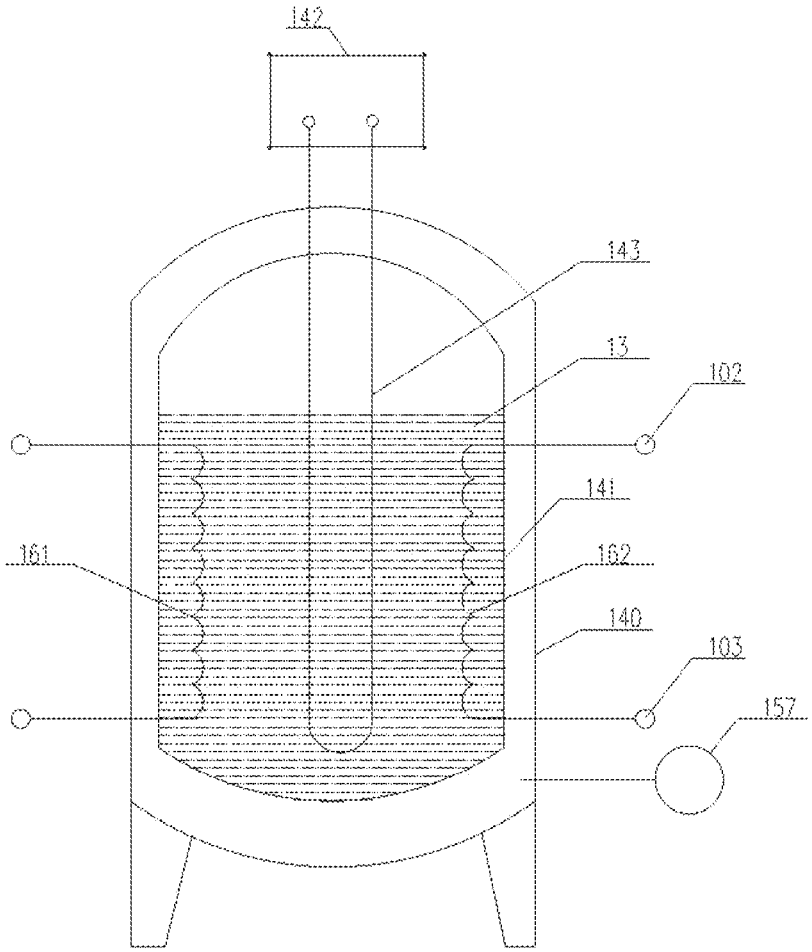
FIG. 18D is a schematic structural diagram of the molten salt thermal storage device according to another embodiment of the present disclosure.

FIG. 18C illustrates that high-temperature thermal insulation material 156 is filled between the molten salt thermal storage outer shell 11 and the molten salt thermal storage inner shell 12, or the composite dual insulation structure is located between the molten salt thermal storage outer shell 97 and the molten salt thermal storage inner shell 98, or the composite dual insulation structure is located between the single-phase power molten salt thermal storage outer shell 140 and the single-phase power molten salt thermal storage inner shell 141, and then the space is evacuated to create the vacuum insulation state 157. This method not only achieves thermal insulation with the high-temperature insulation material 156 but also enhances the thermal stability and strength of the molten salt thermal storage outer shell 11, the molten salt thermal storage outer shell 97, single-phase power molten salt thermal storage outer shell 140 and the molten salt thermal storage inner shell 12, molten salt thermal storage inner shell 98, single-phase power molten salt thermal storage inner shell 141. The vacuum insulation state 157 further increases the insulation effect. FIG. 18D shows a single-phase electric power-supplied molten salt thermal storage heat exchanger insulation structure.

Figure 19A:
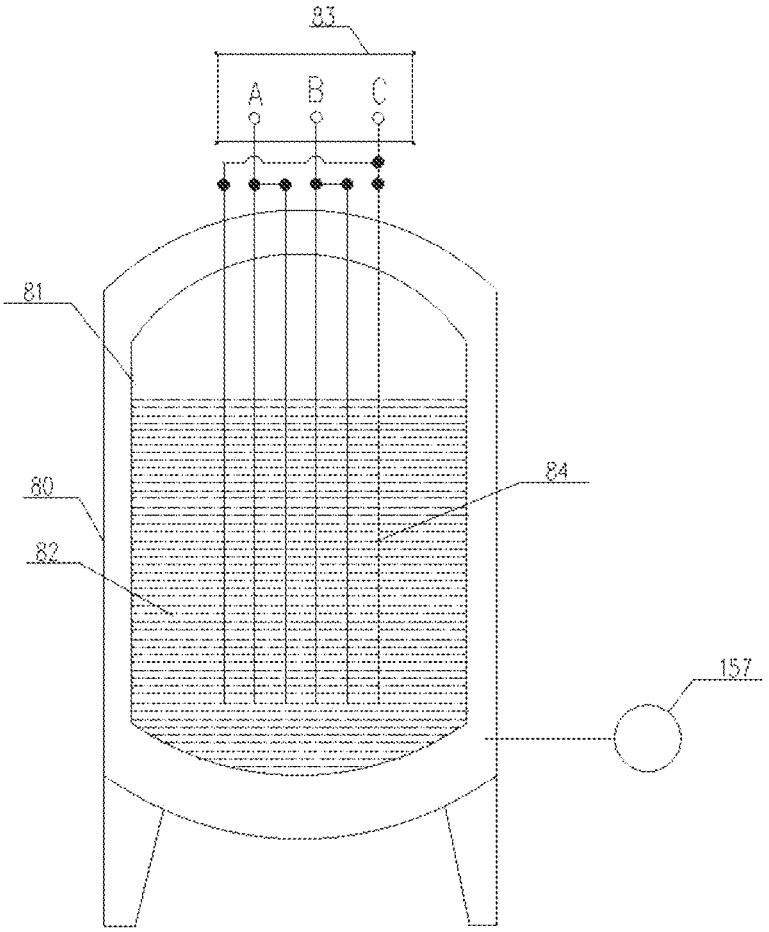
FIG. 19A is a schematic structural diagram of the thermal conductive oil thermal storage and heat transfer device according to another embodiment of the present disclosure.

FIG. 19A depicts an embodiment of the heat storage device structure using thermal conductive oil. In FIGS. 19A-19E, the vacuum insulation state 157 is created between the thermal conductive oil storage heat external shell 80 and the thermal conductive oil storage inner housing 81, or the composite dual insulation structure is located between the thermal conductive oil heat storing and exchanging outer shell 89 and the thermal conductive oil heat storing and exchanging internal shell 90, or the composite dual insulation structure is located between a single phase conductive hot oil heat storing and exchanging outer shell 158 and a single phase conductive hot oil heat storing and exchanging inner shell 159, utilizing the principle of vacuum insulation to achieve thermal insulation.

Figure 19B:
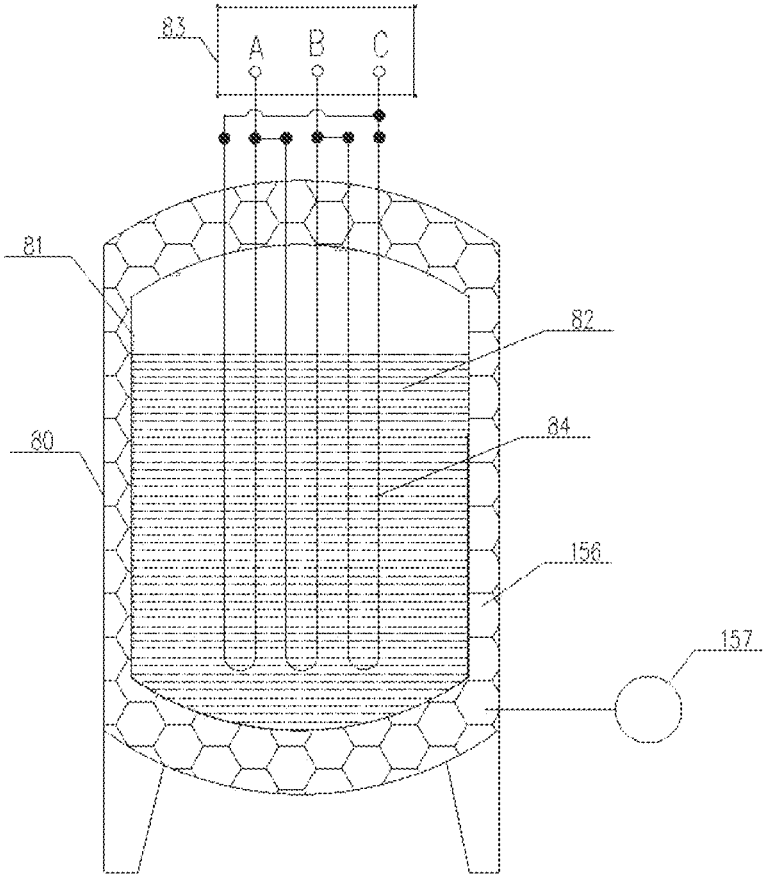
FIG. 19B is a schematic structural diagram of the thermal conductive oil thermal storage and heat transfer device according to another embodiment of the present disclosure.

FIG. 19B shows high-temperature thermal insulation material 156 being filled between the thermal conductive oil storage heat external shell 80 and the thermal conductive oil storage inner housing 81, or the composite dual insulation structure is located between the thermal conductive oil heat storing and exchanging outer shell 89 and the thermal conductive oil heat storing and exchanging internal shell 90, or the composite dual insulation structure is located between a single phase conductive hot oil heat storing and exchanging outer shell 158 and a single phase conductive hot oil heat storing and exchanging inner shell 159. This method not only uses the high-temperature thermal insulation material 156 for thermal insulation but also enhances the thermal stability and strength between the molten salt thermal storage outer shell 11, the molten salt thermal storage outer shell 97, the single-phase power molten salt thermal storage outer shell 140 and the molten salt thermal storage inner shell 12, the molten salt thermal storage inner shell 98, single-phase power molten salt thermal storage inner shell 141 of the molten salt thermal storage. The vacuum insulation state 157 further improves the thermal insulation effect.

Figure 19C:
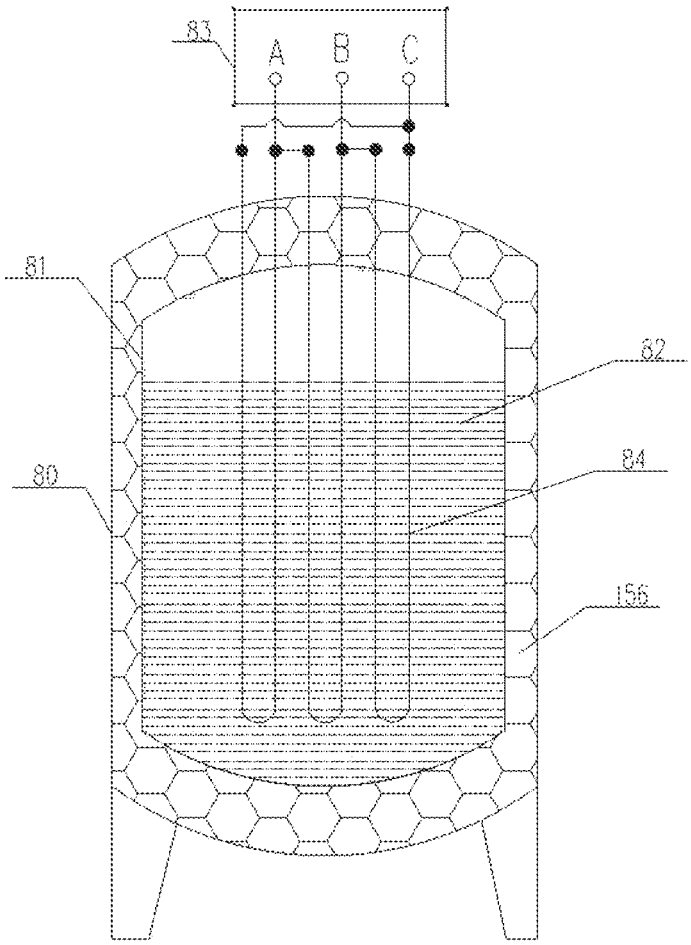
FIG. 19C is a schematic structural diagram of the thermal conductive oil thermal storage and heat transfer device according to another embodiment of the present disclosure.
Figure 19D:
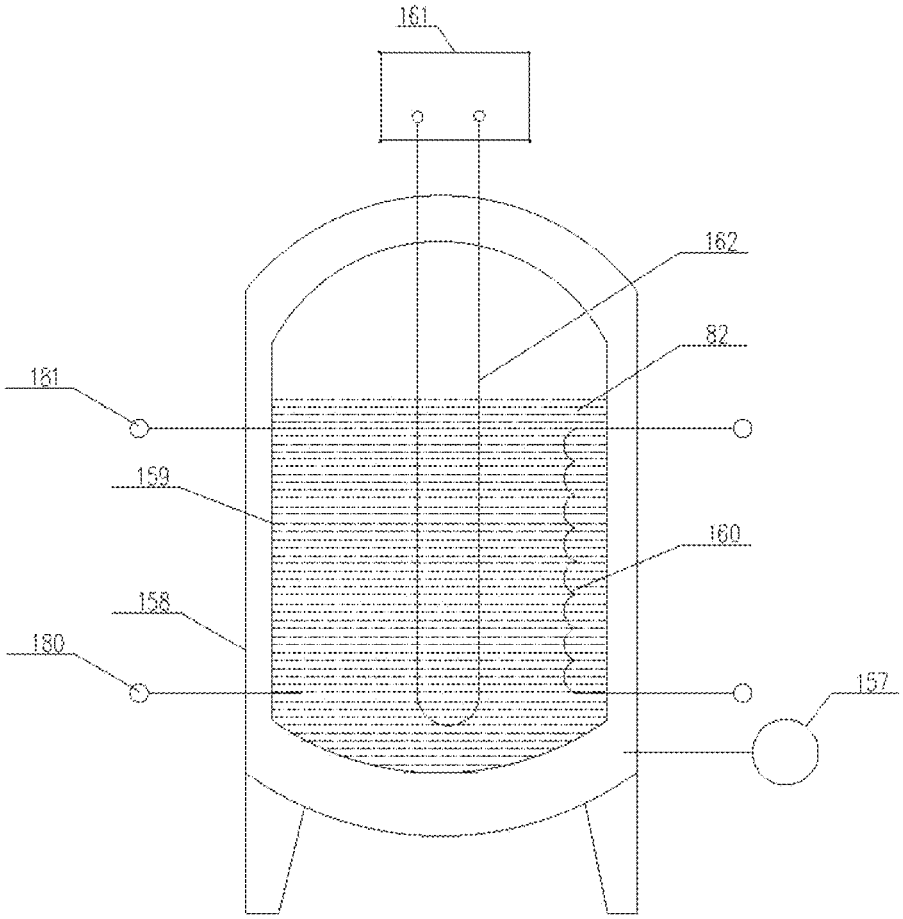
FIG. 19D is a schematic structural diagram of the thermal conductive oil thermal storage and heat transfer device according to another embodiment of the present disclosure.
Figure 19E:
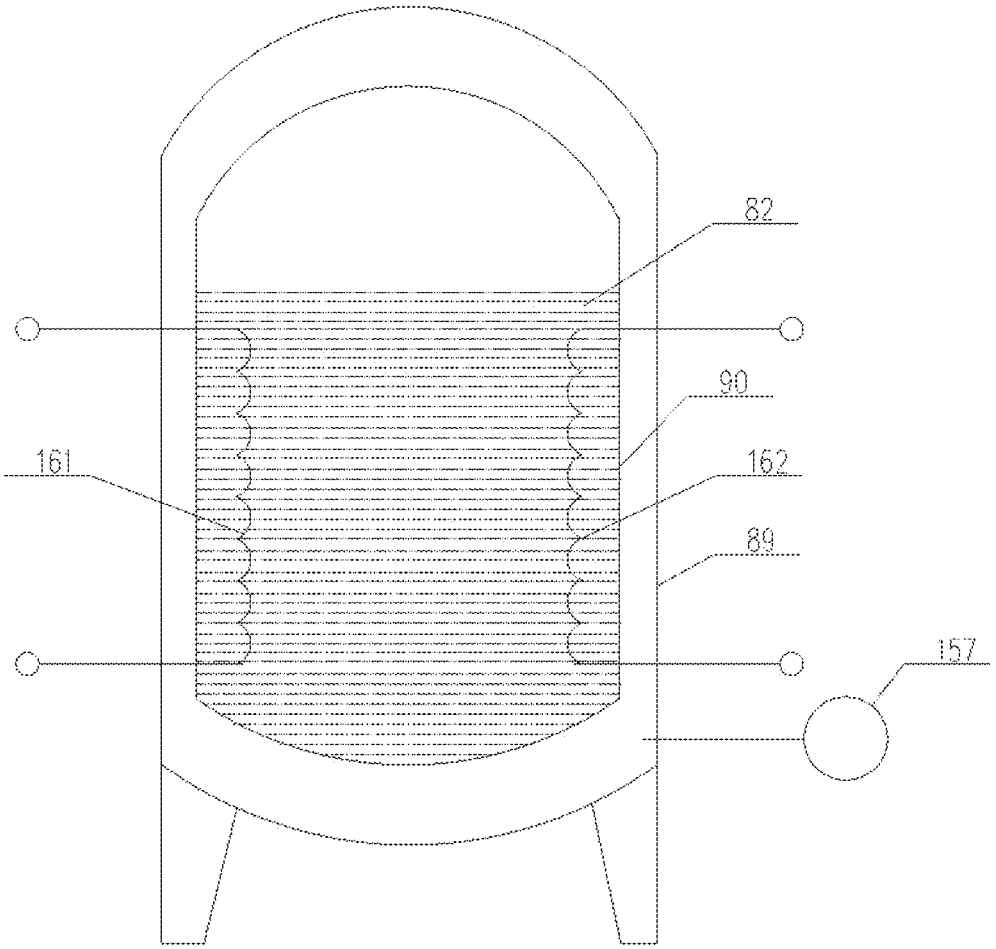
FIG. 19E is a schematic structural diagram of the thermal conductive oil thermal storage and heat transfer device according to another embodiment of the present disclosure.

FIG. 19C shows high-temperature thermal insulation material 156 being filled between the thermal conductive oil storage heat external shell 80 and the thermal conductive oil storage inner housing 81, or the composite dual insulation structure is located between the thermal conductive oil heat storing and exchanging outer shell 89 and the thermal conductive oil heat storing and exchanging internal shell 90, or the composite dual insulation structure is located between a single phase conductive hot oil heat storing and exchanging outer shell 158 and a single phase conductive hot oil heat storing and exchanging inner shell 159, using the high-temperature insulation material 156 to achieve thermal insulation. FIG. 19D illustrates a single-phase electric power-supplied thermal conductive oil storage heat exchanger insulation structure. FIG. 19E shows a schematic diagram of the thermal conductive oil heat exchanger structure.

In summary, the present disclosure offers the following advantages over the existing technologies.

The beneficial effect of this disclosure lies in the use of a summer heat storage and cooling-based energy storage system, which can be widely applied in building central air conditioning systems as an energy storage-based central air conditioning system. The system offers a large energy storage capacity, and the energy storage market extends throughout the entire country.

Another advantage of this disclosure is that the heat storage efficiency reaches 96%, and the stored energy is directly sold to central air conditioning system users. This not only contributes to grid energy storage but also provides users with significant energy savings. It avoids the economically inefficient storage methods like pumped hydro storage and compressed air storage.

This application is also ideal for storing wind and photovoltaic green electricity. Compared to battery storage, air compressor storage, and pumped hydro storage, it offers safety, high efficiency, energy savings, and a low one-time investment. With the current limitations on energy storage for wind and photovoltaic power generation, the heat storage absorption chiller is an excellent option for an all-weather energy storage device.

A further beneficial effect of this application is its alignment with the Montreal Protocol, which aims to limit and phase out refrigerants that contribute to the depletion of the ozone layer and the greenhouse effect. The absorption chiller used in this system does not rely on ozone-depleting refrigerants; instead, water serves as the refrigerant, and lithium bromide is the absorbent.

It should be noted that the above embodiments are only intended to illustrate the technical solutions of this application, and are not intended to limit them. Although the application has been described in detail with reference to the above embodiments, those skilled in the art should understand that they may still modify the technical solutions described in the previous embodiments, or make equivalent substitutions for part or all of the technical features. Such modifications or substitutions do not change the essence of the corresponding technical solutions or extend beyond the scope of the technical solutions as defined in the embodiments of this application.

What is claimed is:

1. A thermal storage absorption refrigeration unit, comprising a thermal storage device and an absorption refrigerating machine; wherein an output end of the thermal storage device is connected to an input end of the absorption refrigerating machine;

wherein the thermal storage device comprises a phase change thermal storage device or a sensible thermal storage device; wherein the phase change thermal storage device is a molten salt thermal storage device or a metal phase change thermal storage device; and the sensible thermal storage device is a high temperature refractory or a refractory brick thermal storage device or a thermal conductive oil thermal storage device;

wherein the thermal storage device is a molten salt thermal storage device, and the absorption refrigerating machine is a lithium bromide absorption refrigerating machine; wherein the molten salt thermal storage device comprises a molten salt thermal storage outer shell, a molten salt thermal storage inner shell, molten salt, a power supply, an electric heating device, and a molten salt circulating pump; and the molten salt is disposed in the molten salt thermal storage inner shell and the electric heating device is disposed in the molten salt; and the lithium bromide absorption refrigerating machine comprises an upper cylinder and a lower cylinder; and the upper cylinder comprises a condenser, a generator, and lithium bromide solution; the lithium bromide solution is provided within the upper cylinder and the generator is immersed in the lithium bromide solution, the condenser is located above the generator, the condenser is set below a water collecting tray; and one end of the molten salt circulating pump is connected with the molten salt thermal storage shell and connected with the molten salt, another end of the molten salt circulating pump is connected with one end of the generator, another end of the generator is connected with the molten salt thermal storage inner shell and connected with the molten salt; and the lower cylinder comprises an evaporator, a refrigerant pump, a spraying device, a solution spraying device, an absorber, lithium bromide solution, a solution purification pump, a solution spraying pump, a concentrate storage cylinder, concentrate, a concentrated liquid discharge pipe and a solution heat exchanger; and the evaporator is set below a water collecting tray, the water collecting tray is located above the absorber, the solution spraying device is set above the absorber, and the absorber is provided above the lithium bromide solution; and one end of the refrigerant pump is connected to the water collecting tray, another end of the refrigerant pump is connected to the spraying device, and the spraying device is located above the evaporator; and one end of the solution purification pump is connected to a lower end of the lower cylinder, and communicated with the lithium bromide solution, another end of the solution spraying pump is connected to a lower end of the upper cylinder through a primary side of the solution heat exchanger, and communicated with the lithium bromide solution, one end of the solution spraying pump is connected to the lower end of the lower cylinder, and communicated with the lithium bromide solution, another end of the solution spraying pump is connected to the solution spraying device, one end of the secondary side of the solution heat exchanger is connected to the lower part of the upper cylinder, and communicated with the lithium bromide solution, another end of the secondary side of the solution heat exchanger is connected to the concentrate storage cylinder, and communicated with the concentrated lithium bromide solution in the concentrate storage cylinder.

2. The thermal storage absorption refrigerating unit of claim 1, wherein the absorption refrigerating machine is a lithium bromide absorption refrigerating machine, an ammonia absorption refrigerating machine or a steam jet refrigerating machine.

3. A thermal storage absorption refrigerating unit, comprising a thermal storage device and an absorption refrigerating machine; wherein an output end of the thermal storage device is connected to an input end of the absorption refrigerating machine; wherein the thermal storage device comprises a phase change thermal storage device and a sensible thermal storage device; wherein, the absorption refrigerating machine is a absorption refrigerating machine and the absorption refrigerating machine comprises a lithium bromide absorption refrigerating machine; the phase change thermal storage device is a molten salt thermal storage device, the molten salt thermal storage device comprises a molten salt thermal storage outer shell, a molten salt thermal storage inner shell, a molten salt, a power supply, an electric heating device, a molten salt heat exchanger, a molten salt heat circulating pump; the molten salt heat exchanger is set in the molten salt; and wherein the sensible thermal storage device is a thermal conductive oil thermal storage device, the thermal conductive oil thermal storage device comprises a thermal conductive oil heat storing and exchanging outer shell, a thermal conductive oil heat storing and exchanging internal shell, the thermal conductive oil, thermal conductive oil heat circulating pump, the thermal conductive oil configured in the thermal conductive oil heat storing and exchanging internal shell; and one end of the molten salt heat changing and circulating pump is connected to the thermal conductive oil heat storing and exchanging internal shell and connected with the heat conductive oil, another end of the molten salt heat changing and circulating pump is connected to an end of the molten salt heat exchanger, another end of the molten salt heat exchanger is connected to the thermal conductive oil heat storing and exchanging internal shell and connected with the heat conductive oil; one end of the thermal conductive oil heat circulating pump is connected to the thermal conductive oil heat storing and exchanging internal shell and communicated with the thermal conductive oil, another end of the thermal conductive oil heat circulating pump is connected to an end of the generator, another end of the generator is connected with the thermal conductive oil heat storing and exchanging internal shell and communicated with the thermal conductive oil.

4. The thermal storage absorption refrigerating unit of claim 3, wherein the thermal storage absorption refrigerating machine is equipped with a two-stage molten salt thermal storage device, a thermal conductive oil storage and heat transfer device and an absorption lithium bromide refrigerating machine;

wherein, a first-stage of molten salt thermal storage device comprises the molten salt thermal storage outer shell, the molten salt thermal storage inner shell, the molten salt, the power supply, the electric heating device, and the molten salt circulating pump; the second-stage of molten salt thermal storage device comprises a molten salt thermal storage outer shell, a molten salt thermal storage inner shell, the molten salt, the electric heating device, the power supply, the molten salt heat exchanger, the molten salt heat circulating pump; the thermal conductive oil storage and heat transfer device comprises the thermal conductive oil heat storing and exchanging outer shell, the thermal conductive oil heat storing and exchanging internal shell, the thermal conductive oil, and the thermal conductive oil heat circulating pump; and one end of the molten salt circulating pump is connected to the molten salt thermal storage inner shell and communicated with the molten salt, another end of the molten salt circulating pump is connected to the molten salt heat inner shell and communicated with the molten salt; and the molten salt thermal storage internal shell is connected to the molten salt thermal storage inner shell and communicated with the molten salt of the two-stage molten salt thermal storage device;one end of the molten salt heat changing and circulating pump is connected to the thermal conductive oil heat storing and exchanging internal shell and connected to the heat conductive oil, another end of the molten salt heat circulating pump is connected to one end of the molten salt exchanger and another end of the molten salt exchanger is connected to the thermal conductive oil heat storing and exchanging internal shell and connected to the heat conductive oil; one end of the thermal conductive oil heat circulating pump is connected with the thermal conductive oil heat storing and exchanging internal shell and communicated with the thermal conductive oil, another end of the thermal conductive oil heat circulating pump is connected to one end of the generator and another end of the generator is connected to the thermal conductive oil heat storing and exchanging internal shell and communicated with the thermal conductive oil.

5. The thermal storage absorption refrigerating unit of claim 4, wherein the thermal storage absorption refrigerating machine is equipped with the phase change thermal storage device, the sensible thermal storage device, and a dual-effect lithium bromide absorption refrigerating machine;

and the phase change thermal storage device comprises the molten salt thermal storage device, the molten salt thermal storage device comprises the molten salt thermal storage outer shell, the molten salt thermal storage inner shell, the molten salt, the power supply, the electric heating device, the molten salt heat exchanger, the molten salt heat circulating pump, the molten salt heat exchanger is set in the molten salt; and the thermal storage device comprises a thermal conductive oil thermal storage device, the thermal conductive oil heat transfer device comprises thermal conductive oil heat storing and exchanging outer shell, the thermal conductive oil heat storing and exchanging internal shell, the thermal conductive oil, the thermal conductive oil heat circulating pump, the thermal conductive oil is stored in the thermal conductive oil heat storing and exchanging internal shell; and a three-cylinder dual-effect lithium bromide absorption refrigerating machine comprises a high temperature generator, a low temperature generator and the lower cylinder; and the high temperature generator cylinder comprises a high temperature generator, high temperature lithium bromide solution, a high temperature heat exchanger, a high temperature dilution returning port, and a high temperature solution heat exchanger; and the low temperature generator cylinder comprises the condenser, a low temperature lithium bromide solution, a low temperature generator, a low temperature dilution returning port, and a low temperature solution heat exchanger; and the lower cylinder comprises the spraying device, the evaporator, the refrigerant pump, a solution spraying device, the absorber, the lithium bromide solution, and a lithium bromide solution spraying pump; and one end of the molten salt heat changing and circulating pump is connected to the thermal conductive oil heat storing and exchanging internal shell and connected with the heat conductive oil, another end of the molten salt heat changing and circulating pump is connected to one end of the molten salt exchanger, and another end of the molten salt exchanger is connected to the thermal conductive oil heat storing and exchanging internal shell and communicated with the heat conductive oil; and one end of the thermal conductive oil heat transfer pump is connected with the thermal conductive oil heat storing and exchanging internal shell and communicated with the thermal conductive oil, another end of the heat conduction oil heat transfer pump is connected to one end of the high temperature generator, and another end of the high temperature generator is connected with the thermal conductive oil heat storing and exchanging internal shell and communicated with the thermal conductive oil; and one end of the lithium bromide solution spraying pump is connected to the lower cylinder, and communicated with the described lithium bromide solution; a first route at another end of the lithium bromide solution spraying pump is connected to the solution spraying device through the concentrate storage cylinder, and a second route is connected with a primary heat exchanging side of the high temperature heat exchanger through the first heat exchange side of the low temperature solution heat exchanger, another end of the heat exchanger is connected to the low temperature dilution returning port;

and a third route is connected to the high temperature solution heat exchanger and the high temperature dilution heat returning port through a secondary heat exchanging side of the low temperature solution heat exchanger.

6. The thermal storage and absorption refrigerating unit of according to claim 5, wherein a two-stage molten salt heat storing device, a thermal conductive oil storage and heat transfer steam device, and a steam dual-effect lithium bromide absorption refrigerating machine are provided; the two-stage molten salt heat storing device comprises the molten salt heat shell, the molten salt thermal storage inner shell, the molten salt, the power power, the electric heating device, the molten salt circulating pump, the molten salt thermal storage outer shell, the molten salt thermal storage inner shell, a molten salt heat exchanger, and a molten salt heat exchanging and circulating pump; and the heat conduction oil storage and heat transfer steam device comprises the thermal conductive oil storage and heat transfer steam shell, the thermal conductive oil storage and heat transfer steam shell, the thermal conductive oil, the thermal conductive oil steam generator, the water pump, the steam storage tank outer shell, the steam tank inner shell, the steam, and the valve; and the steam dual-effect lithium bromide absorption refrigerating machine comprises high temperature generator cylinder, the low temperature cylinder, the lower cylinder; and the high temperature cylinder comprises the high temperature generator, the high temperature heat exchanger; and the low temperature cylinder comprises the low temperature generator, the condenser, the lithium bromide solution spraying pump, the high temperature solution heat exchanger, and the low temperature solution heat exchanger; one end of the molten salt heat changing and circulating pump is connected with the thermal conductive oil storage and heat transfer steam shell and communicated with the thermal conductive oil, another end of the molten salt heat changing and circulating pump is connected to one end of the molten salt exchanger and another end of the molten salt exchanger is connected with the thermal conductive oil storage and heat transfer steam shell and communicated with the thermal conductive oil; one end of the lithium bromide solution spraying pump is connected to the lower cylinder, and communicated with the diluted lithium bromide solution, another end of the lithium bromide solution spraying pump is output in three routes, a first route is connected to the solution spraying device through the concentrate storage cylinder, a second route is connected to one end of the high temperature heat exchanger by the low temperature solution heat exchanger, another end of the high temperature heat exchanger communicates with the low temperature dilution returning port of the low temperature generating cylinder; and a third route connects one end of the high temperature heat exchanger through another side of the low temperature solution heat exchanger, another end of the high temperature heat exchanger connects the drain port of diluted lithium bromide solution, and communicated with the high temperature generating cylinder; one end of the valve is connected to the steam tank inner shell and communicated with the steam, another end of the valve is connected to one end of the high temperature generator and another end of the high temperature generator is communicated with the condensate water.

7. The thermal storage absorption refrigerating unit of claim 6, wherein the two-stage molten salt thermal storage device, the thermal conductive oil storage and heat transfer device, and a direct fired lithium bromide absorption refrigerating machine are provided; wherein, the first-stage of molten salt thermal storage device comprises the molten salt thermal storage outer shell, the molten salt thermal storage inner shell, the molten salt, the power supply, the electric heating device, the molten salt circulating pump; and the second-stage of molten salt thermal storage device comprises the molten salt thermal storage outer shell, the molten salt thermal storage inner shell, the molten salt, the power supply, the electric heating device, the molten salt heat exchanger, and the molten salt heat circulating pump; and the thermal conductive oil storage heat exchange device comprises the thermal conductive oil storage heat exchanging outer shell, the thermal conductive oil heat storing and exchanging internal shell, the thermal conductive oil, and the thermal conductive oil heat circulating pump; and the direct combustion lithium bromide absorption refrigerating machine is equipped with a high temperature generator, the high temperature lithium bromide solution; the high temperature generator is set in the high temperature lithium bromide solution of an original lithium bromide direct fired furnace body; the end of high temperature generator is connected to the thermal conductive oil heat storing and exchanging internal shell through the heat exchanging pump, and communicated with the heat conduction oil; another end of the high temperature generator is connected to the thermal conductive oil heat storing and exchanging internal shell and communicated with the heat conduction oil.

8. The thermal storage and absorption refrigerating unit of claim 7, wherein the two-stage molten salt thermal storage device, the thermal conductive oil thermal storage and heat transfer device, and a heat collecting and supplying system are provided; wherein, the heat collecting and supplying system comprises a hot water exchanging outer tank, a hot water exchanging inner tank, hot water, a hot water exchanger, a heat collecting and supplying circulating pump, a radiator or a underfloor heating pipe or a fan coil, and/or a domestic hot water heat exchanger, and a shower head; and one end of the hot water heat exchanger is connected with the thermal conductive oil heat storing and exchanging internal shell through the heat conduction oil heat circulating pump and communicated with the heat conduction oil; one end of the heat collecting and supplying heating circulating pump is connected to the hot water exchanging inner tank and communicated with the hot water, another end of the heat collecting and supplying heating circulating pump is connected to an end of the radiator or the underfloor heating pipe or the fan coil and/or of the domestic hot water heat exchanger; and another end of the radiator or the underfloor heating pipe or the fan coil, and/or the domestic hot water heat exchanger is connected to the hot water exchanging tank box, and comunicated with the hot water; the shower head is connected to a tap water interface by the domestic hot water heat exchanger.

9. The thermal storage absorption refrigerating unit of claim 8 wherein the single-phase power supply molten salt thermal storage, the thermal conductive oil storage and heat transfer device, the lithium bromide absorption refrigerating machine, and heat collecting and supplying system are provided; and wherein, the oil thermal storage and heat transfer devices comprise a single-phase power molten salt thermal storage outer shell, a single-phase power molten salt thermal storage outer shell, a single-phase power supply, an electric heating device, a molten salt pump, the molten salt output heat exchanger,the molten salt output heat circulating pump, the thermal conductive oil heat storing and exchanging outer shell, the thermal conductive oil heat storing and exchanging internal shell, the thermal conductive oil, the thermal conductive oil heat circulating pump, a first winter/summer conversion valve, a second winter/summer conversion valve, a third winter/summer conversion valve, and a fourth winter/summer conversion valve; and one end of the molten salt output heat exchanger is connected to the thermal conductive oil heat storing and exchanging internal shell and communicated with the thermal conductive oil, another end of the molten salt output heat exchanger is connected to the thermal conductive oil heat storing and exchanging internal shell and communicated to the thermal conductive oil; one end of the thermal conductive oil heat circulating pump is connected to the thermal conductive oil heat storing and exchanging internal shell, and communicated with the thermal conductive oil; another end of the thermal conductive oil heat circulating pump is connected to ends of the second winter/summer conversion valve and the fourth winter/summer conversion valve, respectively; and another end of the second winter/summer switching valve is connected to one end of the hot water heat exchanger; and another end of the fourth winter/summer conversion valve is connected to one end of the high temperature generator; one end of the first winter/summer conversion valve is connected to the thermal conductive oil heat storing and exchanging internal shell, and communicated with the thermal conductive oil; another end of the first winter/summer conversion valve is connected to one end of the winter/summer valve, another end of the winter/summer conversion valve is connected to another end of the high temperature generator; and another end of the winter/summer conversion valve is also connected to another end of the hot water heat exchanger.

10. The thermal storage absorption refrigerating unit of claim 9, wherein the high temperature refractory or the refractory brick thermal storage device, and the two-stage molten salt thermal storage device, the thermal conductive oil storage and heat transfer device, and the lithium bromide refrigerating machine; wherein, the high temperature refractory material or the refractory brick thermal storage device comprises a solid state sensible heat storage device, refractory rick, molten salt heat transfer device, the solid state thermal storage power supply, the electric heating device, and the molten salt circulating pump; and the electric heating device is provided in the firebrick of the solid state sensible heat storage device, and the molten salt heat transfer device is set inside the firebrick; and one end of the molten salt circulating pump is connected to one end of the molten salt heat exchanger, another end of the molten salt circulating pump is connected to the molten salt thermal storage inner shell and communicated to the molten salt, another end of the molten salt heat exchanger is connected to the molten salt thermal storage inner shell and communicated to the molten salt.

11. The thermal storage absorption refrigerating unit of claim 3, wherein a composite dual insulation structure is formed by a vacuum insulation state and a high temperature insulation material; and the composite dual insulation structure is located between the molten salt thermal storage outer shell and the molten salt thermal storage inner shell, or the composite dual insulation structure is located between the molten salt thermal storage outer shell and the molten salt thermal storage inner shell, or the composite dual insulation structure is located between the single-phase power molten salt thermal storage outer shell and the single-phase power molten salt thermal storage inner shell.

12. The thermal storage absorption refrigerating unit of claim 5, wherein a composite dual insulation structure is formed by a vacuum insulation state and a high temperature insulation material; and the composite dual insulation structure is located between the thermal conductive oil storage heat external shell and the thermal conductive oil storage inner housing, or the composite dual insulation structure is located between the thermal conductive oil heat storing and exchanging outer shell and the thermal conductive oil heat storing and exchanging internal shell, or the composite dual insulation structure is located between a single phase conductive hot oil heat storing and exchanging outer shell and a single phase conductive hot oil heat storing and exchanging inner shell.

* * * * *